US008511048B2

(12) United States Patent
Smith

(10) Patent No.: US 8,511,048 B2
(45) Date of Patent: Aug. 20, 2013

(54) PACKAGING FORMING AND LOADING APPARATUS

(76) Inventor: Brenton L. Smith, Alexandria, MN (US)

( * ) Notice: Subject to any disclaimer, the term of this patent is extended or adjusted under 35 U.S.C. 154(b) by 245 days.

(21) Appl. No.: 12/825,074

(22) Filed: Jun. 28, 2010

(65) Prior Publication Data

US 2010/0326016 A1 Dec. 30, 2010

Related U.S. Application Data

(60) Provisional application No. 61/220,760, filed on Jun. 26, 2009, provisional application No. 61/220,916, filed on Jun. 26, 2009.

(51) Int. Cl.
*B65B 1/06* (2006.01)
*B65B 39/00* (2006.01)

(52) U.S. Cl.
USPC ..... 53/575; 53/255; 141/316; 193/2 R

(58) Field of Classification Search
USPC ..... 53/574, 575, 577, 241, 255, 527, 53/530; 141/316, 390, 391; 193/2 R, 17
See application file for complete search history.

(56) References Cited

U.S. PATENT DOCUMENTS

| | | | | | |
|---|---|---|---|---|---|
| 130,489 | A | * | 8/1872 | Crofoot | 141/391 |
| 339,656 | A | * | 4/1886 | Jackson | 193/2 R |
| 393,848 | A | * | 12/1888 | Nowvioch | 141/390 |
| 743,505 | A | * | 11/1903 | Hefner | 53/255 |
| 1,167,782 | A | * | 1/1916 | Richards | 141/390 |
| 1,313,491 | A | * | 8/1919 | Lazzell | 193/2 R |
| 1,971,064 | A | * | 8/1934 | Corlette et al. | 53/530 |
| 2,028,297 | A | * | 1/1936 | Stockdale | 141/391 |
| 2,084,711 | A | * | 6/1937 | Smith | 141/391 |
| 2,360,846 | A | | 10/1944 | Bronander | |
| 3,091,903 | A | * | 6/1963 | Kammerer | 141/316 |
| 3,479,975 | A | | 11/1969 | Ferdinand et al. | |
| 3,481,098 | A | | 12/1969 | Sherrill et al. | |
| 3,875,724 | A | | 4/1975 | Langen | |
| 3,979,920 | A | | 9/1976 | Burgess et al. | |
| 3,986,319 | A | | 10/1976 | Puskarz et al. | |

(Continued)

FOREIGN PATENT DOCUMENTS

| | | |
|---|---|---|
| CH | 437 101 | 5/1967 |

OTHER PUBLICATIONS

PCT/US2010/040231 search report and written opinion, (mailed Jan. 21, 2011); 15 pgs.

*Primary Examiner* — Stephen F Gerrity
(74) *Attorney, Agent, or Firm* — Dicke, Billig, & Czaja, PLLC

(57) ABSTRACT

An automated method for forming a packaged good article includes establishing a continuous path of travel for a mandrel. The mandrel defines an open interior between a package side and a loading side. With the mandrel at a first angle, a packaging material is wrapped about the mandrel at a first station along the path of travel to define a partial package. Product is dispensed into the partial package at a second station. With the mandrel at the second angle, the partial package and the mandrel are separated from one another at a third station. The first angle of the mandrel (at the first station) differs from the second angle of the mandrel (at the third station). The partial package is closed to form a packaged good article. In some embodiments, the mandrel is horizontal at the first station and is vertical at the third station.

9 Claims, 39 Drawing Sheets

(56) References Cited

U.S. PATENT DOCUMENTS

| | | | | |
|---|---|---|---|---|
| 4,015,403 | A | 4/1977 | Langen | |
| 4,221,107 | A | 9/1980 | Langen | |
| 4,250,693 | A | 2/1981 | Andersson | |
| 4,308,020 | A | 12/1981 | Langen | |
| 4,571,236 | A | 2/1986 | Adams | |
| 5,127,507 | A * | 7/1992 | McDermott | 193/2 R |
| 5,465,554 | A | 11/1995 | Lewis et al. | |
| 6,378,577 | B1 * | 4/2002 | Piner et al. | 141/391 |
| 6,708,742 | B2 * | 3/2004 | Weathers et al. | 141/391 |
| 7,497,064 | B2 | 3/2009 | Momich | |
| 7,559,186 | B2 | 7/2009 | Smith | |

* cited by examiner

34

PACKAGING FORMING AND LOADING APPARATUS

CROSS-REFERENCE TO RELATED APPLICATIONS

This application claims priority under 35 U.S.C. §119(e)(1) to U.S. Provisional Patent Application Ser. No. 61/220,916, filed Jun. 26, 2009 and entitled "Product Densification Device", and to U.S. Provisional Patent Application Ser. No. 61/220,760, filed Jun. 26, 2009 and entitled "Densified Particulate Packaged Products and Their Method of Manufacture", the entire teachings of both of which are incorporated herein by reference.

BACKGROUND

A plethora of different products are sold to consumers in packaged form. Common examples are consumable products such as cereal (e.g., ready-to-eat cereal), snack food products, and dry mix products to name but a few. Various automated machinery formats have been developed for loading such products into a desired package format (e.g., carton, box, plastic bag, etc.) simultaneously with, or following, formation of the package. The benefits of such machinery and related methods of use are clearly evident; manufacturers are able to rapidly generate large numbers of packaged good articles on an essentially continuous basis with limited operator interaction. With the advent of precision actuators and programmable logic controllers or other computer-based control systems for controlling operation of these actuators, automated packaging machines are highly cost effective, capable of consistently producing and loading desired packaging formats at ever-increasing rates.

While the control systems and other mechanisms utilized with automated packaging machinery has evolved over time, the basic parameters of most packaging systems has remained essentially the same, and is generally a function of the products being packaged and a format of the package itself. For example, certain products have a uniform shape and size highly amenable to self-compaction within a container (e.g., cigarettes); the automated packaging machinery associated with such products is specially constructed in accordance with the unique product attributes. In many other instances, however, the product to be packaged has a relatively inconsistent shape and/or size (e.g., ready-to-eat cereals). Packaging machinery for handling and packaging such products can thus have a more universal design, useful with a multiplicity of different products and corresponding packaging. Even with this more universal configuration, however, the selected package format greatly affects machine complexity and thus manufacturing line speeds.

For example, many products are packaged in a "bag-in-box" format. In general terms, the product is initially contained within a sealed plastic film bag. The combination sealed bag/product is then contained within a separate, outer carton (typically a paperboard-based carton or box). Conventionally, two (or more) separate machines are necessary to effectuate this packaging technique on a mass production basis. A first machine forms, fills, and seals the product-containing bags (e.g., a bagging machine that continuously feeds product into a film tube, periodically sealing and cutting the tube to form the individual closed bags). A separate, second machine (e.g., a cartoner) forms a closed carton about each of the sealed product bags. Typically, sealed product bags are fed by a conveyor to the separate cartoner machine otherwise including a plurality of movable buckets or mandrels. The sealed product bags are placed in or on respective ones of the buckets, followed by formation of a carton around the bucket (and thus around the corresponding sealed product bag). To enhance speed and efficiency, the cartons are supplied to the cartoner in a magazine of flat carton blanks; individual flat carton blanks are handled by the cartoner machine to effectuate folding about a corresponding one of the moving buckets, resulting in the formation of desired folds (and gluing) of the carton panels relative to one another. Alternatively, with double packaging machines, both the bag and the surrounding carton are initially formed around the same mandrel. The resulting double package is then taken off the mandrel and advanced to a separate filling machine where it is filled with a desired quantity of product, and then to a third machine that closes the bag and the carton.

With the above-described cartoner machinery, the buckets are typically maintained in a horizontal orientation to optimize carton formation and throughput efficiency. In contrast, machinery adapted for filling or dispensing loose product into a simultaneously-formed plastic film bag (or into a previously-formed carton or double package) conventionally incorporates a vertical arrangement in which the product is gravity-fed into the package. While the horizontal carton forming techniques and the vertical package filling techniques are well-accepted, the disparity between the package orientation (i.e., horizontal with cartoners versus vertical with product filling machines) has likely necessitated that the two discrete packaging steps (for bag-in-box packaging) be performed by separate machines. Simply stated, conventional bag-in-box packaging machinery can either vertically fill product into a vertically-oriented package, or form an outer carton about a horizontally-arranged sealed product bag, but not both. The two separate machines collectively occupy significant plant space and require multiple operators.

Other concerns raised by conventional bag-in-box package formation and loading machinery relates to an achieved "compactness" or density of the loaded product. As a point of reference, products having uniform shape and size can be readily packaged in a close, compact fashion, and the corresponding specialized automated packaging machinery operates to effectuate the dense or compact arrangement. With automated vertical filling machines, however, the non-uniform product is simply gravity fed into a simultaneously formed film bag (or previously-formed package), and the bag immediately closed (or sealed) once product dispensement is complete, possibly resulting in a relatively significant volume of unused (or void) storage space within the bag. The excess package volume is further increased by the cartoner that otherwise conventionally forms the carton to a size discernibly larger than an expected size (or volume) of the sealed product bag so as to ensure that the sealed product bag will "fit" within the carton. The resultant package volume is therefore larger than the actual volume of the contained product. This, in turn, undesirably wastes packaging materials and storage space. Further, in response to jostling or other vibration of the packaged good article during shipping, the contained product will inherently "settle" within the package, causing the product to occupy even less of the package volume. When a consumer later opens the package, s/he may perceive the package to be only partially filled. Manufacturers will address this potentially negative perception by providing an explanatory statement of some type on the package, for example "the product may settle during shipment" or the like. Even if successful in alleviating the consumer's concerns, however, the manufacturer has still paid for unneeded packaging material, storage and shipping costs.

In light of the above, a need exists for automated packaging systems, devices, and methods capable of forming and loading products into a bag-in-box package format on a mass production basis. Additionally, a need exists for packaging systems, devices, and methods capable of achieving heightened product densification, in turn reducing packaging material and storage space requirements.

SUMMARY

Some aspects in accordance with principles of the present disclosure relate to a method for forming a packaged good article. The method includes establishing a continuous path of travel for a partial package forming mandrel. The mandrel defines a major axis and an open interior region extending between a package side and a loading side. The package side terminates at a terminal end opposite the loading side, with the terminal end being open to the interior. A packaging material (e.g., a plastic film, carton blank, etc.) is wrapped about the package side at a first station along the path of travel to form a partial package having a closed end extending across the terminal end and an open end disposed over the mandrel. In this regard, the major axis of the mandrel is arranged at a first angle relative to the path of travel at the first station. Product is dispensed into the partial package via the loading side of the mandrel at a second station otherwise provided along the path of travel to complete loading of the product into the partial package. The partial package and the mandrel are separated from one another at a third station along the path of travel. The major axis of the mandrel is arranged at a second angle relative to the path of travel at the third station. The first angle of the mandrel axis (at the first station) differs from the second angle of the mandrel axis (at the third station). Finally, the open end of the partial package is closed to form a packaged good article. In some embodiments, the method includes pivoting the mandrel relative to the path of travel between the second and third stations. For example, in some embodiments, the mandrel is approximately horizontal (e.g., within 5° of a truly horizontal orientation) at the first station and is approximately vertical (e.g., within 5° of a truly vertical orientation) at the third station. In related embodiments, the mandrel is pivotably mounted to a carriage assembly that is otherwise driven along the path of travel, and interfaces with a track or flight-type apparatus between the first and third stations that effectuates pivoting movement of the mandrel relative to the carriage assembly and thus relative to the path of travel. Regardless, with methods of the present disclosure, a partial package (e.g., a partial film bag and/or a partial carton) can be formed about the mandrel at the first station (and with the mandrel in the approximately horizontal orientation). The mandrel is subsequently filled with product dispensed into the mandrel while in the horizontal orientation. The mandrel, and the partial package carried thereby, is transitioned to the vertical orientation to effectuate flow of the product into the partial package. With the automated methodologies of the present disclosure, then, a single machine or apparatus can perform the discrete steps of carton formation and product filling on a continuous, high volume, mass production basis.

Yet other aspects in accordance with principles of the present disclosure relate to a package forming and loading apparatus for use with a packaging machine. The apparatus includes a package portion and a loading portion. The package portion includes a tubular body forming an interior passage extending between, and open at, opposing leading and trailing ends thereof. The tubular body defines a front face, a rear face, and opposing first and second side faces. The loading portion includes a front wall, a rear wall, and first and second side walls. The front wall defines opposing first and second ends. The rear wall is provided opposite the front wall and defines opposing, first and second ends. The rear wall first end is longitudinally proximate the front wall first end. The side walls extend between and connect the front and rear walls. With this construction, the walls combine to form a funnel segment defining a closed perimeter funneling pathway terminating at the front wall second end. A transverse cross-sectional area of the funneling pathway at the front wall second end is greater than the transverse cross-sectional area of the funneling pathway at the front wall first end. The rear wall second end is longitudinally beyond the front wall second end to define a portion of a loading region open to the funneling pathway. With this construction, upon final assembly of the loading portion to the package portion, the funneling pathway of the loading portion is fluidly connected to the interior passage of the package portion to facilitate delivery of product from the loading region to the interior passage via the funneling pathway. In some embodiments, the package portion and the loading portion are integrally formed as a homogenous body, with the rear face of the package portion and the rear wall of the loading portion being formed by a single, continuous panel. In yet other embodiments, the apparatus is assembled to the packaging machine such that at least the loading portion is pivotably maintained. With this construction, product is dispensed into the loading region with the loading portion in a horizontal orientation. Upon pivoting of the loading portion to a more vertical orientation, the product flows from the loading region through the funneling pathway and into the interior passage of the package portion. In related embodiments, a package can be partially formed about the package portion such that the so-dispensed product from the loading portion is within the formed partial package.

Yet other aspects in accordance with principles of the present disclosure relate to a method of automatically forming a densified packaged good article. The method includes establishing a continuous path of travel by an automatically driven conveyor chain for a partial package forming mandrel. The mandrel defines an open interior extending between a package side and a loading side. The package side terminates at a terminal end opposite the loading side, with the terminal end being open to the interior. A packaging material is wrapped about the package side at a first station along the path of travel to form a partial package having a closed end and an open end. The closed end extends across the terminal end of the package side, whereas the open end is disposed over the mandrel. A densifiable product is dispensed into the loading side of the mandrel at a second station along the path of travel. The dispense product is then transferred from the loading side to the package side such that at least a portion of the transferred product is within a region of the package side otherwise encompassed by the partial package. Subsequently, at least one of the mandrel and the partial package is subjected to a vibrational force at a third station along the path of travel to cause the transferred product to densify. The partial package and the mandrel are separated from one another such that the densified transferred product remains within the partial package. Finally, the open end of the partial package is closed to form a densified packaged good article. In some embodiments, a vibrational force is applied to at least one of the partial package and the mandrel during the step of separating the partial package and the mandrel. In yet other embodiments, prior to the step of applying a vibrational force, a fill line of the transferred product might interfere with closure of the open end. In related embodiments, a fill line of the densified transferred product is spaced below the open end such that the transferred product no longer interferes with closure of the open end.

DETAILED DESCRIPTION

System Overview

Figure 1A:
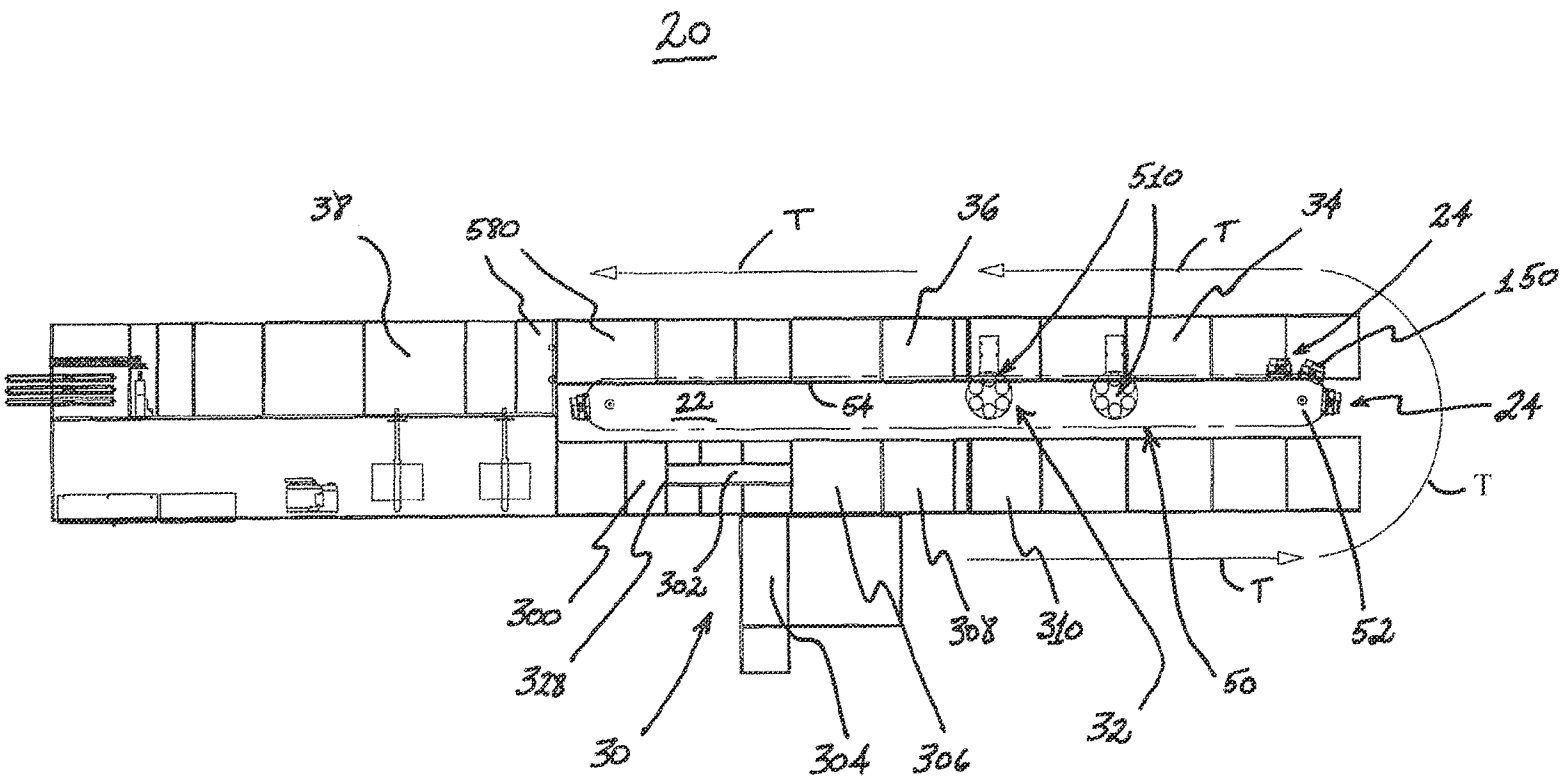
FIG. 1A is a schematic top view of a package forming and loading system in accordance with principles of the present disclosure.

One embodiment of package forming and loading system 20 in accordance with principles of the present disclosure is shown in FIG. 1A. The system 20 generally include a conveyor assembly 22 maneuvering a plurality of mandrel or bucket apparatuses 24 (several of which are schematically shown in FIG. 1A) along a path of travel (represented by the arrows T in FIG. 1A) for processing at various stations. The stations provided with the system 20 can assume various forms, and generally includes a partial package forming station 30, a product loading station 32, an optional product compacting station 34, a package/mandrel separation station 36, and a package completion station 38. As described below, one or more of the stations 30-38 can include two or more sub-stations collectively functioning to effectuate a particular stage of manufacture.

Operation of the system 20 generally entails the mandrel apparatuses 24 continuously moving (or in other embodiments, intermittently moving) along the path of travel T. With embodiments in which the conveyor assembly 22 is a continuous loop as shown, the partial package forming station 30 effectively serves as the initial stage of processing relative to the continuous path of travel T, whereas the separation station 36 serves as the final stage of processing relative to the path of travel T. Processing at the completion station 38 is separate from the path of travel T. At the partial package forming station 30, a partial package is formed about a mandrel of the mandrel apparatus 24, such as a partial film bag, a partial carton, or a partial film bag within a partial carton. As used in this specification, the term "package" is inclusive of any conventional package format (including one container, such as a film bag, inside of another container, such as a paperboard carton), and the term "partial package" is in reference to a semi-complete package having a closed end and an open end. Product is loaded into the mandrel apparatus 24 and then into the corresponding partial package along the product loading station 32. The so-loaded product is densified or compacted at the optional compacting station 34 (where provided). The loaded partial package is removed from the corresponding mandrel apparatus 24 at the package/mandrel separation station 36 for delivery to, and processing by, the packaging completion station 38. The package completion station 38 closes or otherwise completes the loaded partial package into a form appropriate for delivery to a consumer. With continuous movement of the conveyor assembly 22, the mandrel apparatuses 24 continuously pass through the stations 30-36, such that following the package/mandrel separation station 36, the mandrel apparatus 24 proceeds to the partial package formation station 30 where the steps are repeated to form and load a new partial package.

Figure 1B:
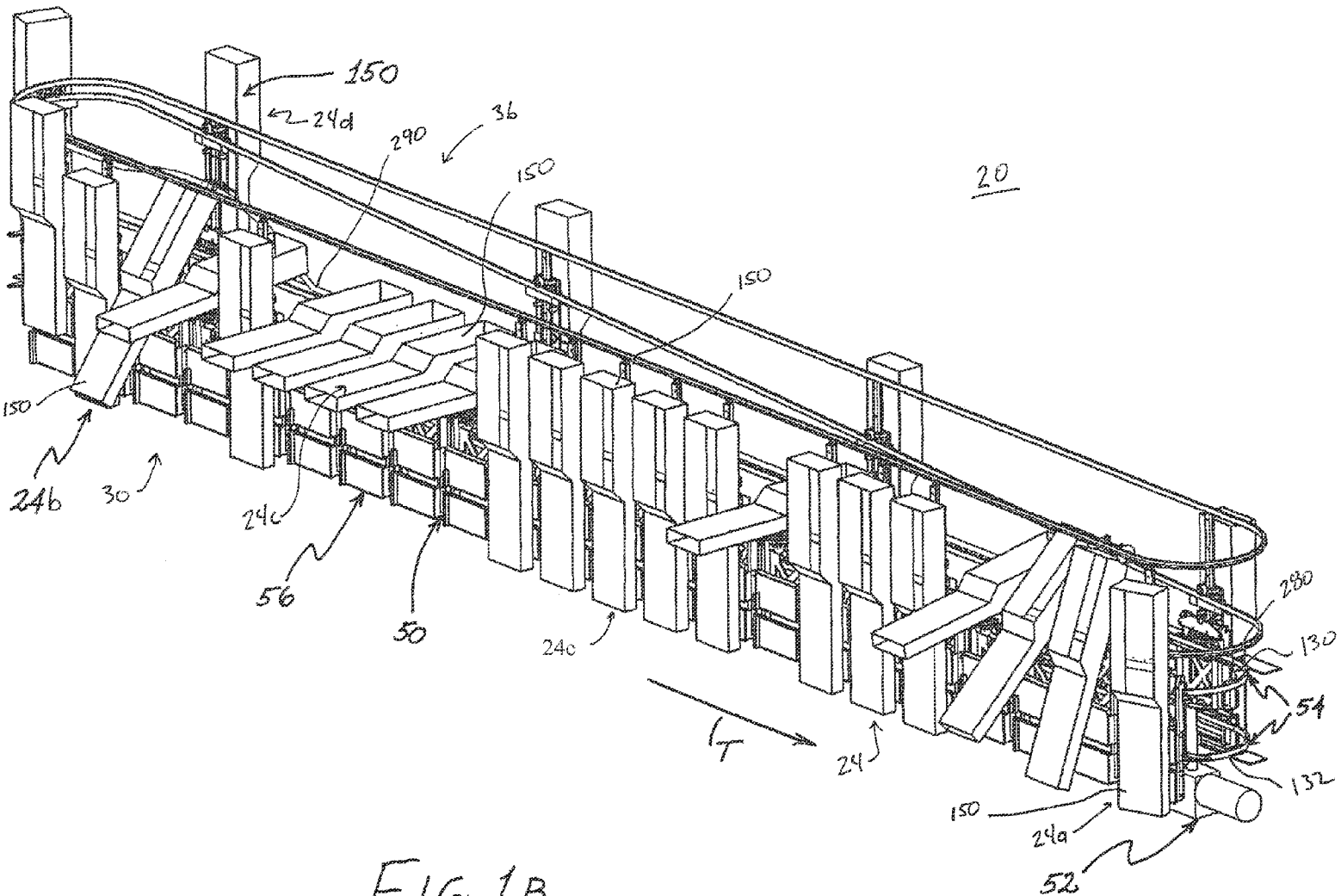
FIG. 1B is a simplified perspective view of a portion of the system of FIG. 1A, illustrating a conveyor assembly and mandrel apparatuses carried thereby.

FIG. 1B provides a more detailed representation of one embodiment of the conveyor assembly 22 and the mandrel apparatuses 24 in forming a portion of the system 20. As compared to FIG. 1A, then, FIG. 1B omits the packaging completion station 38 and reflects a series of the mandrel apparatuses 24 being guided along the path of travel T by the conveyor assembly 22. As a point of reference, a location of the partial package forming station 30 and the package/mandrel separation station 36 are generally identified in FIG. 1B, and again represent the initial point of mandrel interface (i.e., the partial package forming station 30) and the final point of mandrel interface (i.e., the package/mandrel separation station 36) relative to the path of travel T as part of partial package forming and loading operation. As made clear below, a mandrel component provided with each of the mandrel apparatuses 24 can be transitioned to various spatial orientations and positions while traversing the path of travel T as a function of operational parameters in some embodiments.

Conveyor Assembly 22

The conveyor assembly 22 can assume various forms, and generally includes chain or belt 50 (illustrated in highly simplified form in FIG. 1A, but shown in greater detail in FIG. 1B). The chain 50 is driven or acted upon by a conventional drive motor 52 (referenced generally) that can be computer controlled. A rail arrangement 54 (schematically represented in FIG. 1A and shown in greater detail in FIG. 1B) guide movement of the chain 50 along the path of travel T as described below. The conveyor assembly 22 can further include various other structures (e.g., flights, tracks, etc.) that are configured and located relative to the chain 50 so as to selectively interface with the mandrel apparatuses 24 (otherwise carried by the chain 50) along the path of travel T as described below.

The plurality of mandrel apparatuses 24 are mounted to the chain 50 such that movement of the chain 50 generates the path of travel T. In some embodiments, the chain 50 establishes the path of travel T as a continuous loop (e.g., an oval-shaped loop), with the chain 50 being uniformly driven in a single direction. Alternatively, the package forming and loading system 20 can be configured such that the conveyor assembly 22 maneuvers the chain 50 in an intermittent-type fashion, back-and-forth in a non-continuous path of travel.

Regardless of the continuous or intermittent format of the conveyor assembly 22, the driven chain 50 is, in some constructions, comprised of a plurality of linked carriage assemblies 56 as identified in FIG. 1B. The carriage assemblies 56 can be identical, with one of the carriage assemblies 56 being shown in greater detail in FIGS. 2A and 2B. In general terms, the carriage assembly 56 is configured to retain a corresponding one of the mandrel apparatuses 24 (FIG. 1B). The carriage assemblies 56 are pivotably linked to one another to establish the resultant driven chain 50 (FIG. 1B). With this in mind, the carriage assembly 56 includes, in some embodiments, a back plate 60, first and second support arms 62*a*, 62*b*, fixed links 64*a*, 64*b*, first and seconds carriage shafts 66*a*, 66*b*, pivot links 68*a*-68*d*, one or more horizontal support bearings 70, one or more vertical support bearings 72, a reinforcement wall 74, and guide bar 76. The components of the carriage assembly 56 are described in greater detail below. In general terms, however, the fixed links 64*a*, 64*b* are mounted to the back plate 60 and maintain the carriage shafts 66*a*, 66*b* such that the pivot links 68*a*-68*d*, otherwise assembled to the shafts 66*a*, 66*b*, respectively, can pivot relative to the fixed links 64*a*, 64*b* (and thus relative to the back plate 60). The horizontal and vertical support bearings 70, 72 are spatially fixed relative to the back plate 60 and facilitate guided movement of the carriage assembly 56 along one or more rails (not shown) provided with the conveyor assembly 22 (FIG. 1B). The support arms 62*a*, 62*b* connect the reinforcement wall 74 with the back plate 60, and provide features for pivoting interface with a corresponding one of the mandrel apparatuses 24. Finally, the guide bar 76 extends from the reinforcement wall 74 opposite the back plate 60.

The back plate 60 can assume various forms, and is generally constructed of a rigid material (e.g., steel plate) sufficiently sized and shaped to support a corresponding one of the mandrel apparatuses 24 (FIG. 1B) via the support arms 62*a*, 62*b* as described below, as well as a weight of the carriage assembly 56 itself. The back plate 60 can have the cross beam-like configuration as shown for enhanced structural rigidity. Alternatively, other constructions are also envisioned. Regardless, and relative to an orientation upon final assembly of the chain 50 (FIG. 1B), the back plate 60 forms or defines a front 80 (FIG. 2A), a rear 82 (FIG. 2B), a top 84, a bottom 86, and opposing sides 88, 90.

The support arms 62*a*, 62*b* are assembled to the front 80 of the back plate 60 adjacent a corresponding one of the sides 88 or 90. The support arms 62*a*, 62*b* can be identical, each having a length greater than a length of the back plate 60. Thus, and as reflected in FIGS. 2A and 2B, a leading end 100 of each of the support arms 62*a*, 62*b* extends longitudinally beyond the top 84 of the back plate 60, whereas an opposing trailing end 102 extends longitudinally beyond the bottom 86. The support arms 62*a*, 62*b* are formed of a rigid, structurally robust material (e.g., steel bars), adapted to support a weight of a corresponding one of mandrel apparatuses 24 (FIG. 1B). In this regard, a coupling structure 104 is provided or formed at the leading end 100 of each of the support arms 62*a*, 62*b*. As described in greater detail below, the coupling structures 104 promote pivotable coupling of the carriage assembly 56 with a corresponding one of the mandrel apparatuses 24. The coupling structure 104 can assume various forms, and in some embodiments includes a bearing ring 106 rotatably captured within a bore 108 in the corresponding support arm 62*a*, 62*b*. The ring 106 is configured for coupling to a corresponding feature of the mandrel apparatus 24 in a manner that permits rotation of the mandrel apparatus 24 relative to the carriage assembly 56.

The fixed links 64*a*, 64*b* are fixedly mounted to, and project from, the rear 82 of the back plate 60 adjacent the top and bottom 84, 86, respectively. The fixed links 64*a*, 64*b* are formed of a rigid, structurally robust material (e.g., steel bars), adapted to support weight of the carriage assembly 56 and the corresponding mandrel apparatus 24 (FIG. 1B). The fixed links 64*a*, 64*b* effectively establish fixed pivot points of the pivot links 68*a*-68*d* relative to the back plate 60, and thus can be alternatively characterized as an integral part of the back plate 60 (with the back plate 60, in turn, being viewed as the "link" to which the pivot links 68*a*-68*d* are connected). Regardless, the fixed links 64*a*, 64*b* form various apertures as described below for receiving and supporting other components of the carriage assembly 56.

For example, the carriage shafts 66*a*, 66*b* are coupled to the fixed links 64*a*, 64*b* via apertures (unnumbered) formed therein. The carriage shafts 66*a*, 66*b* can be generally aligned with the sides 88, 90, respectively, of the back plate 60 as shown, with the fixed links 62*a*, 62*b* establishing a spacing between the carriage shafts 66*a*, 66*b* and the rear 82 of the back plate 60 sufficient to permit a desired degree of rotation of the pivot links 68*a*-68*d*.

The pivot links 68*a*-68*d* are assembled to a corresponding one of the carriage shafts 66*a*, 66*b*. For example, with the embodiment of FIGS. 2A and 2B, the carriage assembly 56 includes a first pair of upper and lower pivot links 68*a*, 68*b* coupled to the first carriage shaft 66*a*, and second pair of upper and lower pivot links 68*c*, 68*d* coupled to the second carriage shaft 66*b*. Alternatively, a greater or lesser number of the pivot links 68*a*-68*d* can be provided. Regardless, the pivot links 68*a*-68*d* are identical, each defining opposing, first and seconds ends 120, 122 (labeled for the first upper pivot link 68*a*). The first end 120 is coupled to the first carriage shaft 66*a*. The second end 122 is configured for coupling to one of the carriage shafts (not shown) of a second carriage assembly 56 (not shown). Thus, the pivot links 68*a*-68*d* serve to interconnect or couple adjacent ones of the carriage assemblies 56 otherwise forming the chain 50 (FIG. 1B). Stated otherwise, each carriage assembly 56 effectively includes a single pair of the pivot links (i.e., either the first pair 68*a*, 68*b* or the second pair 68*c*, 68*d*) that are connected to an adjacent carriage assembly 56 such that the two adjacent carriage assemblies "share" a pair of the pivot links 68*a*, 68*b* or 68*c*, 68*d*.

In some constructions, the pivot links 68*a*-68*d* associated with a particular one of the carriage shafts 66*a* or 66*b* are rigidly coupled to the shaft 66*a*, 66*b*, with the shaft 66*a*, 66*b* in turn being rotatably mounted to the fixed links 64*a*, 64*b*. With this construction, then, the pivot links 68*a*-68*d* associated with the particular carriage shaft 66*a* or 66*b* can pivot or rotate in tandem relative to the back plate 60 (and other components rigidly affixed to the back plate 60) via rotation of the corresponding carriage shaft 66*a* or 66*b* (e.g., the first upper and lower pair of pivot links 68*a*, 68*b* pivot in tandem relative to the back plate 60 with rotation of the first carriage shaft 66*a* relative to the fixed links 64*a*, 64*b*). Alternatively, the carriage shafts 66*a*, 66*b* can be rigidly affixed to the fixed links 64*a*, 64*b*, with the corresponding pivot links 68*a*-68*d* being rotatably coupled to the corresponding carriage shaft 66*a* or 66*b*. For example, the first pair of upper and lower links 68*a*, 68*b* can be rotatably coupled to the first carriage shaft 66*a*, with the first carriage shaft 66*a* in turn being rotationally fixed to the fixed links 64*a*, 64*b*.

The horizontal support bearing(s) 70 can assume various forms and are generally constructed to facilitate a rolling-type or sliding-type interface with one or more track components (described below) provided with the conveyor assembly 22 (FIG. 1B). For example, in some embodiments, the horizontal bearings 70 include a pair of transversely aligned upper horizontal support bearings 70*a*, 70*b*, and a pair of transversely aligned lower horizontal support bearings 70*c*, 70*d*. The upper horizontal support bearings 70*a*, 70*b* are rotatably connected to a corresponding one of the carriage shafts 66*a*, 66*b*, respectively, at a location "above" the upper fixed link 64*a*. The lower horizontal support bearings 70*c*, 70*d* are similarly rotatably coupled to a corresponding one of the carriage shafts 66*a*, 66*b*, respectively, at a location "below" the lower fixed link 64*b*. Thus, the horizontal support bearings 70 are connected to the back plate 60 via the carriage shafts 66*a*, 66*b* and the fixed links 64*a*, 64*b*. A variety of other arrangements of the horizontal support bearings 70 are also envisioned, and in other embodiments can include more or less than the four horizontal support bearings 70*a*-70*d* shown. Similarly, the horizontal support bearings 70 can be rotatably associated with the back plate 60 with other structures apart from the carriage shafts 66*a*, 66*b*.

Figure 2A:
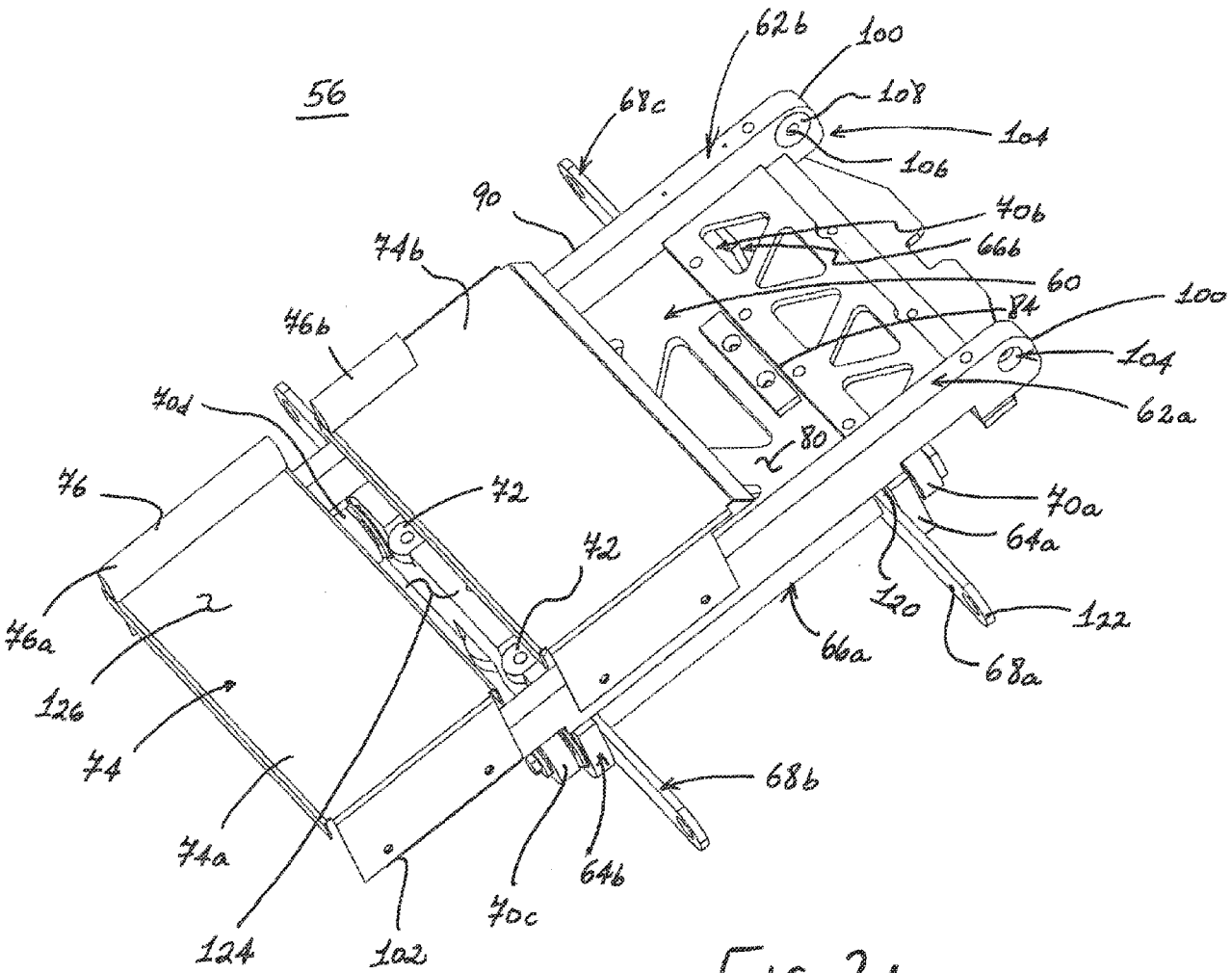
FIG. 2A is a top perspective view of a carriage assembly useful with the system of FIGS. 1A and 1B.
Figure 2B:
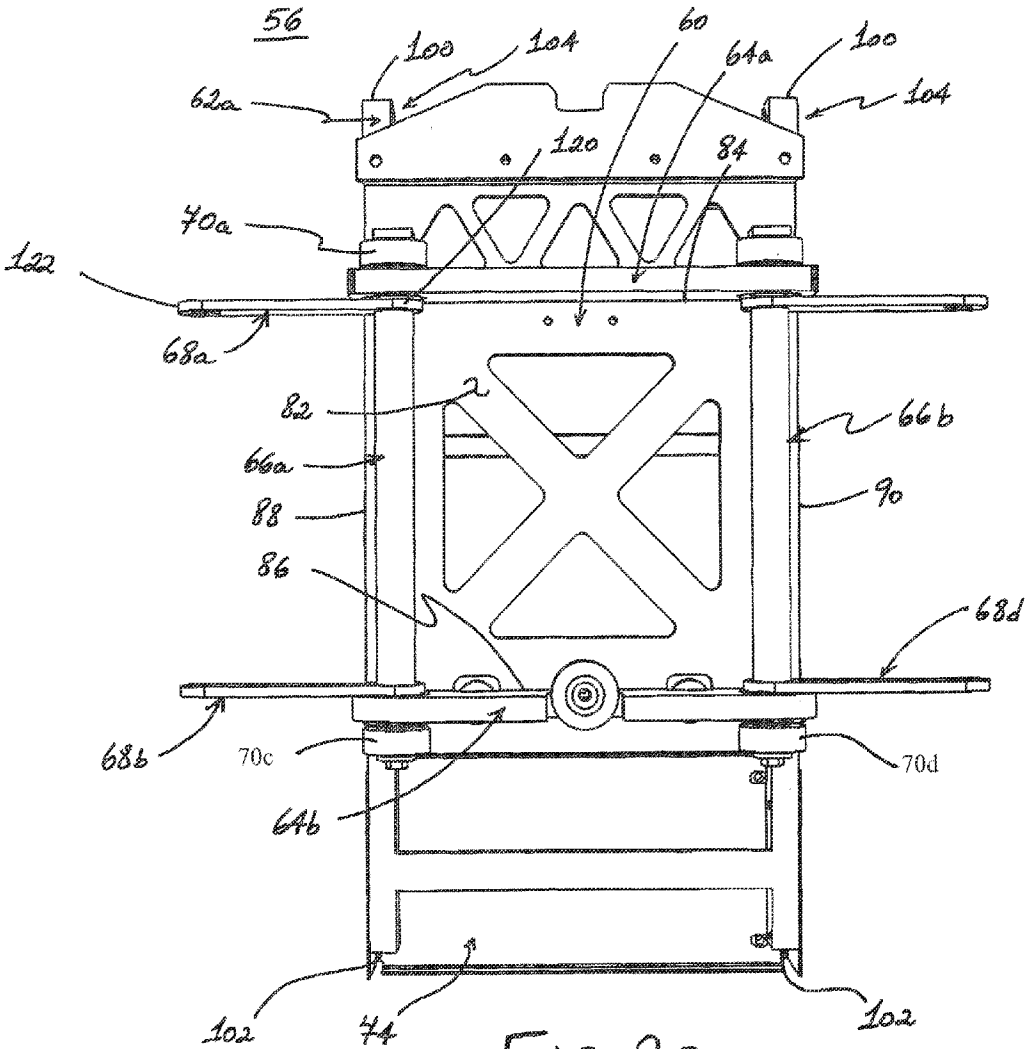
FIG. 2B is a rear plan view of the carriage assembly of FIG. 2A.

The vertical support bearings 72 are rotatably associated with the back plate 60, and are generally configured to facilitate a weight bearing rolling interface of the carriage assembly 56 (and a corresponding one of the mandrel apparatuses 24 (FIG. 1B)) with a track component (described below) provided with the conveyor assembly 22 (FIG. 1B). As a point of reference, relative to an upright orientation of the carriage assembly 56 (i.e., a major plane of the back plate 60 is vertically oriented), an axis of rotation of the vertical support bearings 72 is horizontal, and an axis of rotation of the horizontal support bearings 70 is vertical. In some embodiments, the vertical support bearings 72 are press fitted or otherwise assembled to the lower fixed link 64*b*, although other assembly locations and/or support structures are also acceptable, appropriate for positioning the vertical support bearings 72 to spatially interface with the corresponding conveyor assembly rail(s). While the carriage assembly 56 is shown in FIGS. 2A and 2B as including two pairs of the vertical support bearings 72, in other constructions, a greater or lesser number can be provided.

The reinforcement wall 74 can assume various forms, and is assembled to the support arms 62*a*, 62*b* opposite the front 80 of the back plate 60. In some embodiments, the reinforcement wall 74 includes first and second wall sections 74*a*, 74*b* assembled to the support arms 62*a*, 62*b* in a longitudinally-spaced manner to define a relief slot 124. The relief slot 124 can be formed in a region of the lower horizontal support bearings 70*c*, 70*d*. In other embodiments, the reinforcement wall 74 can include three or more segments; alternatively, the reinforcement wall 74 can be defined as a single, continuous body. Regardless, the guide wall 74 provides a receiving face 126 against which the corresponding mandrel apparatus 24 (FIG. 1B) (and a partial package periodically carried thereby) is selectively received and supported. Where provided, the relief slot 124 facilitates release of air/pressure as the mandrel apparatus 24 (and the partial package carried thereby) is brought into contact with the receiving face 126.

The guide bar 76 is assembled to, and extends from, the receiving face 126 of the reinforcement wall 74, in general alignment with the first side 88 of the back plate 60. With embodiments in which the reinforcement wall 74 is divided into the segments 74*a*, 74*b*, the guide bar 76 can similarly be separated into segments 76*a*, 76*b*, respectively. With these constructions, then, the guide bar 76 continues the relief slot 124 described above. Regardless, the guide bar 76 projects an appreciable distance from the receiving face 126, serving to align the corresponding mandrel apparatus 24 (FIG. 1B) (and a partial package periodically carried thereby) relative to the carriage assembly 56 when vertically arranged as described below. Further, the guide bar 76 is located at what will be a "trailing side" of the mandrel apparatus 24 when traversing along the path of travel T (FIG. 1B), and assists in moving the partial package within the separation station 38 (FIG. 1A) as described below.

Figure 3:
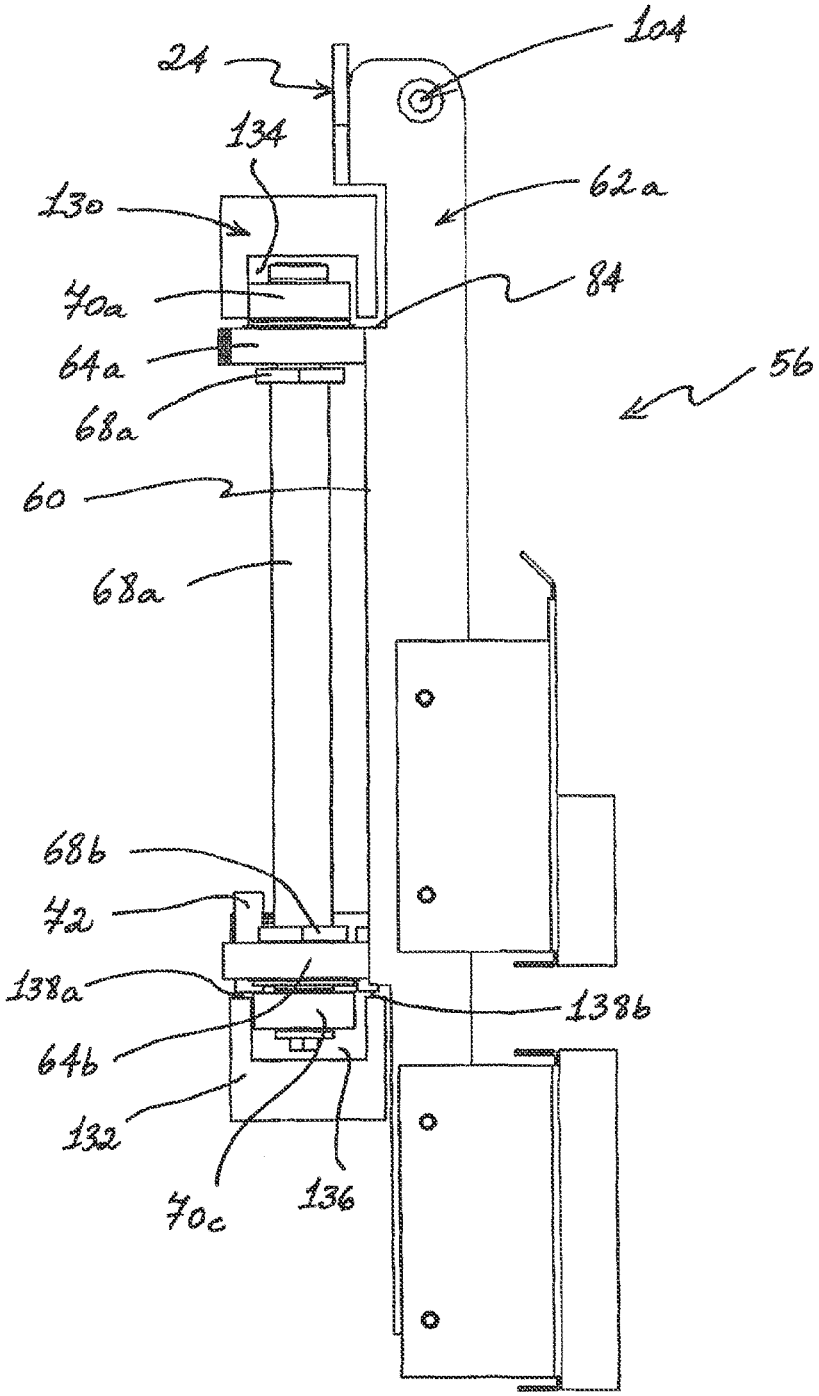
FIG. 3 is a simplified cross-sectional view of the carriage assembly of FIG. 2A coupled with carriage rails provided with a conveyor assembly component of the system of FIGS. 1A and 1B.

As indicated above, the carriage assembly 56 is, in some constructions, adapted to interface with rail or track components optionally provided with the conveyor assembly 22 (FIG. 1B). For example, FIG. 3 illustrates, in simplified form, opposing, upper and lower carriage rails 130, 132 formed as part of the conveyor assembly 22. As a point of reference, the upper and lower carriage rails 130, 132 can have a track-like construction, extending in a similar fashion along (or defining) the path of travel T (into and out of the page of FIG. 3). Though not shown, the carriage rails 130, 132 are spatially supported by various frame members (e.g., beams). With this in mind, each of the carriage rails 130, 132 can have a U-like shape in transverse cross-section, establishing a track or gap 134, 136, respectively, sized to receive corresponding ones of the horizontal support bearings 70. For example, FIG. 3 reflects the first upper horizontal support bearing 70*a* rotatably captured within the track 134 of the upper carriage rail 130, whereas the first lower horizontal support bearing 70*c* is rotatably captured within the track 136 of the lower carriage rail 132. Thus, an interface between the horizontal support bearings 70 and the carriage rails 130, 132 serves to horizontally support and guide the carriage assembly 56 along the path of travel T. Further, the lower carriage rail 132 forms opposing support surfaces 138*a*, 138*b* against which the vertical support bearings 72 rotatably (or slidably) bears. With this construction, an interface between the vertical support bearing 72 and the lower carriage rail 132 supports a weight of the carriage assembly 56 and the corresponding mandrel apparatus 24 (FIG. 1B).

As a point of reference, FIG. 3 further reflects rigid assembly of the back plate 60 relative to the horizontal support bearings 70 via the carriage shafts 66*a*, 66*b* (one of which is visible in FIG. 3) and the vertical support bearings 72 via the lower fixed link 64*b*, as well as extension of the support arms 62*a*, 62*b* (one of which is shown in FIG. 3) vertically above the top 84 of the back plate 60, the upper horizontal support bearings 70*a* and the upper carriage rail 130. This construction locates the coupling structure 104 provided with the support arms 62*a*, 62*b*, and thus the mandrel apparatus 24 (a portion of which is shown in FIG. 3) attached thereto, away from the upper carriage rail 130 for desired movement as described below.

The controlled movement of the carriage assemblies 56 as part of the conveyor assembly 22 (i.e., along the upper and lower carriage rails 130, 132) described above is but one acceptable embodiment envisioned by the present disclosure. A variety of other constructions can also be employed. With the construction of FIG. 3, however, and with additional reference to FIG. 1B, the upper and lower carriage rails 130, 132 are arranged to desirably establish a uniform horizontal or elevational position of the carriage assemblies 56 along an entirety of the path of travel T, with the carriage assembly 56 in turn promoting desired pivoting of the corresponding mandrel apparatus 24 relative to the path of travel T via one or more other components (e.g., additional rails or tracks described below).

Mandrel Apparatus 24

Figure 4:
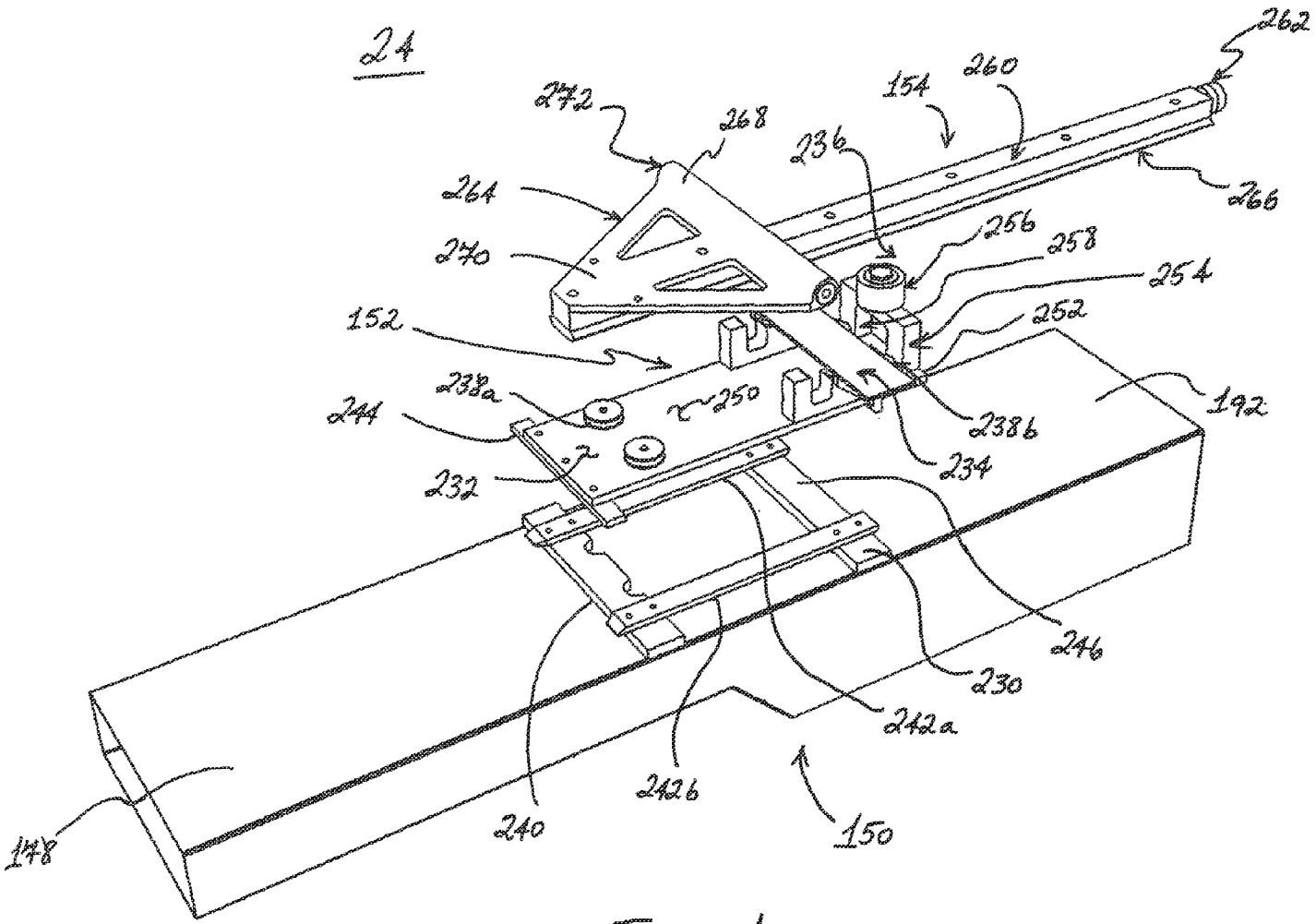
FIG. 4 is a rear perspective exploded view of a mandrel apparatus useful with the system of FIGS. 1A and 1B.

The mandrel apparatuses 24 can be identical. One embodiment of the mandrel apparatus 24 in accordance with the present disclosure is shown in FIG. 4, and includes a mandrel or bucket 150, a slide assembly 152, and a pivot arm assembly 154. In general terms, the mandrel 150 is configured to facilitate formation of a partial package, as well as loading of product into the partial package. The slide assembly 152 and the pivot arm assembly 154 are coupled to the mandrel 150. The slide assembly 152 promotes horizontal movement of the mandrel 150 relative to the conveyor assembly 22 (FIG. 1B), whereas the pivot arm assembly 154 pivotably couples the mandrel apparatus 24 to a corresponding one of the carriage assemblies 56 (FIGS. 2A and 2B).

Figure 5A:
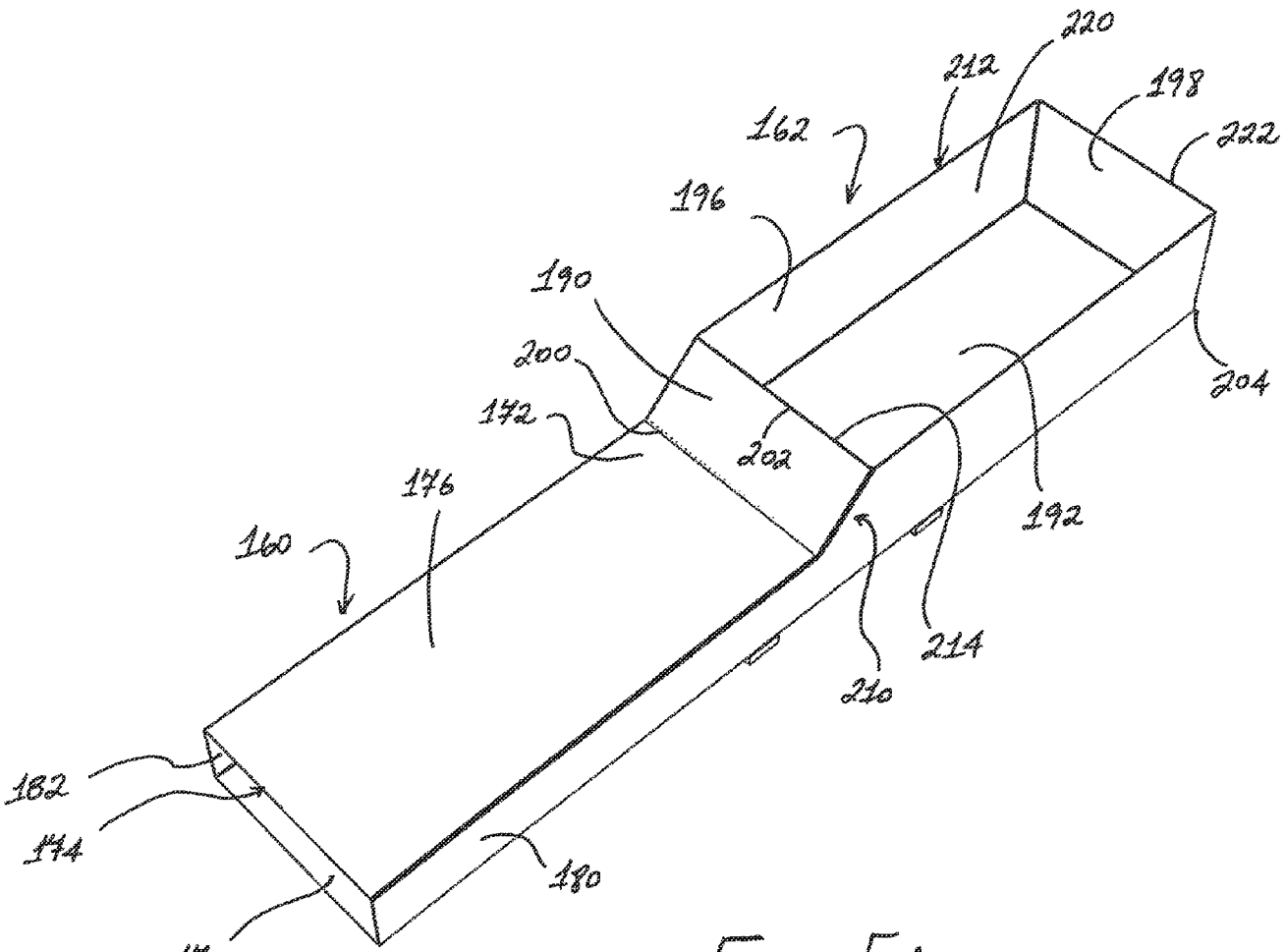
FIG. 5A is a front perspective view of a mandrel portion of the mandrel apparatus of FIG. 4.
Figure 5B:
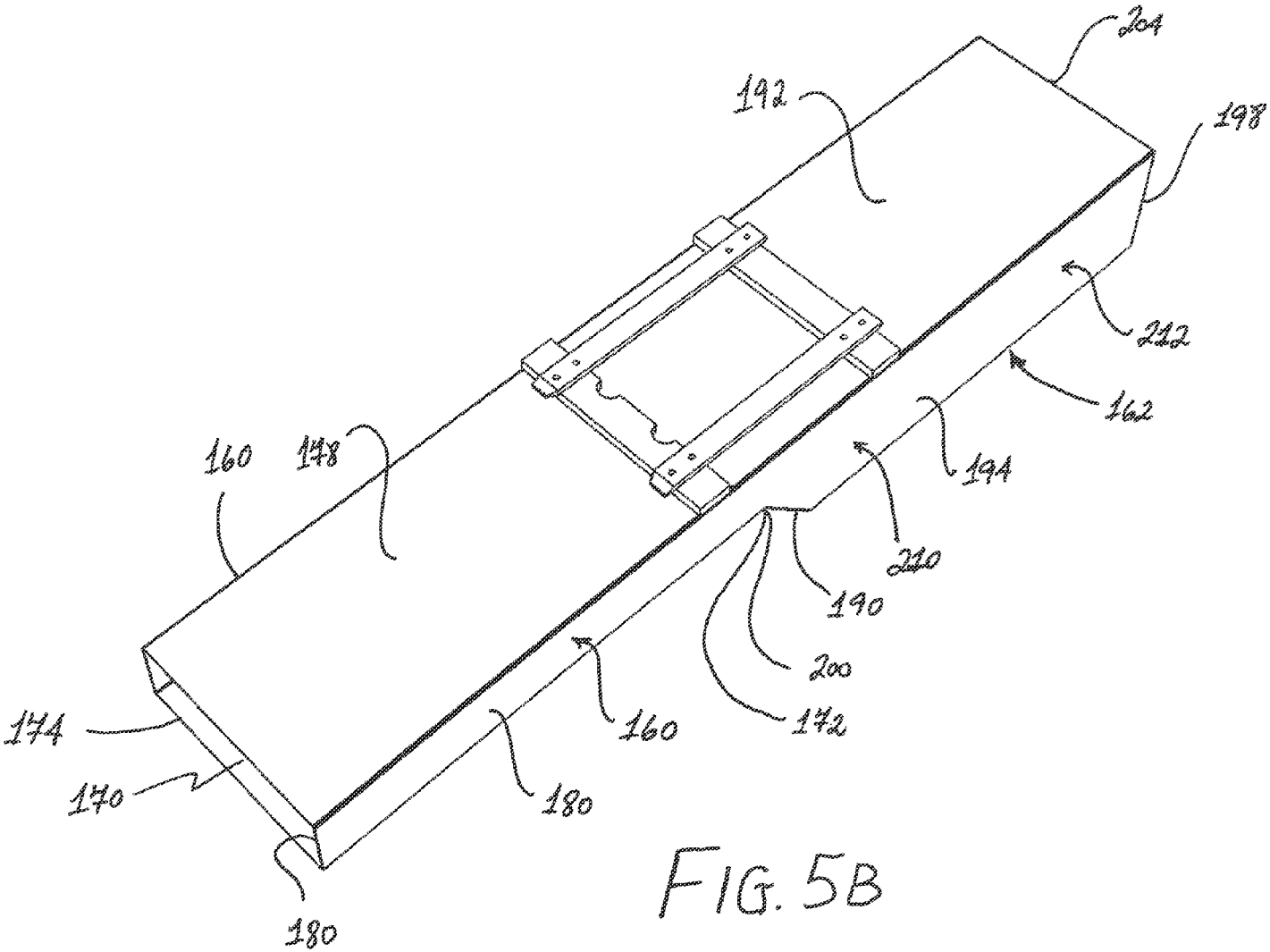
FIG. 5B is a rear perspective view of the mandrel of FIG. 5A.

With additional references to FIGS. 5A and 5B, the mandrel 150 includes or defines a package or mandrel portion 160 and a loading or product portion 162. With some embodiments, the package and loading portions 160, 162 are integrally formed as a homogenous structure. In other embodiments, the package portion 160 can be separate from the loading portion 162, with the package forming and loading system 20 (FIG. 1A) adapted to selectively bring the package and loading portions 160, 162 into temporary engagement during a product loading operation.

The package portion 160 is a generally tubular body forming an interior passage 170 extending between, and open at, opposing leading and trailing ends 172, 174 thereof. As a point of reference, a location of the leading end 172 is generally indicated in FIGS. 5A and 5B, it being understood that with embodiments in which the mandrel 150 is an integral, homogenous body, the leading end 172 may not be physically discernable from the loading portion 162. Regardless, the tubular package portion 160 can have a generally rectangular shape in transverse cross-section (relative to a central axis of the interior passage 170), defining a front face 176, a rear face 178, and opposing first and second side faces 180, 182. The front and rear faces 176, 178 can be identical (in terms of size and shape), having the parallel spatial relationship shown. Similarly, the first and second side faces 180, 182 can be identical, extending in a parallel fashion between the front and rear faces 176, 178. While the tubular package portion 160 is shown as having the rectangular shape, other shapes are also envisioned. For example, the tubular package portion 160 can be square, oval, circular, etc, in transverse cross-section. In yet other embodiments, more complex shapes can be employed. Regardless, the package portion 160 has a relatively rigid construction sufficient to facilitate formation of a bag, carton, or other package format about a perimeter thereof. That is to say, a shape of the package portion 160 dictates a shape of the package formed by the system 20 (FIG. 1A) as described below, and thus will be in accordance with the package shape desired by the manufacturer.

The loading portion 162 projects from the leading end 172 of the package portion 160, and generally includes a front wall 190, a rear wall 192, opposing first and second side walls 194, 196, and an optional top wall 198. The front wall 190 extends from the front face 176 of the package portion 160 at the leading end 172 thereof. With embodiments in which the mandrel 150 is provided as a homogenous or integral body, the front wall 190 is an extension of the front face 176 (and vice-versa). Thus, a first end 200 of the front wall 190 corresponds with the leading end 172 of the package portion 160. In alternative constructions, the package portion 160 is physically separate from the loading portion 162, such that the package portion leading end 172 is physically discernable from the loading portion first end 200. An opposing, second end 202 of the front wall 190 is defined as being spatially opposite the leading end 172. Relative to a central axis of the loading portion 162, extension of the front wall 190 from the first end 200 to the second end 202 includes an outward component or vector, such that the front wall 190 is non-parallel relative to the central axis.

The rear wall 192 extends from the rear face 178 of the package portion 160. With embodiments in which the mandrel 150 is formed as an integral body, the rear face 178 and the rear wall 192 are defined as a homogenous panel. Regardless, the rear wall 192 can be co-planar with the rear face 178 of the package portion 160. The rear wall 192 includes or defines a terminal end 204 opposite the package portion 160. As shown, the terminal end 204 is longitudinally beyond the second end 202 of the front wall 190.

The first and second side walls 194, 196 correspond with the first and second side faces 180, 182, respectively. Thus, the first side wall 194 can be co-planar with the first side face 180, and the second side wall 196 can be co-planar with the second face 182. The side walls 194, 196 extend from the leading end 172 of the package portion 160 to the terminal end 204 of the rear wall 192. Further, a shape of the side walls 194, 196 corresponds with the angular projection of the front wall 190 to the second end 202 as described above.

Finally, the optional top wall 198 extends from the terminal end 204 of the rear wall 192, and interconnects the opposing side walls 194, 196. Where provided, a plane of the top wall 198 can be perpendicular relative to the central axis of the loading portion 162, and is spatially opposite the trailing end 174 of the package portion 160. In other embodiments, the top wall 198 can be omitted.

The walls 190-198 combine to form the loading portion 162 as defining a funnel region 210 and a loading region 212. The funnel region 210 has a closed perimeter funneling pathway (primarily obscured in the views of FIGS. 5A and 5B, but referenced generally at 214 in FIG. 5A) defined by the walls 190-196. The funneling pathway 214 tapers in transverse cross-sectional area (i.e., a plane perpendicular to the central axis of the loading portion 162) from the front wall second end 202 to the front wall first end 200. With embodiments in which the mandrel 150 is provided as a homogenous, integral body, then, the funneling pathway 214 is permanently open to the interior passage 170 of the package portion 160. With alternative embodiments in which the mandrel and loading portions 160, 162 are separately provided, the funneling pathway 214 is open at the first end 200 of the front wall 190, such that upon temporary engagement between the mandrel and loading portions 160, 162, the funneling pathway 214 is open to the interior passage 170.

The loading region 212 has or defines a product-receiving trough 220 (best seen in FIG. 5A) that is open to the funneling pathway 214. The trough 220 is further open to an exterior of the loading portion 162 via an opening 222. The opening 222 has a perimeter defined by the second end 202 of the front wall 190, as well as leading edges of the side walls 194, 196 and the top wall 198 opposite the rear wall 192. A volumetric size of the trough 220 is selected to accommodate various volumes of product expected to be processed via the mandrel 150 during a package forming and loading operation.

The loading portion 162 is generally sized and shaped in accordance with a size and shape of the package portion 160. Thus, the loading portion 162 can have shapes differing from those implicated by FIGS. 5A and 5B. The package portion 160 and the loading portion 162 are similarly constructed of a rigid, light weight yet structurally robust material such as sheet metal.

Use of the mandrel 150 as part of a package forming and loading operation is described in greater detail below. In general terms, however, a package is partially formed about the package portion 160. Product is loaded onto the so-formed partial package by initially dispensing the product into the trough 220 of the loading portion 162 via the opening 222, with the mandrel 150 (or at least the loading portion 162) horizontally oriented (i.e., the mandrel 150 or at least the loading portion 162 is spatially arranged such that a central axis of the mandrel 150 is horizontal). Upon subsequent movement of the mandrel 150 (or of at least the loading portion 162) from a horizontal orientation to a more vertical orientation (i.e., the central axis of the mandrel 150 is vertical or nearly vertical), product within the trough 220 is gravity-fed through the funneling pathway 214 and into the interior passage 170 of the package portion 160.

Returning to FIG. 4, the optional slide assembly 152 includes a bracket 230, a mounting plate 232, a latch plate 234, a lifting cam roller device 236, and slide rollers 238. In general terms, the bracket 230, the mounting plate 232 and the latch plate 234 collectively rigidly couple the slide assembly 152 to the mandrel 150. The lifting cam roller device 236 captures a corresponding component of the pivot arm assembly 154 to the slide assembly 152, with the slide rollers 238 promoting a slidable relationship between the pivot arm assembly 154 and the slide assembly 152 (and thus between the pivot arm assembly 154 and the mandrel 150).

The bracket 230 and the mounting plate 232 can assume various forms appropriate for establishing selective physical connection between the mandrel 150 and the slide assembly 152. Thus, for example, the bracket 230 can include a foot 240 and legs 242*a*, 242*b* assembled to one or both of the rear face 178 and/or the rear wall 192 of the mandrel 150. The foot 240 is dimensioned to abuttingly receive a shoulder 244 provided with the mounting plate 232. The legs 242*a*, 242*b* are spaced from the rear face 178/rear wall 192 such that the shoulder 244 can be slidably received between the rear face 178/rear wall 192 and the legs 242*a*, 242*b*, with the legs 242*a*, 242*b* effectively capturing the shoulder 244 against the foot 240. The latch plate 234 is located along the mounting plate 232 opposite the foot 240 and is operable to temporarily lock with the bracket 230 (and thus relative to the mandrel 150). For example, the latch plate 234 can be a spring loaded body, providing a lip surface (hidden in FIG. 4) that selectively engages a lock plate 246 provided with the bracket 230. In the normal or locked position, the latch plate 234 is biased into fixed engagement with the lock plate 246. Where desired, the latch plate 234 can be forced or moved from engagement with the lock plate 246, allowing the mounting plate 232 to be disassembled from the bracket 230. With this construction, the mandrel 150 can be quickly separated from the mounting plate 232 through user-caused operation of the latch plate 234. A wide variety of other constructions and/or mechanisms can alternatively be employed that facilitate selective assembly of the mounting plate 232 relative to the mandrel 150/bracket 230. In yet other embodiments, the slide assembly 152 can be more permanently associated with the mandrel 150. Regardless, the mounting plate 232 defines an exterior face 250 and an upper end 252 opposite the foot 240.

The lifting cam roller device 236 includes, in some embodiments, a secondary bracket 254 and a lift roller 256. The secondary bracket 254 is attached to the exterior face 250 of the mounting plate 232 adjacent the upper end 252, and rotatably maintains the lift roller 256. In this regard, the secondary bracket 254 forms an aperture 258 sized to slidably receive a corresponding component of the pivot arm assembly 154 as described below. The lift roller 256 is configured to rotate (or slide) within a vertical mandrel track (not shown) provided with the conveyor assembly 22 (FIG. 1B) in cam-like fashion. With this construction, a vertical lifting force applied to the lift roller 256 is transferred to the mandrel 150 via the secondary bracket 254, the mounting plate 232 and the bracket 230. Other devices or mechanisms appropriate for transferring a lifting force onto the mandrel 150 are also acceptable.

The slide rollers 238 are rotatably coupled to the exterior face 250 of the mounting plate 232, and are located to rotatably interface with a corresponding component of the pivot arm assembly 154. In one embodiment, two pairs 238*a*, 238*b* of the slide rollers are provided, with the slide rollers 238 of each pair 238*a*, 238*b* spaced in accordance with a dimension of a corresponding component of the pivot arm assembly 154. As described below, the sliding relationship afforded by the slide rollers 238 relative to the pivot arm assembly 154 allows the mandrel 150 to move vertically relative to the pivot arm assembly 154 (and thus relative to the carriage assembly 56) in response to a lifting force applied to the lift roller 256.

Construction and operation of the slide assembly 152 is best understood with reference to components of the pivot arm assembly 154. In this regard, the pivot arm assembly 154 includes an arm 260, a tilt control bearing 262, and a support truss 264. The arm 260 is sized and shaped for slidable interface with the slide rollers 238 of the slide assembly 152, for example by forming opposing slots 266 (one of which is visible in FIG. 4) sized to rotatably capture a corresponding one of the slide rollers 238. The tilt control bearing 262 is rotatably maintained at an end of the arm 260, and is configured to rotatably (or slidably) interface with one or more mandrel tilt tracks associated with the conveyor assembly 22 (FIG. 1B) in a cam-like manner as described below. Finally, the support truss 264 is mounted to the arm 260 opposite the tilt control bearing 262, and includes a rod 268 and reinforcement frame 270. The rod 268 includes or carries coupling bodies 272 (one of which is visible in FIG. 4) adapted for rotatable connection with corresponding features of the carriage assembly 56. The reinforcement frame 270 can assume various forms, and is generally configured to support the rod 268 against a weight of the mandrel 150.

Figure 6:
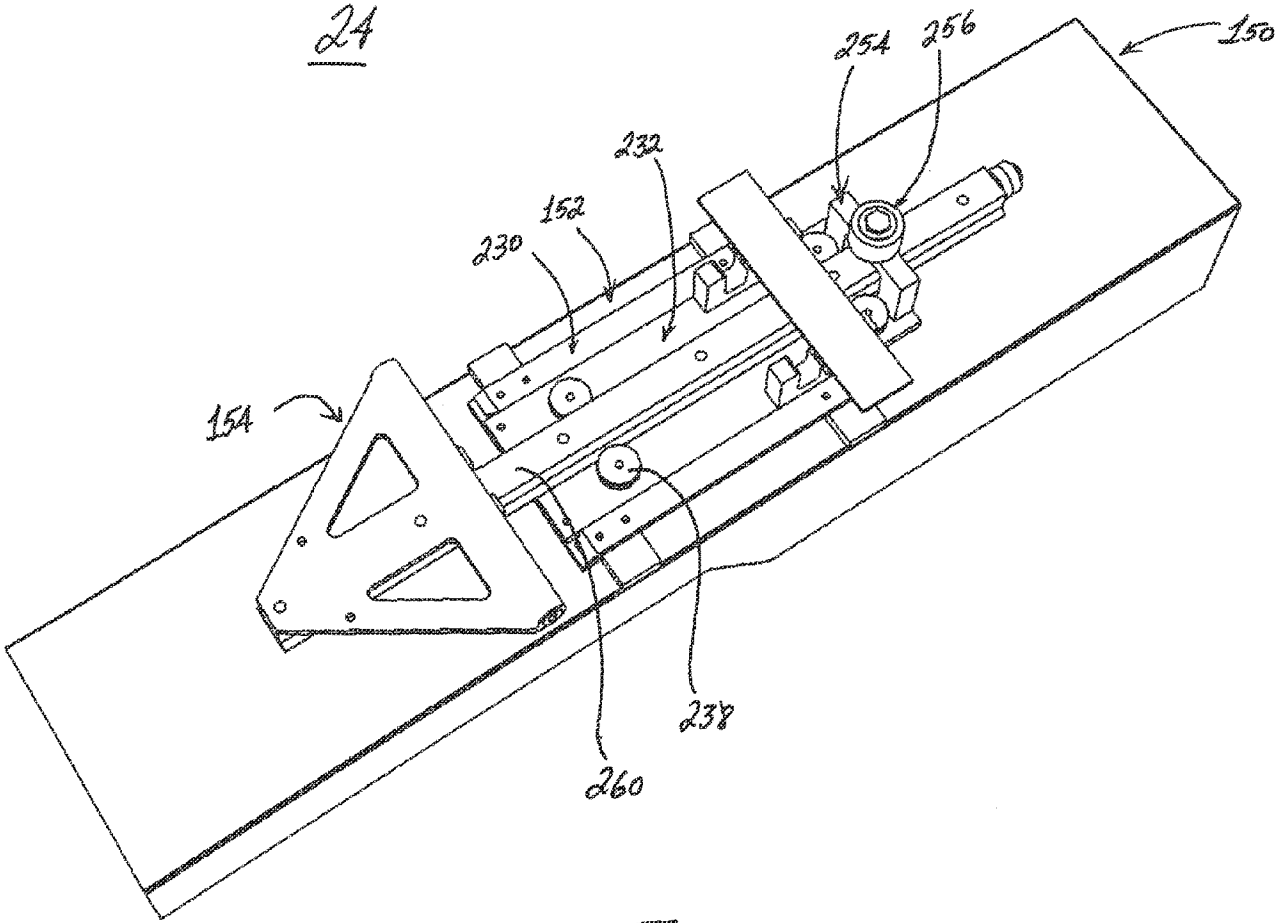
FIG. 6 is a rear perspective view of the mandrel apparatus of FIG. 4 upon final assembly.

With reference between FIGS. 4 and 6, construction of the mandrel apparatus 24 (with embodiments in which the slide assembly 152 and the pivot arm assembly 154 are considered to be "part" of the mandrel apparatus 24) includes coupling the mounting plate 232 of the slide assembly 152 to the bracket 230 otherwise assembled to the mandrel 150. The arm 260 of the pivot arm assembly 154 is slidably coupled between the slide rollers 238, and is laterally captured by the slide assembly 152 at the secondary bracket 254. With this construction, then, the mandrel 150 is linearly moveable relative to the arm 260 via sliding engagement between the arm 260 and the slide rollers 238. Thus, a lifting force applied to the lift roller 256 results in vertical movement of the mandrel 150 relative to the arm 260.

Mandrel Apparatus 24/Carriage Assembly 56

Figure 7:
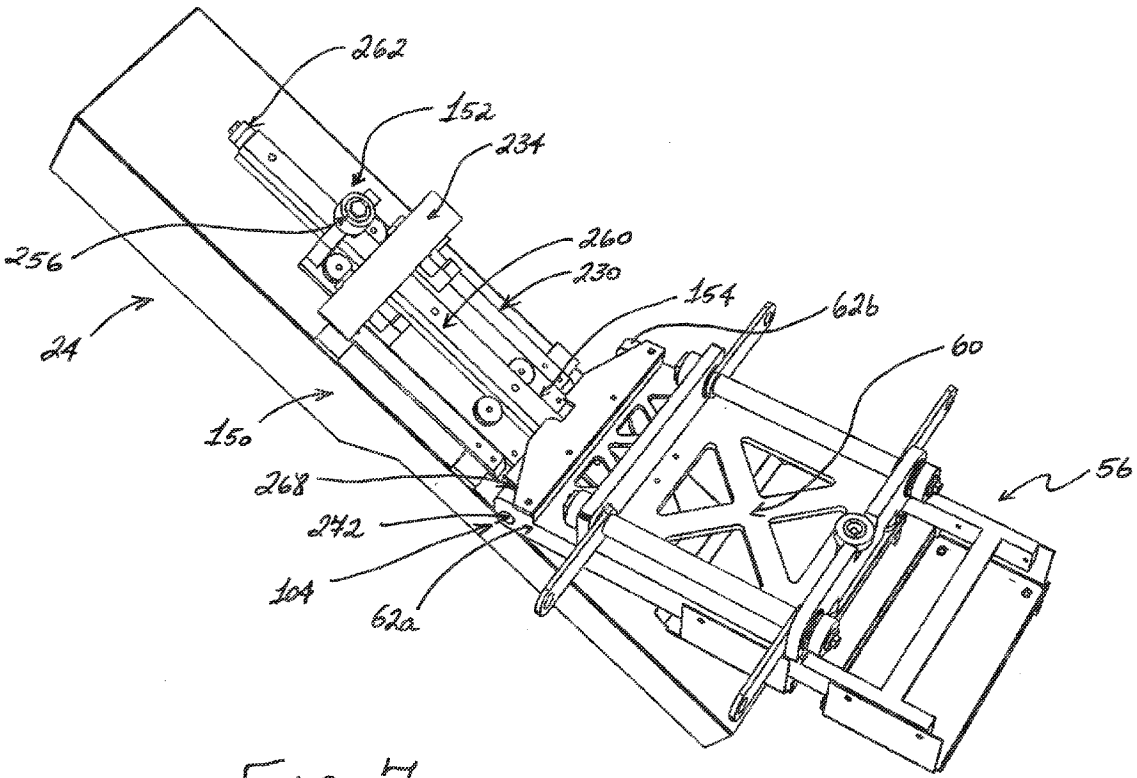
FIG. 7 is a rear perspective view of the carriage assembly of FIG. 2A coupled with the mandrel apparatus of FIG. 6.

With additional reference to FIG. 7, the rod 268 of the mandrel apparatus 24 is coupled to the support arms 62*a*, 62*b* of the carriage assembly 56 via a pivoting connection between the coupling structure 104 provided with the carriage assembly 56 and the coupling bodies 272 provided with the mandrel apparatus 24. Upon final assembly, then, the mandrel 150 can rotate or pivot relative to the carriage assembly 56 (and in particular relative to the back plate 60) via the rotatable connection between the coupling structures 104, 272. A rotational orientation of the mandrel 150 relative to the carriage assembly 56 is dictated by forces acting upon the tilt control bearing 262. Further, the mandrel 150 is vertically translatable relative to the carriage assembly 56 via the slide assembly 152 as described above (i.e., the mandrel 150 is vertically slidable relative to the arm 260, whereas the arm 260 is vertically fixed relative to the carriage assembly 56). Thus, where the carriage assembly 56 is held at a fixed vertical elevation and a lifting force is applied to the lift roller 256, the mandrel 150 moves vertically relative to the carriage assembly 56.

Finally, the mandrel 150 is readily removable/interchangeable relative to the carriage assembly 56 by unlocking the latch plate 234. Thus, where a differently-sized mandrel 150 is desired (e.g., replacing a first sized and shaped mandrel 150 with a second, differently sized and shaped mandrel 150 to effectuate formation of a differently sized and/or shaped package as desired), an operator simply replaces the existing mandrel 150/bracket 230 with a different mandrel 150 (that otherwise includes a separate one of the brackets 230). The new mandrel 150/bracket 230 is coupled to the arm 260. Under these circumstances, then, the bracket 230 can be considered as a permanent "part" of the mandrel apparatus 24 (or of the mandrel 150), whereas remaining components of the slide assembly 152 and the pivot arm assembly 154 are considered permanent "parts" of the carriage assembly 56 (e.g., the pivot arm assembly 154 and all components of the slide assembly 152 apart from the bracket 230 remain with the carriage assembly 56 when replacing the mandrel 150).

The combination mandrel apparatus 24/carriage assembly 56 provides for a variety of different spatial orientations or positions of the mandrel 150 relative to the carriage assembly 56. For example, in the simplified view of FIG. 8A, the mandrel 150 is in a first orientation and spatial position relative to the carriage assembly 56. In particular, the mandrel 150 is vertically oriented (i.e., a central axis A of the mandrel 150 is vertical), with the rear face 178 abutting or resting against the receiving face 126 of the reinforcement wall 74. The mandrel side face 182 nests against the guide bar 76 to better ensure a desired vertical arrangement of the mandrel 150. Finally, the mandrel 150 is in a vertically-lowered position relative to the carriage assembly 56, with the slide assembly 152 (for ease of illustration, only the lifting cam roller device 236 of the slide assembly 152 is shown) arranged relative to the arm 260 such that the secondary bracket 254 contacts or bears against the rod 268. Stated otherwise, the mandrel 150 is at a vertically lowest-most point relative to the carriage assembly 56 via the slide assembly 152 having "moved" downwardly along the arm 260. The secondary bracket 254/rod 268 interface can prevent further downward movement of the mandrel 150 relative to the carriage assembly 56 and/or an externally force can be applied to the mandrel apparatus 24. For example, the lift roller 256 can be nested within a mandrel vertical path track 280 (drawn generally) provided with the conveyor assembly 22 that serves to control a vertical or lift position of the mandrel 150 relative to the carriage assembly 56.

Figure 8A:
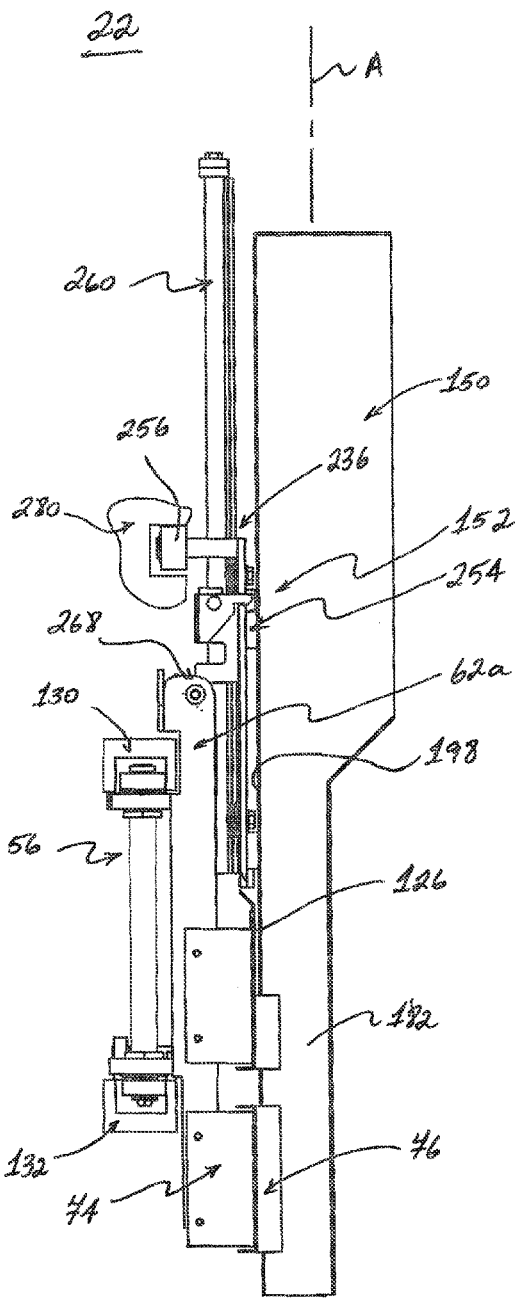
FIGS. 8A-8D are simplified side views illustrating various spatial positions and orientations of the mandrel relative to the carriage assembly with the construction of FIG. 7.
Figure 8B:
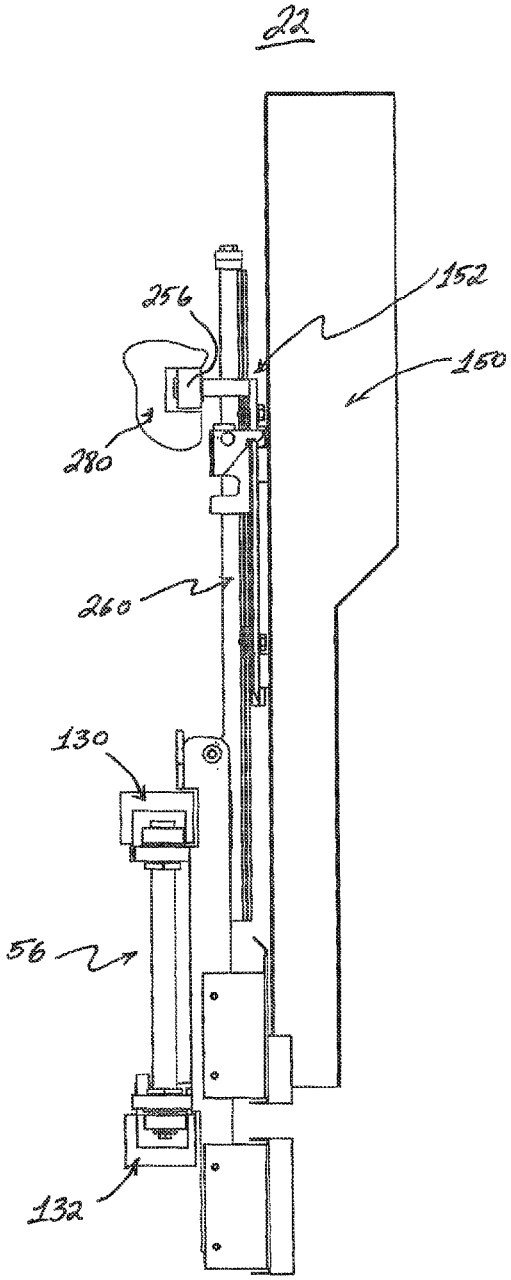

The mandrel 150 can be vertically raised from the state of FIG. 8A to a second state reflected in FIG. 8B. FIG. 8B reflects the conveyor assembly 22 as including the mandrel vertical path track 280 (schematically illustrated) located to interface with the lift roller 256. In particular, the mandrel vertical path track 280 is located along the path of travel T (into and/or out of the page of FIG. 8B) in a manner effectuating a change in vertical position of the mandrel 150. As the lift roller 256 traverses the mandrel vertical path track 280, the lift roller 256, and thus the slide assembly 152 and the mandrel 150 attached thereto, experiences a change in elevation, with the mandrel 150/slide assembly 152 sliding along the arm 260 and thus moving vertically relative to the carriage assembly 56. As revealed by a comparison of FIGS. 8A and 8B, where the mandrel vertical path track 280 changes elevation relative to the carriage rail(s) 130, 132 (that otherwise maintain the carriage assembly 56 at a constant elevation), the mandrel 150 can be maneuvered to a plethora of different vertical elevations relative to the carriage assembly 56.

Figure 8C:
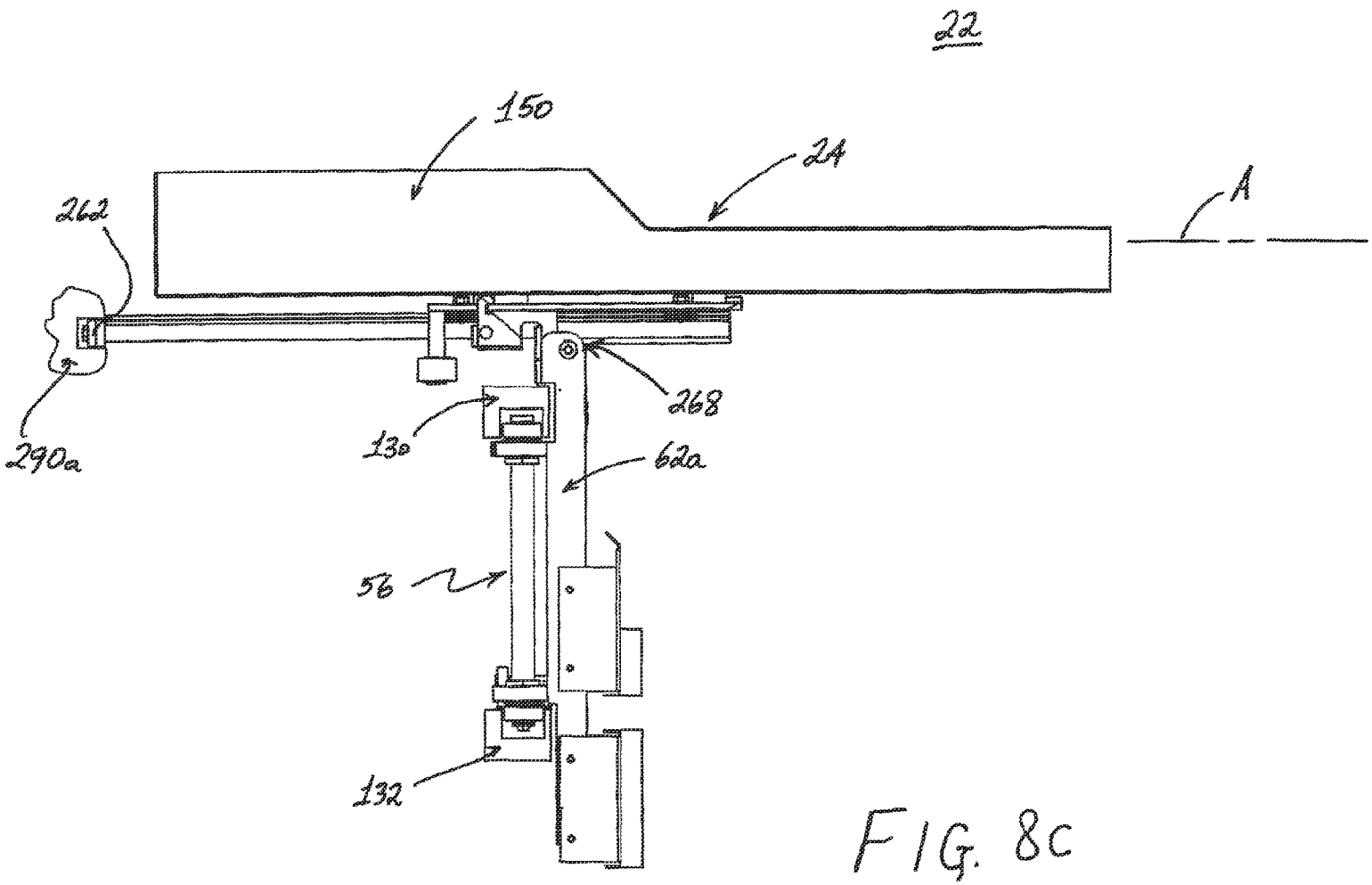

Yet another spatial orientation of the mandrel 150 facilitated by the mandrel apparatus 24 and the carriage assembly 56 is reflected in FIG. 8C, and includes the mandrel 150 transitioned toward a more horizontal orientation (as compared to the vertical orientation of FIG. 8A), for example with the mandrel central axis A being horizontal. With cross-reference between FIGS. 8A and 8C, the pivotable coupling between the rod 268 of the mandrel apparatus 24 and the support arms 62*a*, 62*b* (one of which is visible in the views) of the carriage assembly 56 permits the mandrel 150 to pivot or rotate relative to the carriage assembly 56 about a pivot point established at the rod 268. Transitioning of the mandrel 150 between the vertical orientation (FIG. 8A) and the more horizontal (or truly horizontal) orientation (FIG. 8C) can be effectuated in a variety of manners. For example, a force can be applied to the mandrel 150 of sufficient magnitude and direction to cause the mandrel 150 to pivot (or at least initiate a pivoting motion). Alternatively, or in addition, various features can be provided with the conveyor assembly 22 (referenced generally in FIGS. 8A and 8C) that initiate and/or control movement of the mandrel 150 between the vertical and horizontal orientations. For example, the conveyor assembly 22 can include a pivot path track 290 (schematically illustrated in FIG. 8C) located and positioned to selectively interface with the tilt control bearing 262 provided with the mandrel apparatus 24. The pivot path track 290 is formed along the path of travel T (into and out of the page of FIG. 8C), defining an incrementally changing path in terms of elevation and lateral spacing relative to the carriage assembly 56 (otherwise held at a spatially constant elevation by the carriage rails 130, 132) along the path of travel T. Thus, for example, the pivot path track segment 290*a* shown in FIG. 8C has a first elevation and lateral spacing relative to the carriage assembly 56/carriage rails 130, 132 such that with the tilt control bearing 262 engaged therewith, the mandrel 150 is forced or guided to the horizontal orientation shown (via pivoting of the rod 268 relative to the support arms 62*a*, 62*b*).

Figure 8D:
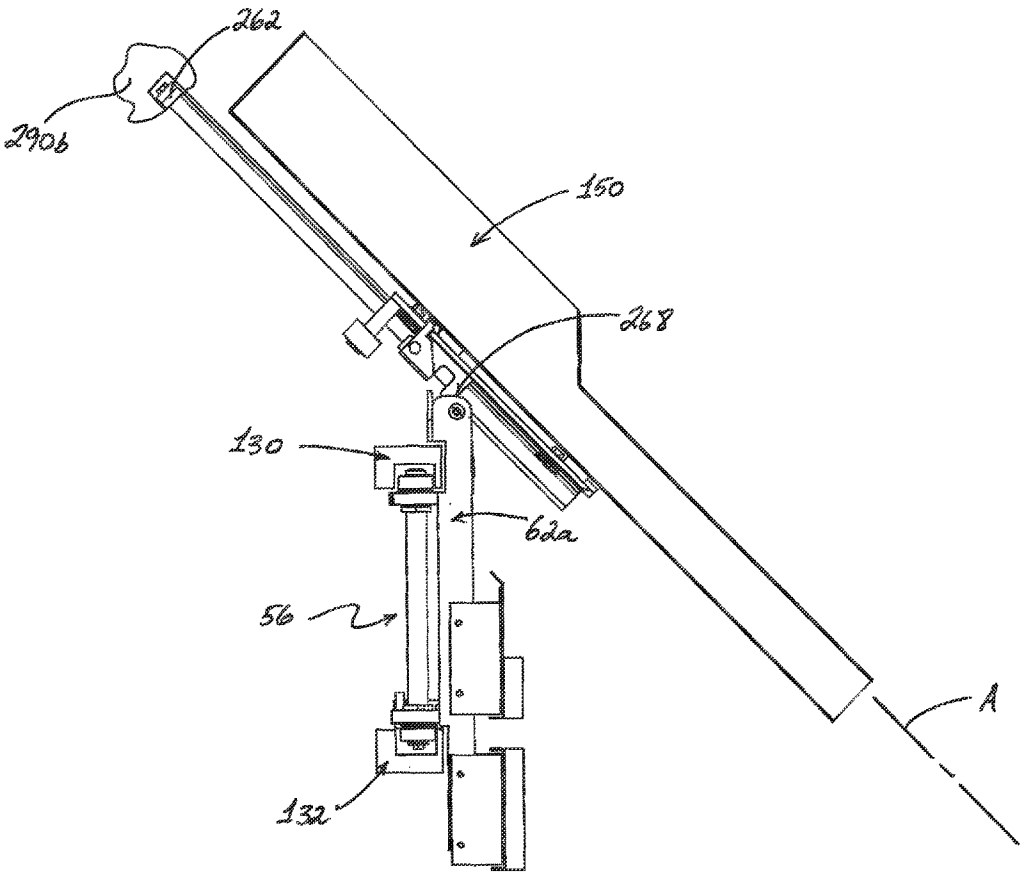

FIG. 8D illustrates a different segment 290*b* of the pivot path track 290, having a second elevation and lateral location (as compared to the elevation and lateral spacing of the pivot path track segment 290*a* in FIG. 8C) relative to the carriage rails 130, 132 and thus relative to the carriage assembly 56. More particularly, the second pivot path track segment 290*b* is spatially located such that with the tilt control bearing 262 engaged therewith, the mandrel 150 is forced or guided to the intermediate spatial orientation shown (i.e., the central axis A of the mandrel 150 is spatially arranged at an angle between the vertical and horizontal orientations), again with the rod 268 pivoting relative to the support arms 62*a*, 62*b* of the carriage assembly 56.

Pivoting and/or vertical transitioning of the mandrel 150 relative to the carriage assembly 56 can be accomplished with a number of differing mechanisms that may or may not include the mandrel vertical path track 280 (FIG. 8B) and/or the pivot path track 290. In more general terms, then, the package forming and loading system 20 (FIG. 1A) of the present disclosure is configured to selectively pivot and vertically maneuver the mandrels 150 as they traverse along the path of travel T in a desired fashion as described below. As a point of reference, FIG. 1B more clearly illustrates several of the possible spatial orientations and positions of the mandrels 150 as the carriage assemblies 56 traverse the path of travel T, as otherwise dictated by the conveyor assembly 22. The mandrel 150 of a first mandrel apparatus 24*a* is vertically oriented, and in a lowered position. The mandrel 150 of a second mandrel apparatus 24*b* is partially transitioned between a vertical and horizontal orientation. The mandrel 150 of a third mandrel apparatus 24*c* is horizontally oriented. The mandrel 150 of a fourth mandrel apparatus 24*d* is vertically oriented, and in a raised position. The rail arrangement 54 (e.g., the carriage rails 130, 132) maintain a vertical elevation of the carriage assemblies 56. FIG. 1B further reflects one embodiment of the mandrel vertical path track 280 (otherwise dictating a vertical elevation of the mandrels 150). Also, one embodiment of the pivot path track 290 is shown in FIG. 1B. The pivot path track 290 dictates a rotational orientation of the mandrels 150 connected thereto; however, depending upon operational parameters, the system 20 can operate such that some of the mandrels 150 "bypass" the pivot path track 290 (e.g., the mandrel 150 of a fifth mandrel apparatus 24*e*) and are not rotationally affected by the pivot path track 290.

Partial Package Forming Station 30

Returning to FIG. 1A, and with the above understanding of the conveyor assembly 22 and the mandrel apparatuses 24 in mind, the package forming and loading system 20 provides the partial package forming station 30 along a sequentially first location of the path of travel T. The partial package forming station 30 can assume a variety of forms, and is generally configured to form a partial package about the package portion 160 (FIG. 5A) of the mandrel 150 (FIG. 1B) of each of the mandrel apparatuses 24 as they sequentially pass through the station 30 via driven operation of the conveyor assembly 22. In some embodiments, the partial package forming station 30 is configured to create a partial inner film bag and a partial outer carton about the package portion 160. For example, the partial package forming station 30 can include a film handling module 300, a plastic sleeve module 302, a carton picker module 304, a carton sleeve forming module 306, a film sealing module 308, and a carton end completion module 310.

Figure 9:
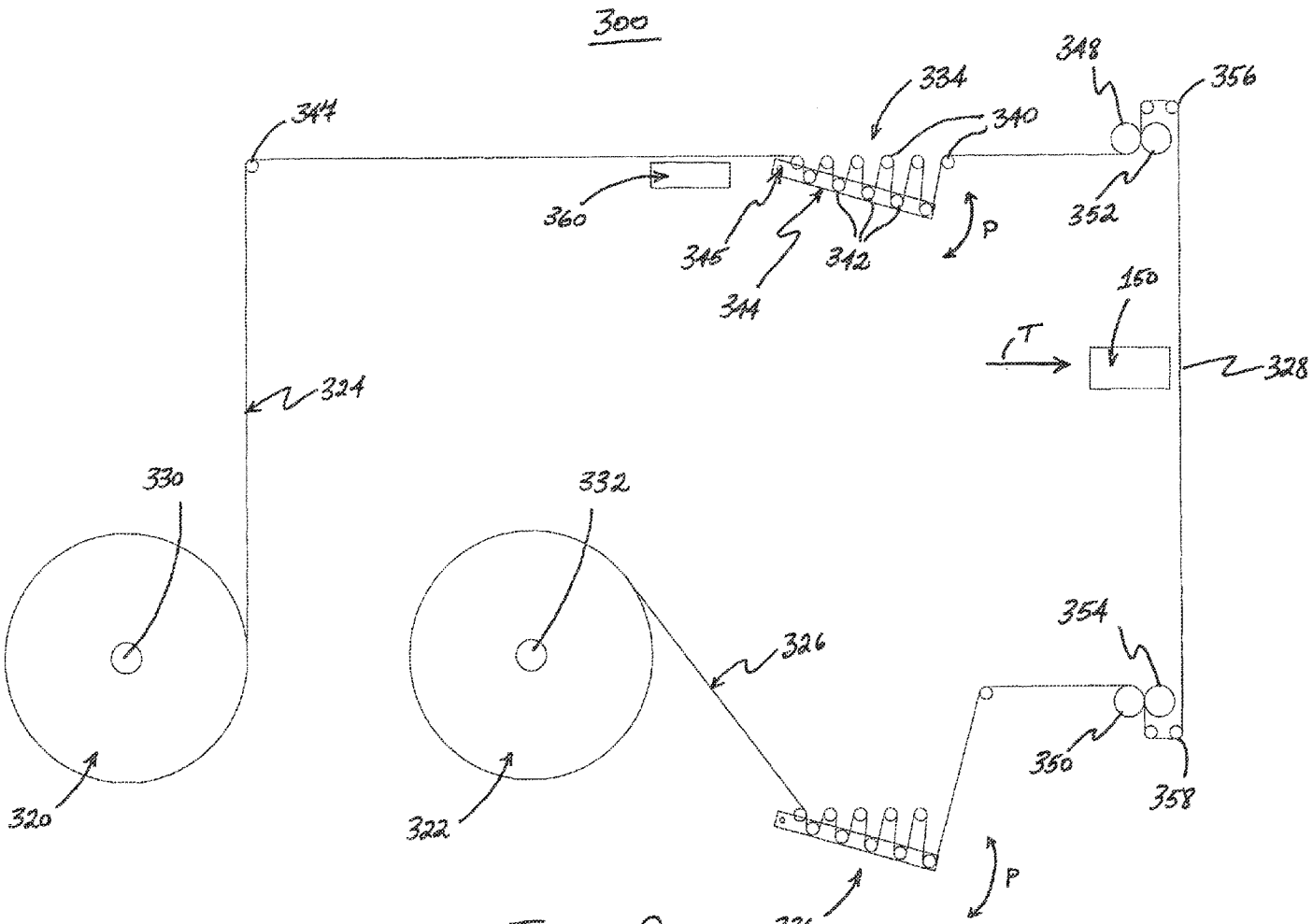
FIG. 9 is a simplified schematic diagram of a film loading module provided with a partial package forming station of the system of FIG. 1A.

One construction of the film handling module 300 is shown in FIG. 9, and includes first and second film source rolls 320, 322. Film 324 from the first film source roll 320 and film 326 from the second film source 322 are directed through various rollers and guide mechanisms for ultimate presentation at a wrapping zone 328 (referenced generally). For ease of explanation, one of the mandrels 150 described above is generically shown in a horizontal orientation and just prior to entering the wrapping zone 328 while moving along the path of travel T. With reference to the orientation of FIG. 9, the film 324 from the first source roll 320 is directed to a location "above" the wrapping zone 328 and thus can be referred to as an "upper" film; similarly, the film 326 from the second film source 322 can be referred to as a "lower" film.

Each of the film source rolls 320, 322 are provided as a large roll of film appropriate for containing the product in question (e.g., a polyethylene or polypropylene film safe for contact with consumable products), rotatably maintained on a corresponding motorized spindle 330, 332, respectively, (with operation of each of the motorized spindles 330, 332 being controlled by a separate controller (not shown), such as servo-controllers). While the films 324, 326 pass through differing film paths, the rollers and mechanisms associated with the film paths can be functionally identical. As a point of reference, the upper film 324 is sealed to the lower film 326 at the wrapping zone 328. As the mandrel 150 traverses through the wrapping zone 328 along the path of travel T, a pulling force is applied to the films 324, 326. The spindles 330, 332 operate to unwind the corresponding source rolls 320, 322 so as to deliver a continuous supply of the upper and lower films 324, 326 to the wrapping zone 328. Metering of the films 324, 326 relative to the wrapping zone 328 is provided by a first or upper accumulation assembly 334 associated with the upper film 324 and a second or lower accumulation assembly 336 associated with the lower film 326.

The accumulation assemblies 334, 336 can be identical (or at least functionally identical) such that the following description of the upper accumulation assembly 334 applies equally to the lower accumulation assembly 336. The accumulation assembly 334 consists of a plurality of stationary rollers 340 and a plurality of moveable rollers 342. Within the upper accumulation assembly 334, the upper film 324 passes around and between consecutively opposite ones of the stationary rollers 340 and the moveable rollers 342 as shown. The moveable rollers 342 are each rotatably coupled to a common arm 344 that in turn is pivotably connected to a support frame (not shown) in a manner establishing a pivot point 345. Pivotable mounting of the arm 344 operates to collectively translate the moveable rollers 342 relative to the stationary rollers 340 along an intermittent, arcuate path (represented by the arrow P in FIG. 9) about the pivot point 345. In some embodiments, accumulation assembly 334 is configured to serve as an accumulation station for the upper film 324 with the arm 344, and thus the movable rollers 342 carried thereby, moves or pivots under the forces of gravity.

The upper film 324 can be directed from the film source roll 320 and into the upper accumulation assembly 334 in various fashions, such as by an upstream guide roller 347, and is driven from the upper accumulation assembly 334 to the wrapping zone 328 by an upper drive roller 348. The upper drive roller 348 is intermittently actuated (or caused to rotate) by an appropriate controller (not shown). Relative to delivery of the upper film 324, the upper drive roller 348 is caused to operate intermittently, for example driven to rotate when one of the mandrels 150 is about to enter the wrapping zone 328. Under these circumstances, while the spindle 330 is operating to provide a constant and continuous supply of the upper film 324 and the drive roller 348 is in an idle state, gravity causes or allows the arm 344, and thus the moveable rollers 342 carried thereby, to pivot downward along the arcuate path P for accumulation of the upper film 324. As the upper drive roller 348 is operated to drive the upper film 324 to the wrapping zone 328, the arm 344/moveable rollers 342 naturally pivot back upward along the arcuate path P, removing any excess/slack in the upper film 324. Additionally, because the arm 344 (and/or any other body provided with the upper accumulation assembly 334 and acting upon the moveable rollers 342) has an appropriate mass, a constant tension is naturally applied to the upper film 324 within the upper accumulation assembly 334 to impart a desired tension in the upper film 324 that in turn promotes accurate driving thereof by the upper drive roller 348. A lower drive roller 350 is similarly provided for driving the lower film 326 from the lower accumulation assembly 336 to the wrapping zone 328, with the lower accumulation assembly 336/lower drive roller 350 operating as described above.

Delivery of the upper film 324 to the wrapping zone 328 can further be controlled by an upper pinch roller 352 associated with the upper drive roller 348. The upper film 324 is secured, or pinched, between the upper drive roller 348 and the upper pinch roller 352. A lower pinch roller 354 is similarly provided at the lower drive roller 350 for interfacing with the lower film 326. In some embodiments, the drive rollers 348, 350 and the pinch rollers 352, 354 are independently pivoted as needed to prevent natural and expected "walking" of the films 324, 326 along the corresponding drive roller 348, 350, respectively. Finally, one or more upper guide rollers 356 can be provided for directing the upper film 324 from the upper drive roller 348 to the wrapping zone 328 to better ensure that a parallel contacting surface is presented to the mandrel 150. One or more lower guide rollers 358 can similarly be provided along the film path of the lower film 326 between the lower drive roller 350 and the wrapping zone 328.

Further control over the metered delivery of the films 324, 326 to the wrapping zone 328 is provided by an optional tracking device 360 (shown in block form) operatively associated with the upper accumulation assembly 334. In general terms, the tracking device 360 senses information indicative of a velocity of the upper film 324 as it passes through the upper accumulation assembly 334, with this velocity, in turn, indicating whether or not a sufficient amount of the upper film 324 is being fed from the film source roll 320. As a point of reference, as the film source roll 320 continually expends a length of the upper film 324, a diameter of the film source roll 320 gradually decreases. If the driven speed of the spindle 330 were to remain constant, the arm 344 connecting the moveable rollers 342 would rotate upward along the arcuate path P as an effectively lesser amount of the upper film 324 is being provided to the upper drive roller 348 per unit time. Thus, to provide a constant velocity of the upper film 324 at the upper drive roller 348, the spindle 330 can be driven at a continuously increasing angular velocity until the film source roll 320 has been depleted of usable film. With this in mind, the tracking device 360 can assume various forms, such as an encoder located at the pivot point 345 of the arm 344 and programmed to determine (or sense) the angular position of the arm 344. The so-located encoder senses the angular position of the arm 344, and commands (directly or indirectly) the controller operating the spindle 330 to adjust a rotational speed of the spindle 330 accordingly. A similar tracking device can be operative associated with the lower accumulation device 336. It will be understood that other techniques and/or devices can alternatively be employed to control the metered delivery of the films 324, 326 to the wrapping zone 328.

The film handling module 300 described above is but one acceptable film handling construction envisioned by the present disclosure. A variety of other, conventional film handling or supply devices can alternatively be employed that may or may not include the accumulation assemblies 334, 336 and/or the tracking device 360. With embodiments in which the accumulation assemblies 334, 336 and the tracking device 360 are provided, however, the film handling module 300 further includes a control system (not shown), such as programmable logic controllers, computer, etc., and sensor(s) that collectively operate (or respond to information from) the mechanisms associated with the spindles 330, 332, the accumulating assemblies 334, 336, and the tracking device 360 in a synchronized manner. For example, during operational periods of time where mandrels are continuously passing through the wrapping zone 328, the controller operates the motorized spindles 330, 332 to continuously rotate. The drive rollers 348, 350, in synchronized timing with the individual mandrel 150 passing through the wrapping zone 328, positively move a sufficient length of the corresponding films 324, 326 from the accumulation assemblies 334, 336 for delivery to the wrapping zone 328. Once the mandrel 150 has passed through the wrapping zone 328, positive rotation of the drive rollers 348, 350 is temporarily stopped until the sequentially next mandrel 150 enters the wrapping zone 328 at which time the drive rollers 348, 350 are again rotated a necessary amount.

As described in greater detail below, while the package forming and loading system 20 (FIG. 1A) may operate to continuously move or drive the conveyor assembly 22 (FIG.

1B), operational parameters may dictate that one or more of the consecutively-arranged mandrels 150 do not pass directly through the wrapping zone 328 (and thus a continuous supply of the films 324, 326 is temporarily unnecessary). Under these circumstances, the spindles 330, 332 periodically discontinue the unwinding motion.

Figure 10:
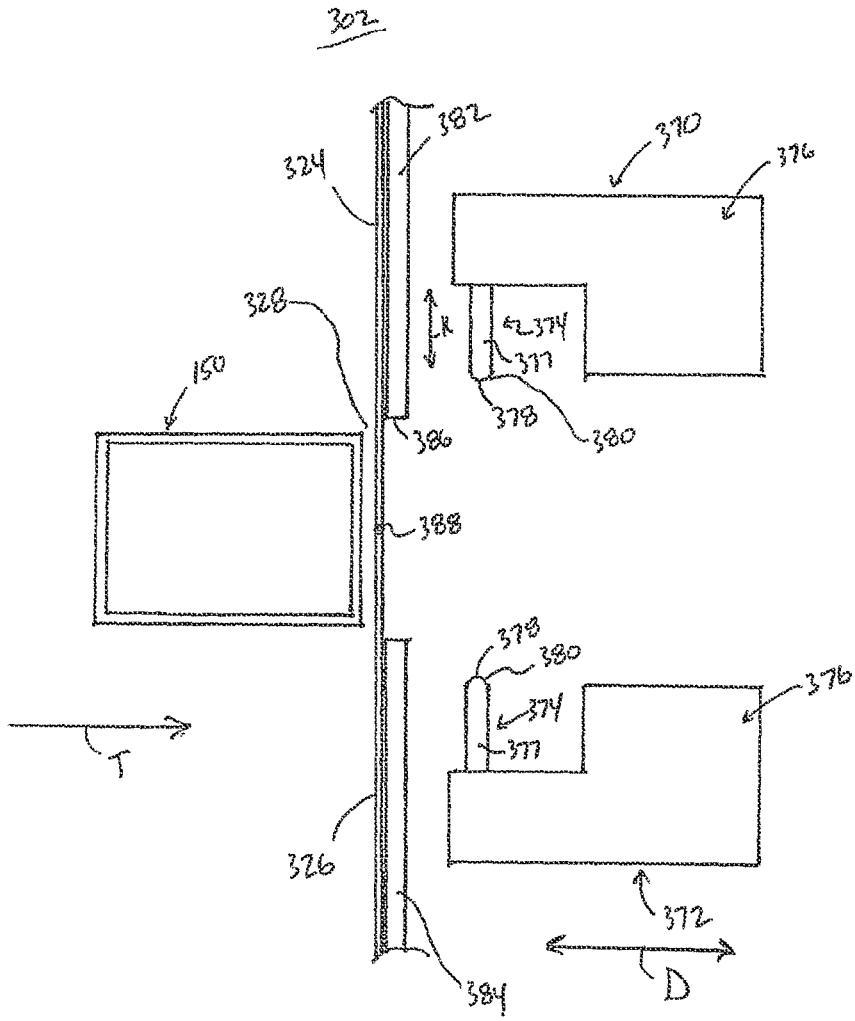
FIG. 10 is a simplified side view of a plastic sleeve forming module useful with the partial package forming station of FIG. 1A.

Returning to FIG. 1A, the plastic sleeve module 302 is located immediately downstream (relative to the path of travel T) of the film handling module 300, and in particular immediately downstream of the wrapping zone 328. The sleeve module 302 is generally constructed to form a continuous, open-ended plastic sleeve about each of the mandrels 150. With this in mind, FIG. 10 illustrates, in simplified form, one embodiment of the sleeve module 302 as including upper and lower jaw assemblies 370, 372. For ease of explanation, one of the mandrels 150 described above is generally shown in FIG. 10 in a horizontal orientation and just prior to entering the wrapping zone 328 while moving along the path of travel T. The jaw assemblies 370, 372 can be identical, or at least functionally identical, such that the following description of the upper jaw assembly 370 applies equally to the lower jaw assembly 372. The jaw assembly 370 includes a sealing knife mechanism 374 and a linear drive device 376. The sealing knife mechanism 374 includes a sealing knife 377 configured to effectuate sealing or bonding of plastic film (e.g., heat, ultrasound, etc.) and cutting of plastic film at a knife end 378. A guide surface 380 is formed adjacent the knife end 378 and is generally configured to facilitate smooth, sliding contact with film. The sealing knife mechanism 374 is vertically moveable relative to the path of travel T, as indicated by an arrow K in FIG. 10. For example, the sealing knife mechanism 374 can be slidably connected to an actuator (not shown, but akin to a servo driven linear actuator) operable to advance and retract the sealing knife 377 (e.g., vertically relative to the orientation of FIG. 10).

The linear drive device 376 dictates a longitudinal location of the sealing knife mechanism 374 relative to the path of travel T, with the linear drive device 376 of the upper and lower jaw assemblies 370, 372 being individually or collectively driven in tandem by a drive unit (not shown) in a reciprocal, back-and-forth fashion as represented by an arrow D in FIG. 10. Though not shown, the sleeve module 302 can include one or more controllers and/or sensors that dictate movement of the sealing knife mechanisms 374 and the drive devices 376.

Operation of the sleeve module 302 in forming a plastic sleeve about the mandrel 150 otherwise passing through the wrapping zone 328 begins with the relationship of FIG. 10. Initially, the mandrel 150 enters the wrapping zone 328 as defined, for example, by opposing guide plates 382, 384. The plates 382, 384 are separated by a gap 386 sized in accordance with a corresponding dimension of the mandrel 150 (i.e., the mandrel 150 freely passes through the gap 386). FIG. 10 further reflects the upper and lower films 324, 326 collectively extending over the plates 382, 384 and across the gap 386. It will be recalled that the upper and lower films 324, 326 are sealed or joined to one another at the wrapping zone 328. FIG. 10 generally reflects this joined relationship at a seam 388. For reasons made clear below, the seam 388 can also be referred to as a leading side seam relative to the mandrel 150 being processed.

As the mandrel 150 is poised to contact the films 324, 326, the drive devices 376 longitudinally locate the corresponding sealing knife mechanism 374 in relatively close proximity to the plates 382, 384. The jaw assemblies 370, 372 are operated such that the sealing knife mechanisms 374 are in a retracted state, with the knife end 378 of the corresponding sealing knife mechanism 374 being vertically retracted from the path of travel T a sufficient distance to permit passage of the mandrel 150 therebetween.

Figure 11A:
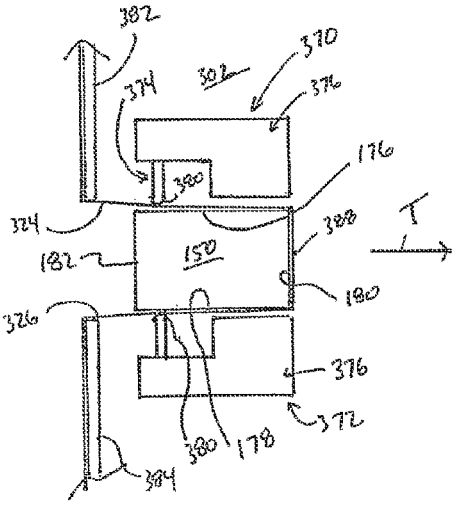
FIGS. 11A-11C illustrate operation of the sleeve forming module of FIG. 10.

With continued movement of the mandrel 150 along the path of travel T, the drive devices 376 accelerate away from the guide plates 382, 384 in a direction of the path of travel T as shown in FIG. 11A, ultimately matching the linear velocity of the mandrel 150. Thus, movement of the drive devices 376 is synchronized with movement of the mandrel 150 along the path of travel T. The upper and lower films 324, 326 begin wrapping about the mandrel 150. In this regard, the leading side seam 388 is located against the first side face 180 of the mandrel 150. The upper film 324 wraps around the first side face 180 and onto the front face 176, with this desired wrapping motion being promoted by contact between the upper film 324 and the guide surface 380 of the upper jaw assembly knife mechanism 374. The lower film 326 similarly wraps along the rear face 178 via directed interface with the guide surface 380 of the lower jaw assembly 372.

Figure 11B:
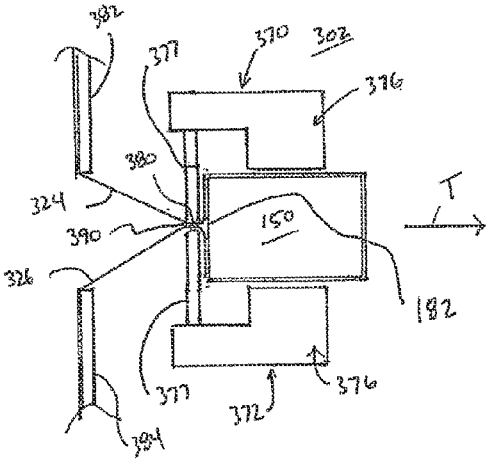

Once the second side face 182 of the mandrel 150 has advanced to a point of alignment with the knife ends 378, the knife mechanisms 374 are transitioned to the extended state shown in FIG. 11B. In the extended state, the sealing knives 377 bring the upper and lower films 324, 326 into contact with one another at the second side face 182 of the mandrel 150, with the corresponding guide surfaces 380 effectuating a relatively tensioned wrap of the films 324, 326 about the mandrel 150. At the point of contact, a differential velocity between the mandrel 150 and the drive devices 376 is zero (i.e., the drive devices 376 are traveling at the same linear velocity as the mandrel 150). The sealing knifes 377 are then operated to effectuate sealing of the films 324, 326 (e.g., the knife ends 378 are temporarily heated). As a result, a second seal 390 is created at which the upper and lower films 324, 326 are joined to one another. The second seal 390 is then internally severed by operation of the knife ends 378 (e.g., the knife ends 378 can be sharpened or further heated to completely cut through the second seal 390). The jaw assemblies 370, 372 are then commonly operated to retract the knives 377 and move the knife mechanisms 374 back toward the plates 382, 384 (i.e., the initial position of FIG. 10).

Figure 11C:
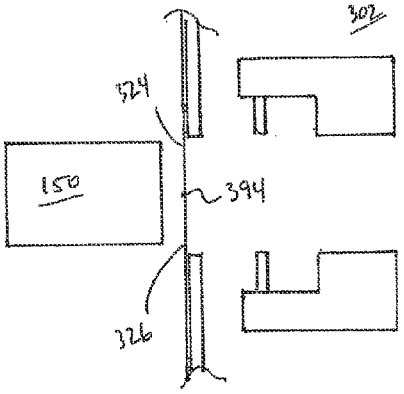
Figure 11C:
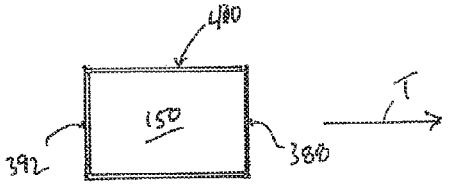

Cutting of the second seal 390 generates discrete downstream and upstream seam segments 392, 394 as shown in FIG. 11C. The downstream seam segment 392 completes a film sleeve 400 about the mandrel 150. Thus, the downstream seam segment 392 serves as a trailing side seam relative to the mandrel 150. Conversely, the upstream seam segment 394 remains at the wrapping zone 328 for subsequent processing with a sequentially next mandrel 150. In other words, following the sealing and cutting steps, the upstream seam segment 394 serves as the leading seam 388 (FIG. 10) for the sequentially next mandrel.

Figure 11D:
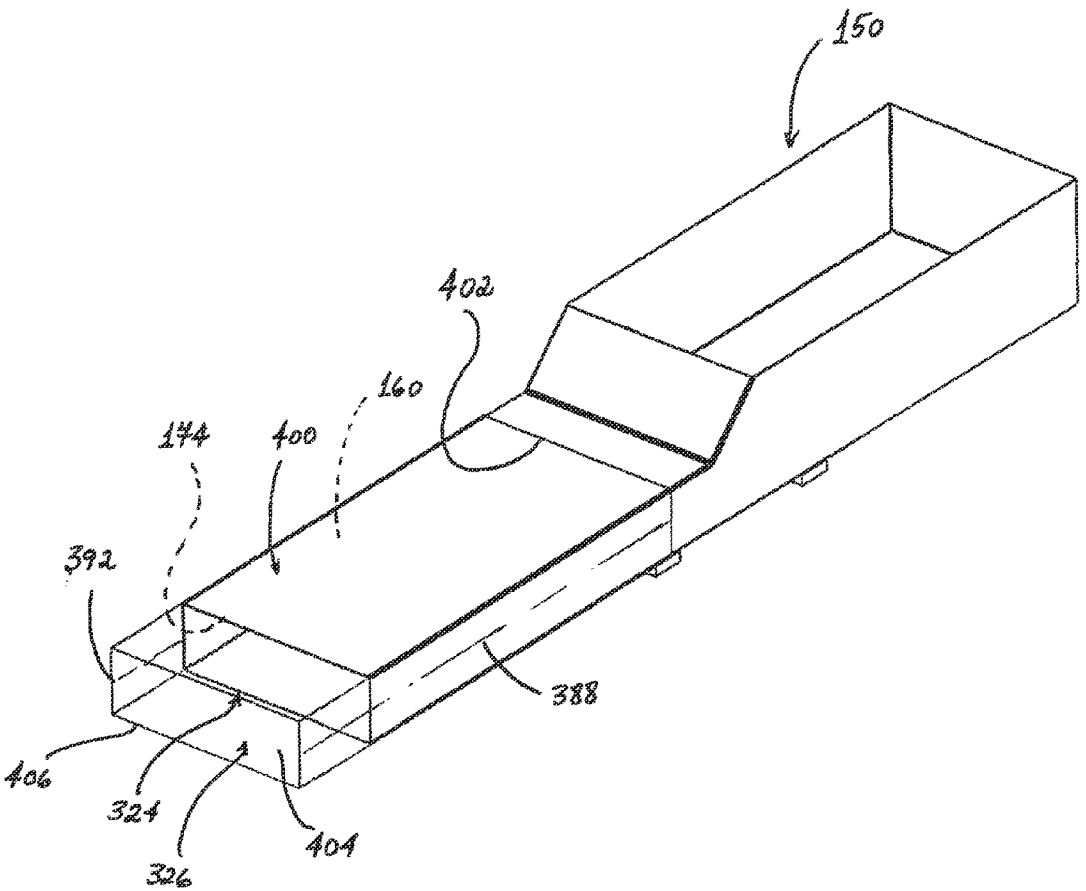
FIG. 11D is a perspective view of a mandrel and film after passing through the sleeve forming module of FIG. 10.

FIG. 11D illustrates one embodiment of the mandrel 150 after having passed through the sleeve module 302 (FIG. 10). In particular, the package portion 160 has been wrapped in the upper and lower films 324, 326 that are sealed longitudinally by the leading and trailing side seams 388, 392, thus resulting in the film sleeve 400. An upper end 402 of the film sleeve 400 is in direct contact with the mandrel 150. Conversely, a lower portion 404 of the film sleeve 400 extends beyond the end 174 of the mandrel 150, such that a lower, open end 406 of the film sleeve 400 is free of the mandrel 150.

Returning to FIG. 1A, the carton picker module 304 and the carton sleeve forming module 306 can assume any form conventionally employed with automated cartoner machines. In general terms, and in some embodiments, a plurality of flat carton blanks are provided to the module 304 in a magazine.

Figure 12:
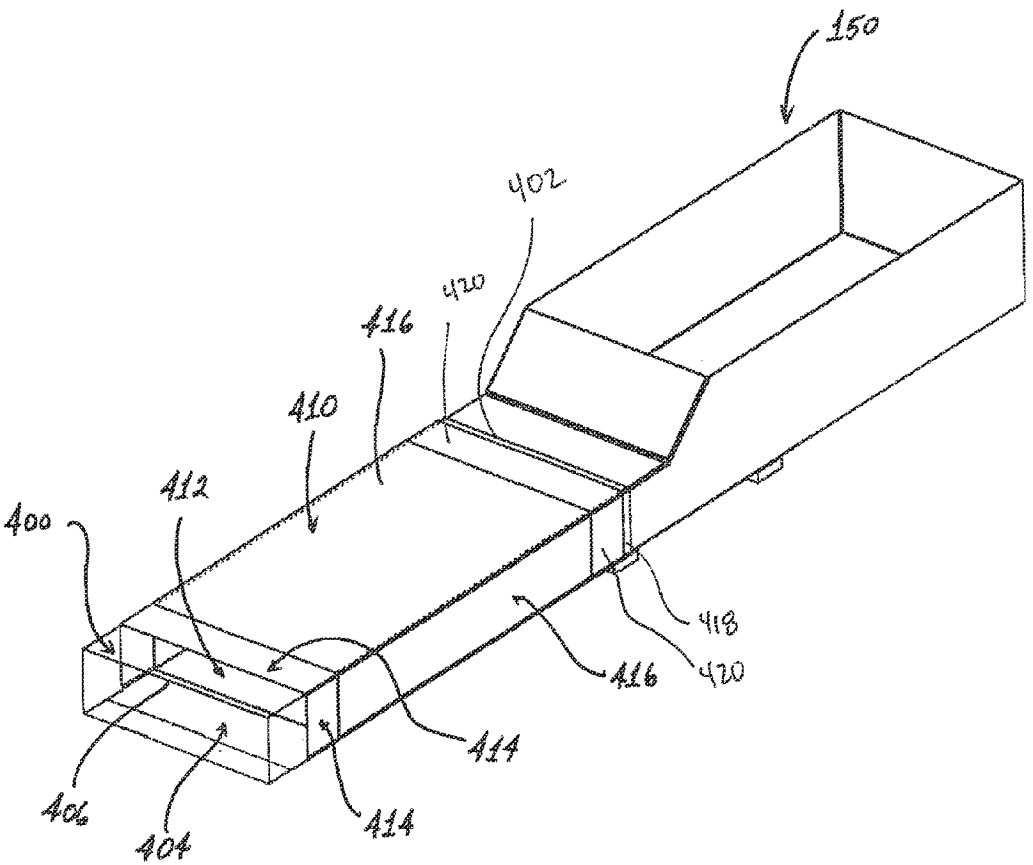
FIG. 12 is a perspective view of a mandrel, film, and carton packaging material after passing through a carton sleeve forming module provided with the partial package forming station of FIG. 1A.

Individual ones of the flat carton blanks are removed from the magazine by the carton picker module 304 and inserted into the path of travel T. The so-inserted carton blank is then caused to wrap around the mandrel 150/film sleeve 400 (FIG. 11D) by various flights and/or mechanisms provided with the carton forming module 306 as the mandrel 150 continues along the path of travel T. Following processing by the carton picking module 304 and the carton forming module 306, a carton sleeve 410 is formed about the mandrel 150 as shown in FIG. 12. Glue applied by the carton sleeve forming module 306 adhesively secures or completes the carton sleeve 410. As a point of reference, although the carton sleeve 410 is formed over the film sleeve 400, the lower portion 404 of the film sleeve 400 extends (or is exposed) beyond a bottom portion 412 of the carton sleeve 410 (with the bottom portion 412 conventionally including one or more end flaps referenced generally at 414). In this regard, the end flaps 414 are foldable relative to panels 416 (two of which are visible in the view of FIG. 12) of the carton sleeve 410. In some embodiments, prior to folding of the end flaps 414 relative to the panels 416, the lower portion 404 of the film sleeve 400 may be "within" an area defined by the unfolded end flaps 414. However, the lower portion 404 of the film sleeve 400 is readily accessible by simply folding one or more of the end flaps 414 away from the lower portion 404. The upper end 402 of the film sleeve 400 may or may not extend beyond a top edge 418 of the carton sleeve 410 that can otherwise conventionally be defined by end flaps 420 that are foldable relative to the corresponding panel 416.

Figure 13:
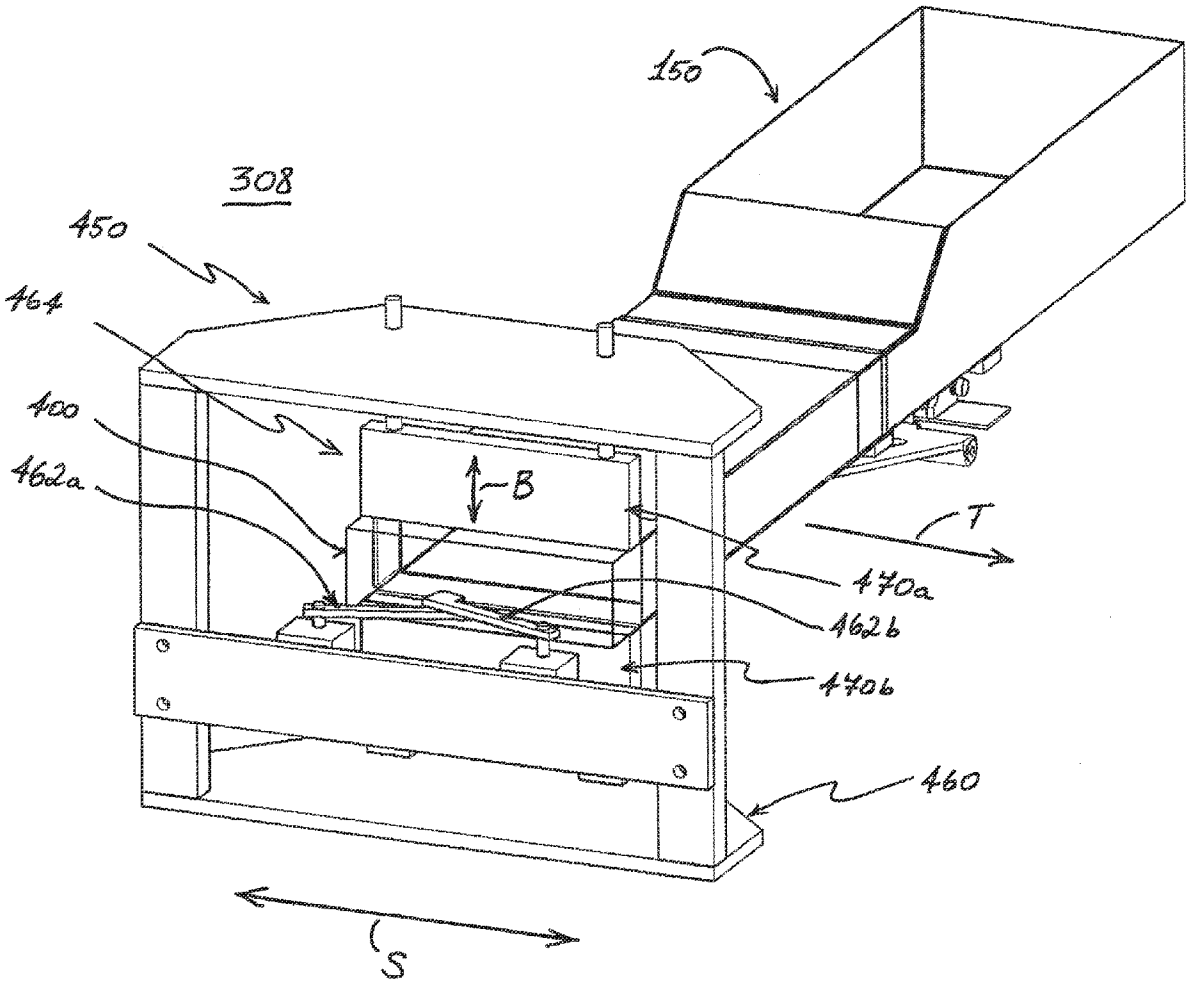
FIG. 13 is a simplified perspective view of a film sealing module useful with the partial package forming station of FIG. 1A, along with a mandrel being acted upon by the module.

With reference to FIGS. 1A and 12, the film sealing module 308 is configured to seal the lower, open end 406 of the film sleeve 400 with continued movement of the mandrel 150 along the path of travel T. One acceptable construction of the film sealing module 308 is shown schematically in FIG. 13 and includes a sealing device 450. A relationship of the sealing device 450 relative to the path of travel T of one of the mandrels 150 is reflected in FIG. 13, with the sealing device 450 acting upon the film sleeve 400 (otherwise carried by the mandrel 150) to form a bottom seal at the lower, open end 406.

The sealing device 450 generally includes a shuttle assembly 460, film fingers 462*a*, 462*b*, and a seal mechanism 464. The shuttle assembly 460 maintains the film fingers 462*a*, 462*b* and the seal mechanism 464, and is longitudinally movable relative to the path of travel T (as indicated by the arrow S in FIG. 13) by a linear drive mechanism (not shown).

Figure 14A:
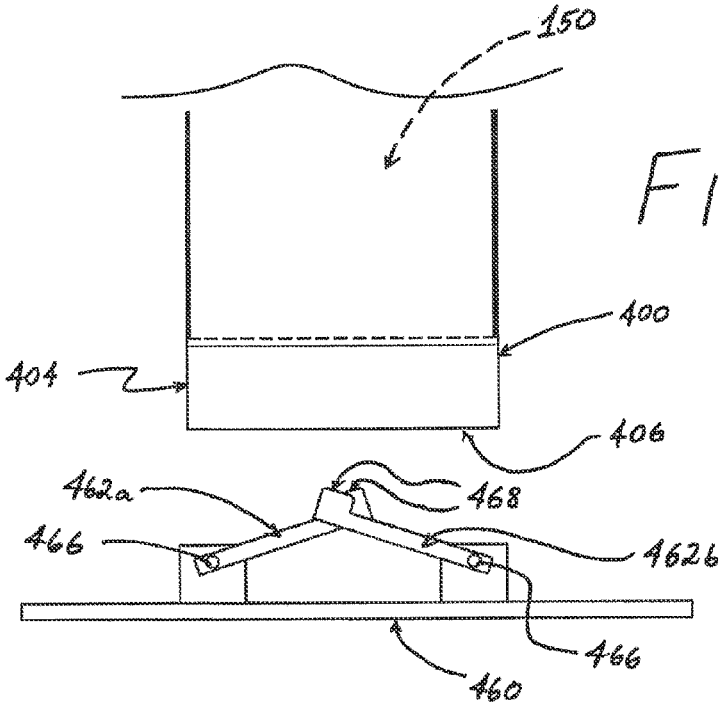
FIGS. 14A and 14B are simplified top views of a portion of the module of FIG. 13, illustrating operation of film engaging fingers relative to a film sleeve carried by a mandrel.
Figure 14B:
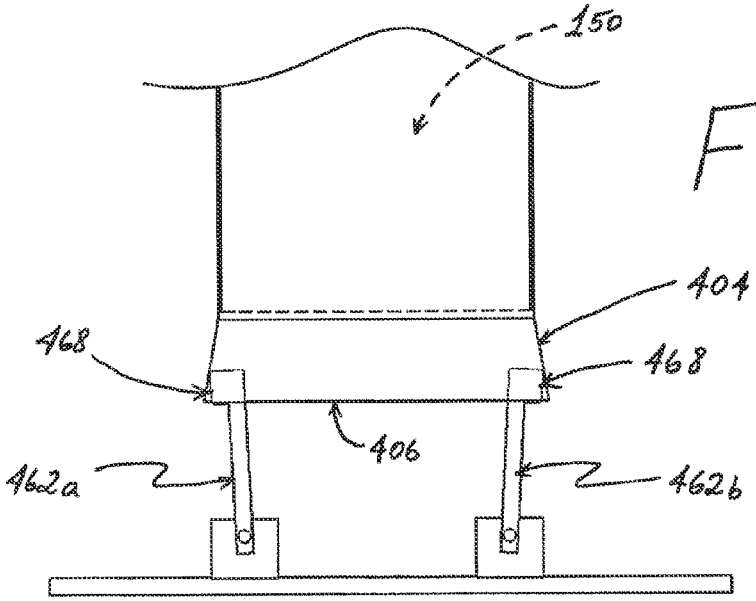

The film fingers 462*a*, 462*b* can be identical, and are rotatable relative to the shuttle assembly 460 as reflected in FIGS. 14A and 14B, each rotating about a pivot point 466 located generally opposite an engagement end 468. In particular, one or more actuators (not shown), such as servo actuators, dictate a rotational position of the film fingers 462*a*, 462*b*. The rotational position, in turn, has a predetermined relationship relative to the mandrel 150 and thus the film sleeve 400 carried thereby (shown schematically in FIGS. 14A and 14B). For example, FIG. 14A reflects the film fingers 462*a*, 462*b* in a rotationally retracted or disengaged state whereby the engagement ends 468 are away from or outside of the film sleeve lower portion 404. Conversely, in the rotationally advanced or engaged state of FIG. 14B, the film fingers 462*a*, 462*b* have been rotated so as to insert the corresponding engagement ends 468 within the film sleeve open end 406, and into engagement or contact with opposing sides of the lower portion 404. In the engaged state, then, the film fingers 462*a*, 462*b* apply a slight tension onto the trailing portion 404.

Returning to FIG. 13, the horizontally driven seal mechanism 464 can include vertically driven upper and lower seal bars 470*a*, 470*b*. The seal bars 470*a*, 470*b* can assume various forms appropriate for imparting a seal into plastic film (e.g., heat, ultrasound, etc.). Regardless, the seal mechanism 464 incorporates one or more actuators (not shown) that selectively advance and retract the seal bars 470*a*, 470*b* relative to the center of the mandrel 150 in the vertical direction (represented by the arrow B in FIG. 13).

Figure 15A:
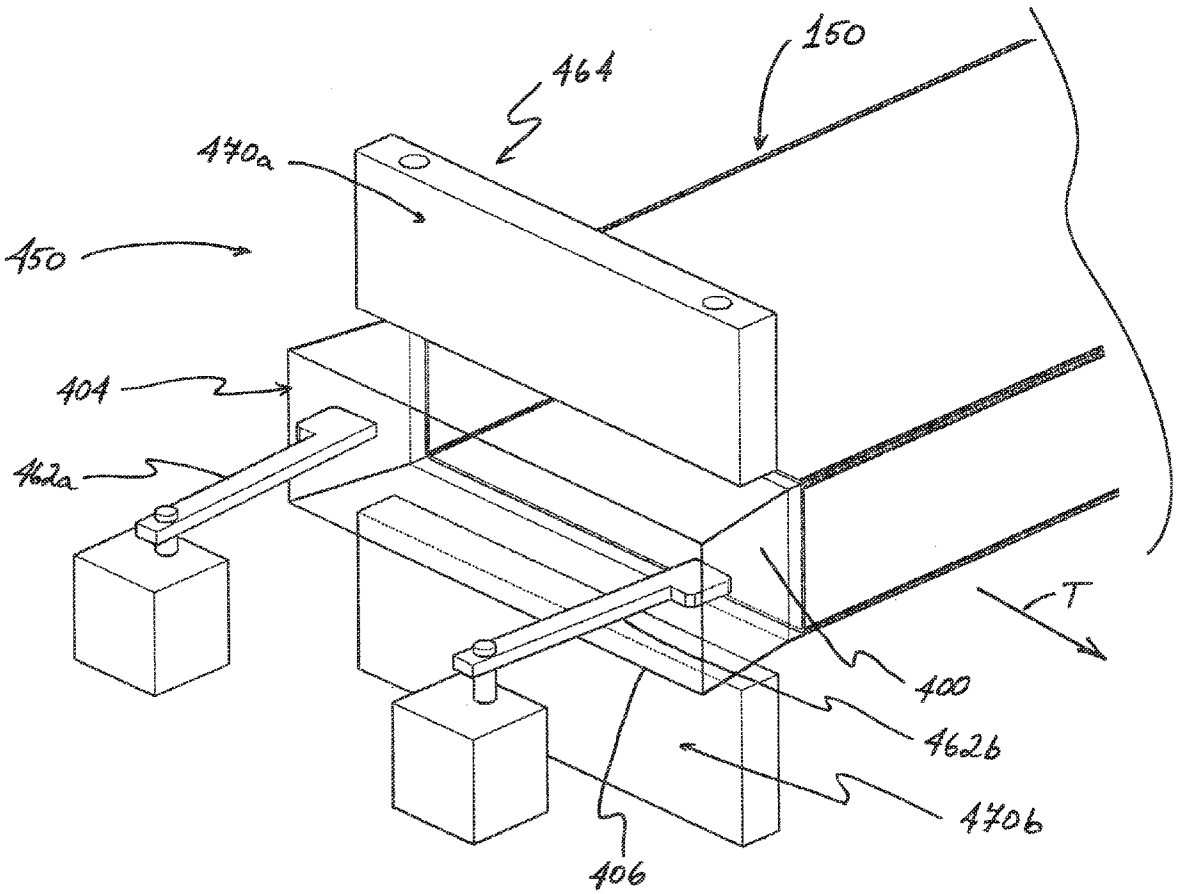
FIG. 15A is a simplified perspective view of a sealing device portion of the film sealing module of FIG. 12 at an initial stage of processing a film sleeve maintained by a mandrel.
Figure 15B:
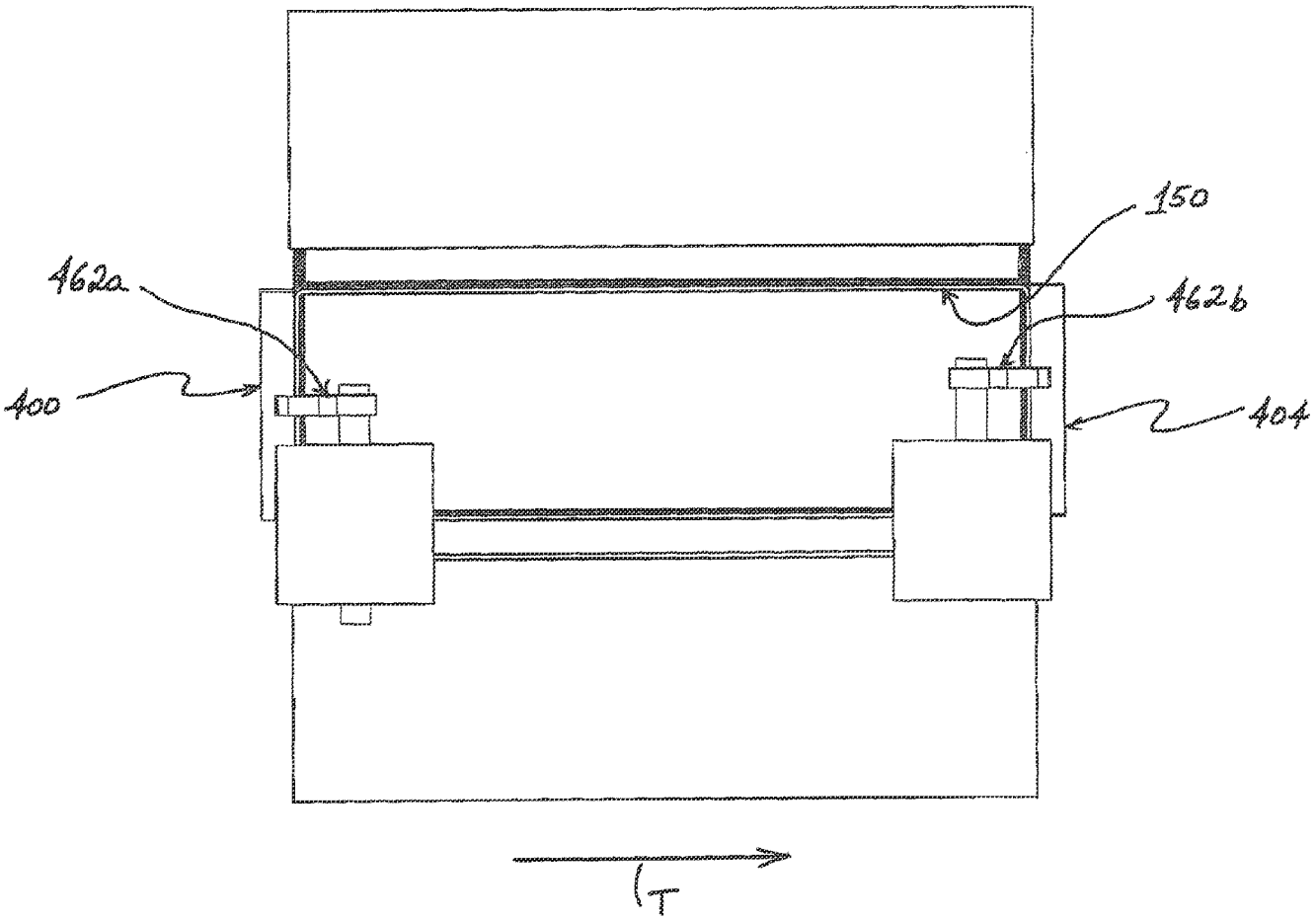
FIG. 15B is a simplified front view of the sealing device portion of FIG. 15A at an intermediate stage of operation relative to the film sleeve and mandrel of FIG. 15A.
Figure 15C:
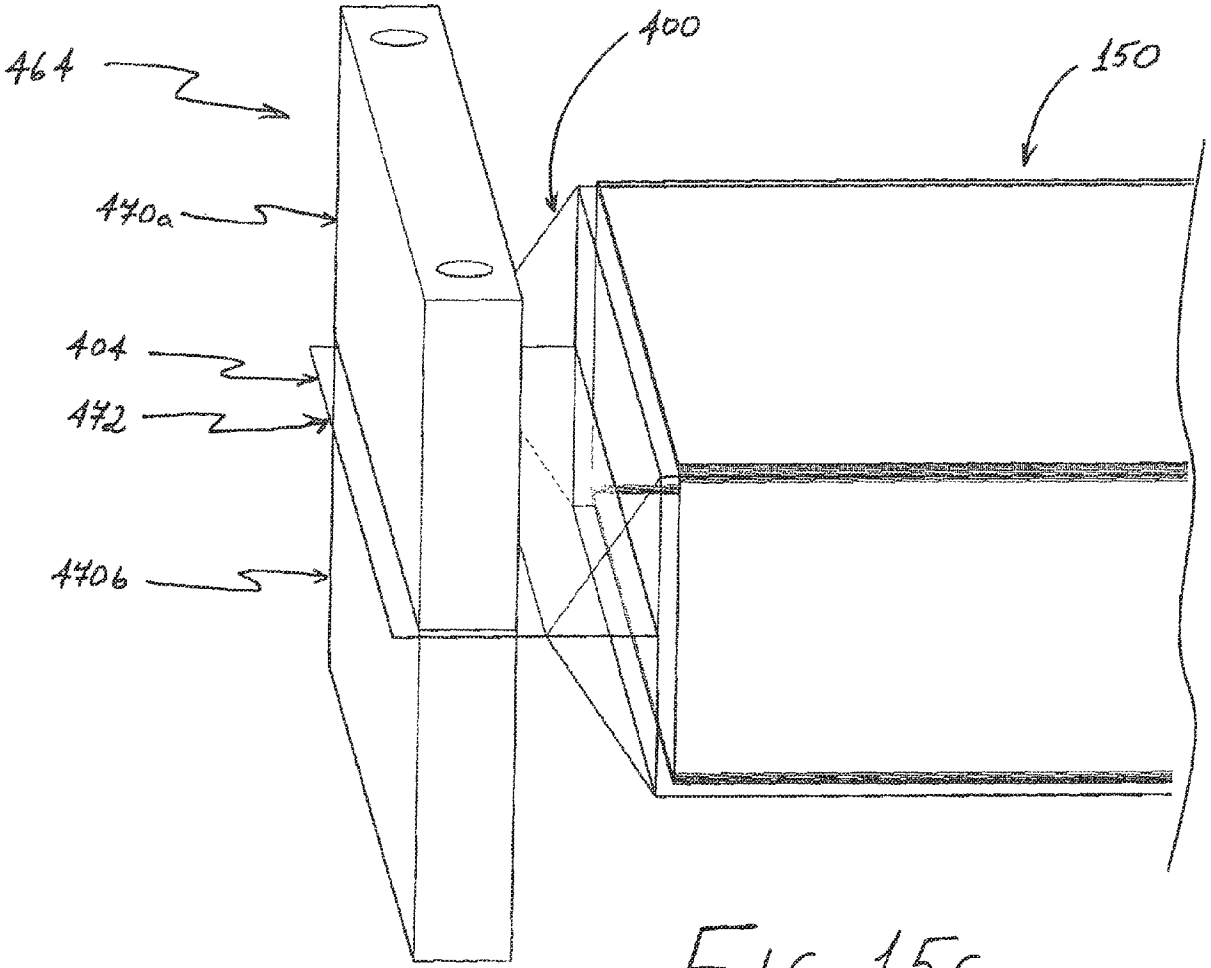
FIG. 15C is a simplified perspective view of the sealing device of FIG. 15A at a final stage of operation in forming a bottom seal to the film sleeve of FIG. 15A.

Operation of the sealing device 450 is generally reflected in FIGS. 15A-15C. At the initial stage of FIG. 15A, the mandrel 150, in the horizontal orientation described above, "enters" the sealing device 450 along the path of travel T, it being understood that the mandrel 150 is at all times physically spaced from the sealing device 450, being positioned to instead "insert" the film sleeve lower portion 404 into the sealing device 450. As generally shown, the lower portion 404 of the film sleeve 400 may be somewhat loosely arranged relative to the rigid construction of the mandrel 150. Regardless, the seal bars 470*a*, 470*b* are sufficiently spaced so as to permit initial passage of the lower portion 404 therebetween. In the initial stage of interface between the film sleeve 400 and the sealing device 450, the film fingers 462*a*, 462*b* are in the retracted state (FIG. 14A), and thus are "outside" of the lower portion 404.

The shuttle assembly 460 moves the film fingers 462*a*, 462*b* and the seal mechanism 464 in a synchronized fashion with continuous movement of the mandrel 150 along the path of travel T. In some embodiments, the sealing device 450 can include one or more plow bars that serve to fold one or more of the end flaps 414 (FIG. 12) of the carton sleeve 410 (FIG. 12) away from the open end 406 of the film sleeve 400 prior to interaction with the film fingers 462*a*, 462*b* and/or the seal mechanism 464. As shown in FIGS. 15A and 15B, the film fingers 462*a*, 462*b* are prompted to move to the extended state, thereby entering the lower portion 404 of the film sleeve 400, and engaging opposing sides of the lower portion 404. The opposing forces applied by the film fingers 462*a*, 462*b* onto the lower portion 404 renders the film of the lower portion 404 to a taut, relatively linear low profile (also reflected in FIG. 14B). The film fingers 462*a*, 462*b* are then prompted to withdraw from the lower portion 404 (i.e., rotated to the retracted state). As shown in FIG. 15C, the seal mechanism 464 is then immediately operated to bring the seal bars 470*a*, 470*b* into intimate contact with the lower portion 404, forming a bottom seal 474 on the film sleeve 400. Because the seal bars 470*a*, 470*b* contact the lower portion 404 essentially instantaneously after withdrawal of the film fingers 462*a*, 462*b* (FIG. 15B), the lower portion 404 remains relatively taut and thus amenable to seal formation. As a point of reference, the mandrel 150 continues to move along the path of travel T between the stages of FIGS. 15B and 15C (into the page of FIG. 15C), with the shuttle assembly 460 moving with the mandrel 150 in a synchronized fashion. Following formation of the bottom seal 474, the shuttle assembly 460 returns to an initial position for subsequent processing of a sequentially next mandrel 150/film sleeve 400. The lower portion 404, including the now-formed bottom seal 474, can be tucked into the carton sleeve 410 (not shown in FIG. 15C for ease of illustration) using any known technique.

Figure 16:
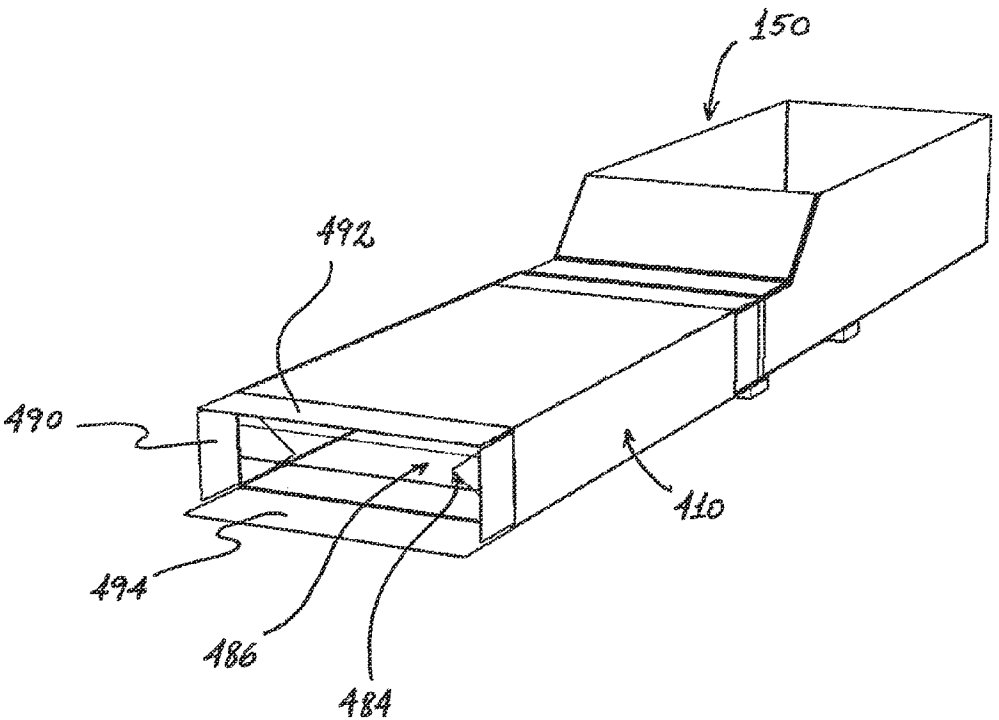
FIG. 16 is a perspective view of a mandrel, partial film package, and carton sleeve following processing by the film sealing module of FIG. 12.

Following processing by the film sealing module 308, a bottom seam 484 is formed as shown in FIG. 16. The bottom seam 484 serves as a closed end of a partial film package or bag 486. In other words, the film sealing module 308 operates to transition the film sleeve 400 (FIG. 12) to the partial film package 486 that is closed by the bottom seal 484 at one end thereof.

Figure 17:
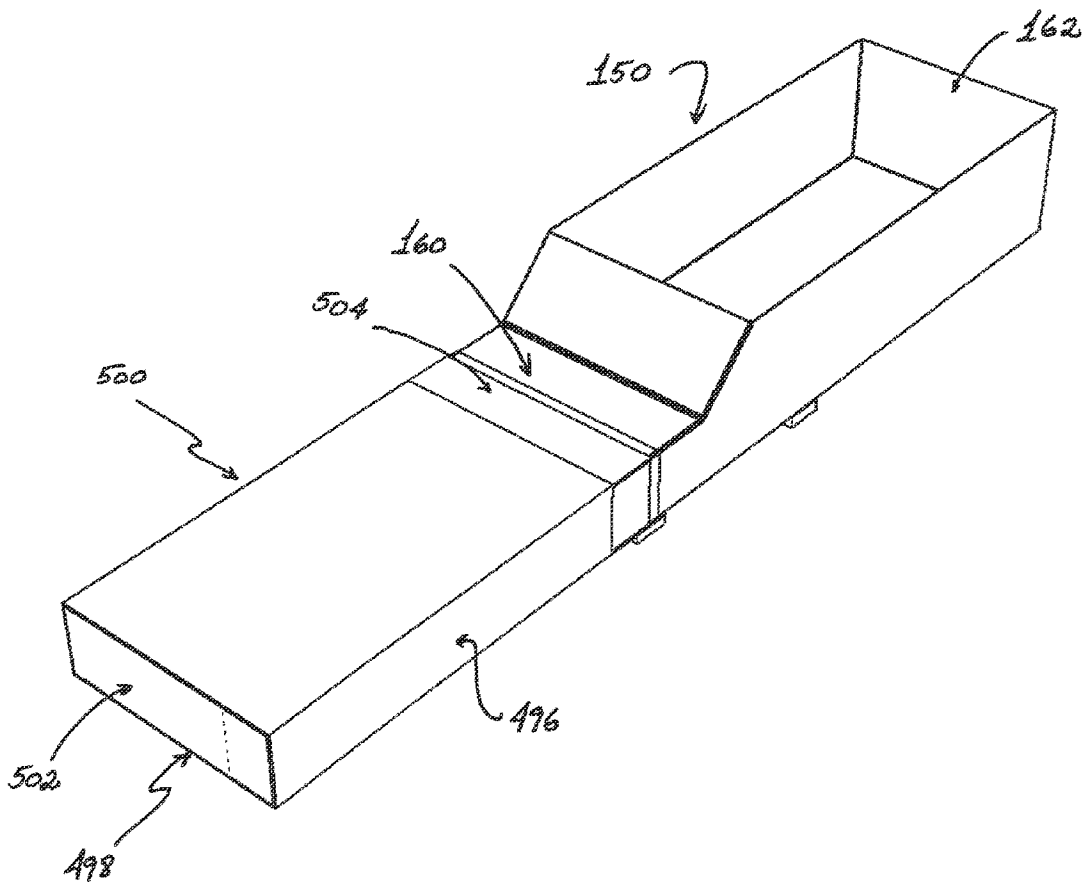
FIG. 17 is a perspective view of a mandrel and a partial package following processing by the partial package forming station of FIG. 1A.

Returning to FIG. 1A, the carton end completion module 310 can assume various forms conventionally employed by cartoner machines to close an end of a carton sleeve by tucking various flaps and applying glue. In general terms, and with additional reference to FIG. 16, the carton end completion module 310 incorporates various plow bars, folding mechanisms, and/or adhesive applying devices along the path of travel T that sequentially inwardly fold opposing minor flaps 490 of the carton sleeve 410. A first major flap 492 is then folded inwardly over the minor flaps 490. A second major flap 494 is similarly folded onto the first major flap 492. At one or more stages of the folding process, adhesive is applied to one or both of the major flaps 492, 494, such that upon folding of the second major flap 494, the flaps 492, 494 are adhered to one another. Following processing by the carton end completion module 310, then, the carton sleeve 410 is converted into a partial carton package 496, a bottom end 498 of which is closed as shown in FIG. 17.

Following processing by the partial package forming station 30, the mandrel 150 now carries a partial package. The partial package is identified generally at 500 in FIG. 17 and can be the partial film package or bag 486 (FIG. 16) disposed within the partial carton package 496, only the partial film package 486, or only the partial carton package 496. Reference to the "partial package 500" is inclusive of any of these configurations. The partial package 500 has a closed end 502 and an open end 504. The closed end 502 is closed relative to the package portion 160 of the mandrel 150, whereas the open end 504 is effectively open to the loading portion 162.

Product Loading Station 32

With additional reference to FIG. 1A, loading of the partial package 500 with product is performed at the product loading station 32 that can assume various forms and generally includes one or more hoppers 510 positioned to dispense product into the mandrel 150 of each of the mandrel apparatuses 24. A wide variety of different products can be processed/packaged in accordance with systems and methods of the present disclosure, and in some embodiments are particulate products such as ready-to-eat cereal (RTE) pieces having a variety of shapes, such as o-rings, spheres, rectangles, flakes, squares and any combination thereof. Other non-limiting examples of products envisioned by the present disclosure include uncooked past, dehydrated potatoes and snack products to name but a few, with the name products including bugle-shaped products, loosely packaged crackers (vs. a stacked array), potato chips, and the like. Further, the products processed and packaged by the systems and methods of the present disclosure can be densifiable, meaning that when present in a given volume, has void volume between adjacent particles that is reducible by at least 8% (e.g., the initial or freely settled void volume and final or tapped or packaged void volume has a delta of at least 8%) and without compaction or substantial reduction in the size of the particles (e.g., breakage). However, non-densifiable products (as defined above) can also be processed/packaged using the systems and methods of the present disclosure.

The hopper(s) 510 can be of a conventional type, adapted to gravity feed or release a known amount of product. As a point of reference, the mandrel apparatuses 24 are continuously moving along the path of travel T, such that the hopper 510 (or at least a dispensing end thereof) is, in some embodiments, configured to move in a synchronized fashion with the mandrel apparatuses 24.

Figure 18:
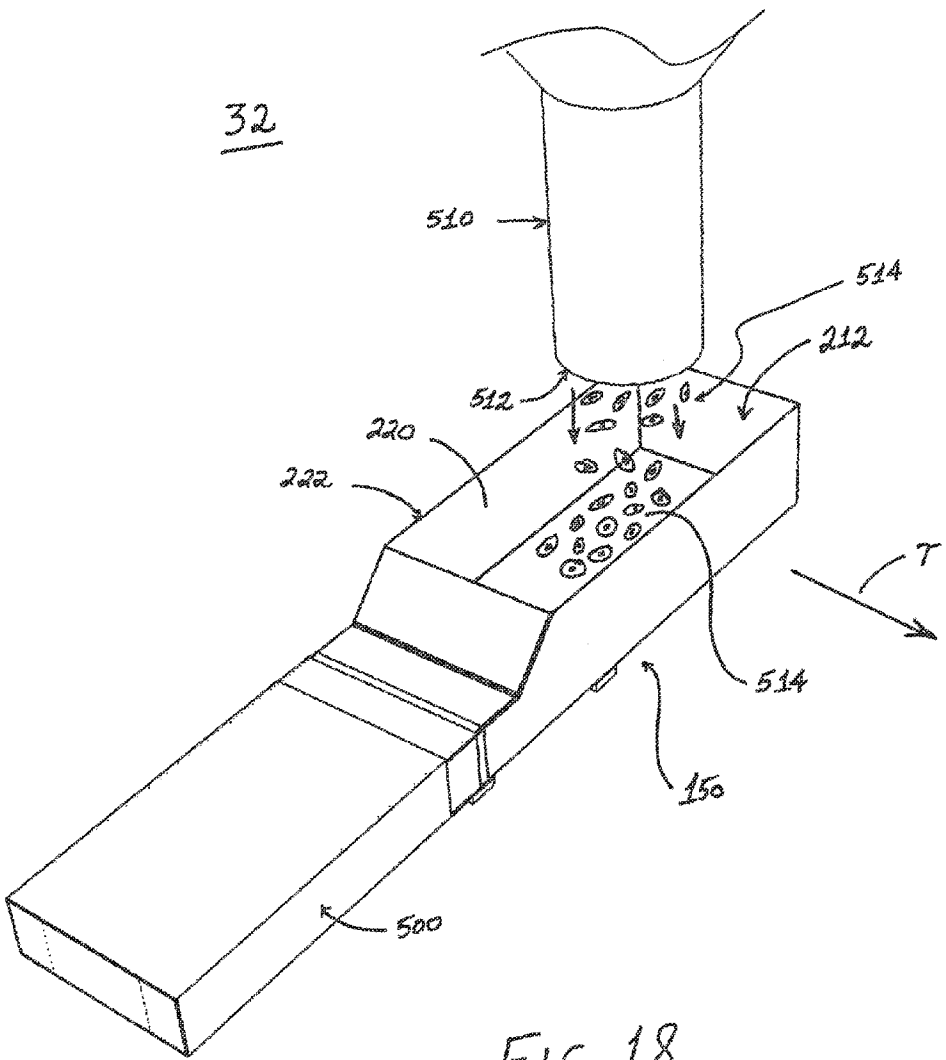
FIG. 18 is a perspective view of a mandrel at a product loading station provided with the system of FIG. 1A.

For reasons made clear below, the loading station 32 can include one or more sensors (not shown) associated with the hopper(s) 510 and configured to signal information indicative of the quantity and/or weight of product within the hopper(s) 510 and thus available for loading into partial packages. Also, the loading station 32 is, in some embodiments, configured to effectuate transitioning of the mandrel apparatus 24 between a horizontal orientation and a vertical orientation to effectuate product loading. For example, FIG. 18 illustrates, in simplified form, a relationship of the mandrel 150 relative to the hopper 510 as dictated by the loading station 32. The mandrel 150 is horizontally oriented (e.g., upon exiting the partial package forming station 30 (FIG. 1A)), traveling along the path of travel T. A dispensing end 512 of the hopper 510 is aligned with the loading region 212 of the mandrel 150. Product 514 dispensed from the hopper 510 falls through the opening 222 of the loading region 212 and into the trough 220. At the stage of FIG. 18, then, the partial package 500 and the dispensed product 514 are both retained by the mandrel 150, but the product 514 is not yet delivered into the partial package 500.

Figure 19A:
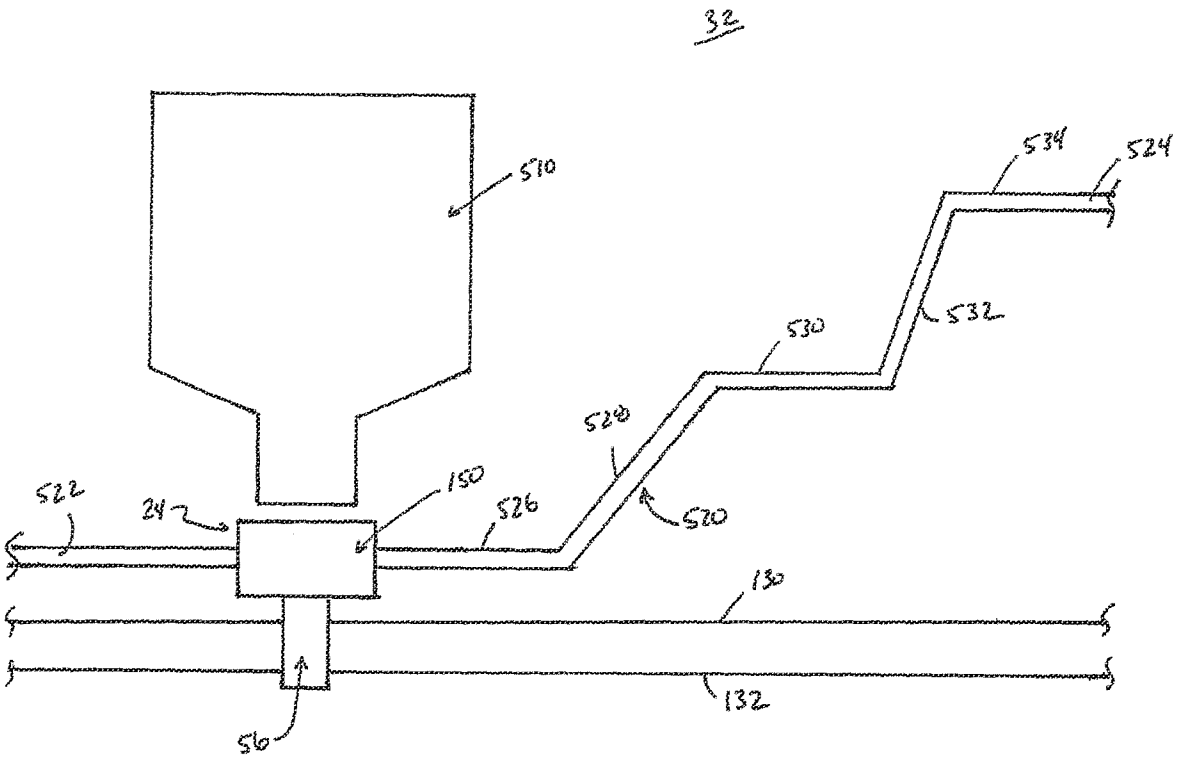
FIG. 19A is a simplified schematic diagram of the loading station of FIG. 1A.

With the above conventions in mind, the loading station 32 can include one or more transition tracks (not shown in FIG. 18) that effectuate transitioning or pivoting of the mandrel 150 from the horizontal orientation. FIG. 19A schematically illustrates the loading station 32 as including a transition track 520 extending between an entrance end 522 and an exit end 524. The transition track 520 is sized to receive the tilt control bearing 262 (hidden in FIG. 19A, but shown, for example, in FIG. 4) of the mandrel apparatus 24, presenting a cam-like interface that effectuates transitioning of the mandrel 150 from the horizontal orientation (at the leading end 522) to a vertical orientation (and the trailing end 524) as the carriage assembly 56 moves along the path of travel T. As a point of reference, FIG. 19A further illustrates the conveyor assembly carriage rails 130, 132 that guide movement and control elevation of the carriage assembly 56.

The transition track 520 includes first-fifth segments 526-534. The first segment 526 extends horizontally from the entrance end 522. The second segment 528 extends in an angularly upward fashion from the first segment 526 to the third segment 530. The third segment 530 extends substantially horizontal between the second and fourth segments 528, 532. The fourth segment 532 extends in an upwardly angled fashion from the third segment 530 to the fifth segment 534. Finally, the fifth segment 534 extends horizontally to the exit end 524. With this configuration, the transition track 520 effectuates incremental transitioning of the mandrel 150 from horizontal to vertical, including a short dwell period in which the mandrel 150 is maintained at an orientation between horizontal and vertical (via the third segment 530).

Though not reflected by the plan view of FIG. 19A, the transition track 520 can have a horizontal component or vector in addition to the vertical component described above to accommodate changes in a lateral distance between the tilt control bearing 262 (FIG. 4) and the carriage assembly 56 with pivoting of the mandrel 150. For example, FIG. 19B illustrates, in simplified form, a relationship of the mandrel 150 relative to the transition track 520 as the tilt control bearing 262 is engaged along the first segment 526. As shown, the mandrel 150 is horizontally oriented, with a lateral spacing $S_1$ established between the tilt control bearing 262 and the carriage assembly 56 (via the transition track 520 and the carriage rails 130, 132). With continued movement of the mandrel apparatus 24 along the path of travel T (out of the page of FIG. 19B), the cammed interface between the tilt control bearing 262 and the second segment 528 of the transition track 520 causes the mandrel 150 to pivot from the horizontal orientation (of FIG. 19B) toward a more vertical orientation as shown in FIG. 19C. Commensurate with this pivoting motion, a smaller lateral distance $S_2$ is established between the tilt control bearing 262 and the carriage assembly 56 (via the transition track 520 and the carriage rails 130, 132). In the partial transition state of FIG. 19C, the mandrel 150 is not truly vertical. As the tilt control bearing 262 moves along the third segment 530 (FIG. 19A) of the transition track 520, the mandrel 150 is held or maintained in this intermediate orientation (i.e., at an angle between horizontal and vertical). With pivoting of the mandrel 150 from the horizontal orientation (FIG. 19B), the product 514 flows from the loading region 212, through the funneling region 210, and into the package portion 160. By temporarily maintaining or holding the mandrel 150 in the mid-angle orientation of FIG. 19C (the holding period being a function of a length of the third segment 530 and the speed of the conveyor assembly drive motor), a more controlled flow rate of the product 514 through the funneling region 210 is promoted, thereby reducing the possibility of product bridging.

Figure 19E:
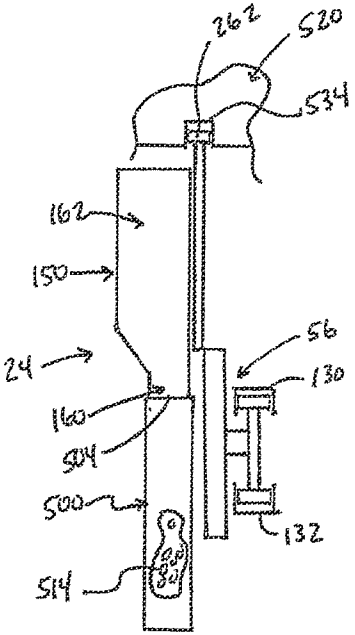
FIGS. 19B-19E are simplified schematic diagrams showing processing of a mandrel carrying a partial package through the product loading station of FIG. 1A.
Figure 19C:
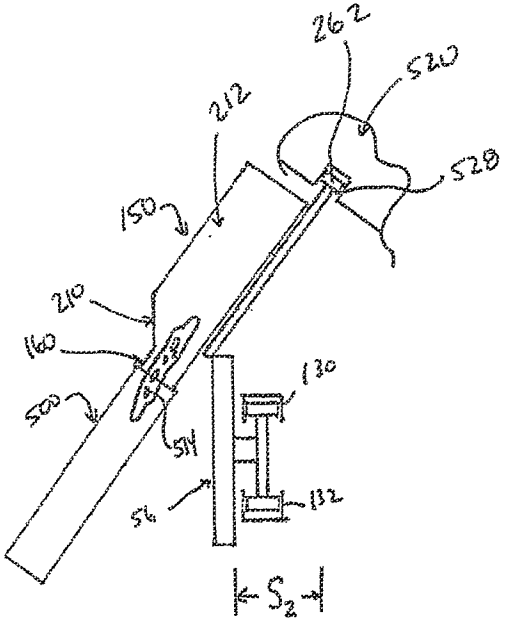
Figure 19B:
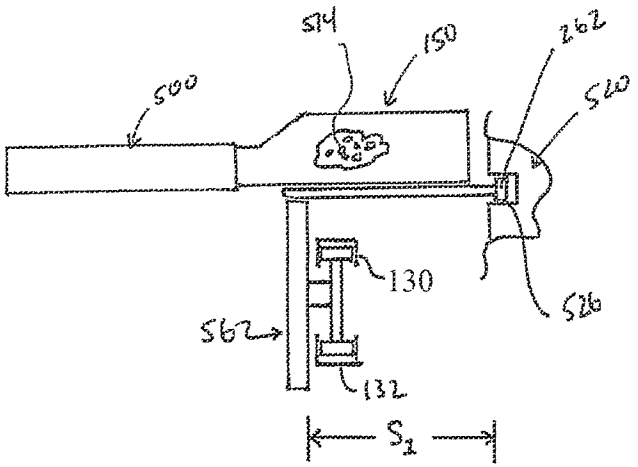
Figure 19D:
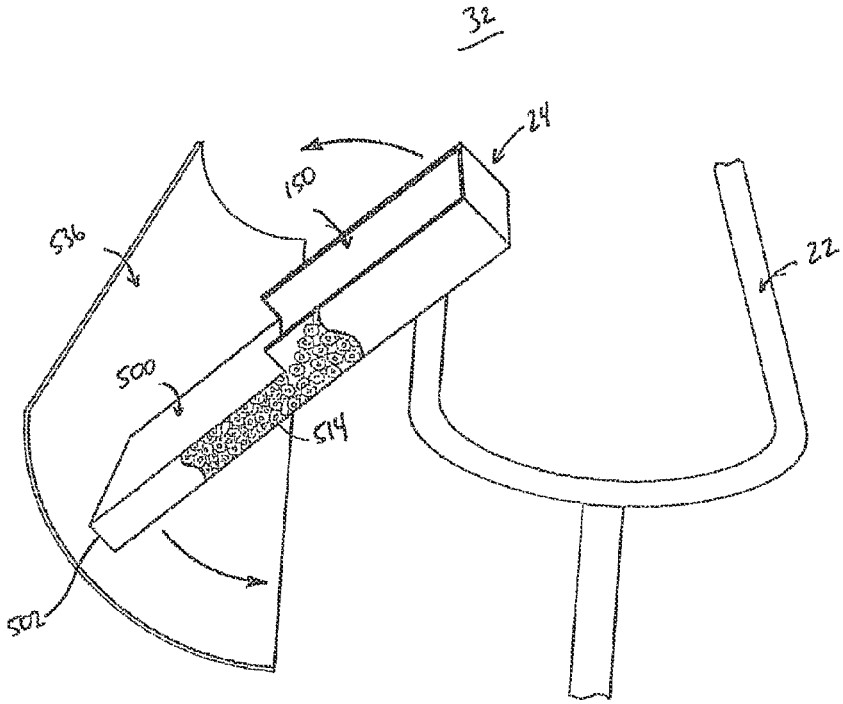

As shown in FIG. 19D, the loading station 32 can further include a lower rail 536 located and oriented relative to the conveyor assembly 22, and thus relative to the mandrel 150 (drawn generally in FIG. 19D), so as to prevent inadvertent separation of the partial package 500 from the mandrel 150 as the mandrel 150 transitions from the horizontal orientation to the vertical orientation. The lower rail 536 is located and curved to slidably receive the closed end 502 of the partial package 500. Further, the lower rail 536 can assist with transitioning of the mandrel orientation as the mandrel apparatus 24 moves along the transition track 520 (not shown in FIG. 19D). In other embodiments, the lower rail 536 can be omitted.

In the view of FIG. 19E, the mandrel apparatus 24 has moved further along the path of travel T (out of the page of FIG. 19E), with the tilt control bearing 262 now located along the fifth segment 534 of the transition track 520. As a result, the mandrel 150 has been further pivoted relative to the carriage assembly 56 and is now vertically (or nearly vertically) oriented via a relationship between the transition track 520 and the carriage tracks 130, 132. Due to the effects of gravity, the product 514 has flowed completely from the loading portion 162 of the mandrel 150 and into the package portion 160. The gravity-induced feeding or loading of the package portion 160 may locate an entirety of a volume of the product 514 below the open end 504 of the partial package 500. Alternatively, and as described in greater detail below, a volume of the product 514 within the package portion 160 may be greater than an internal volume of the partial package 500 immediately following processing by the product loading station 34 such that with the mandrel 150 in the vertical orientation, a level of the transferred product 514 is "above" the open end 504 of the partial package 500.

Product Compacting Station 34/Separation Station 36

Figure 20:
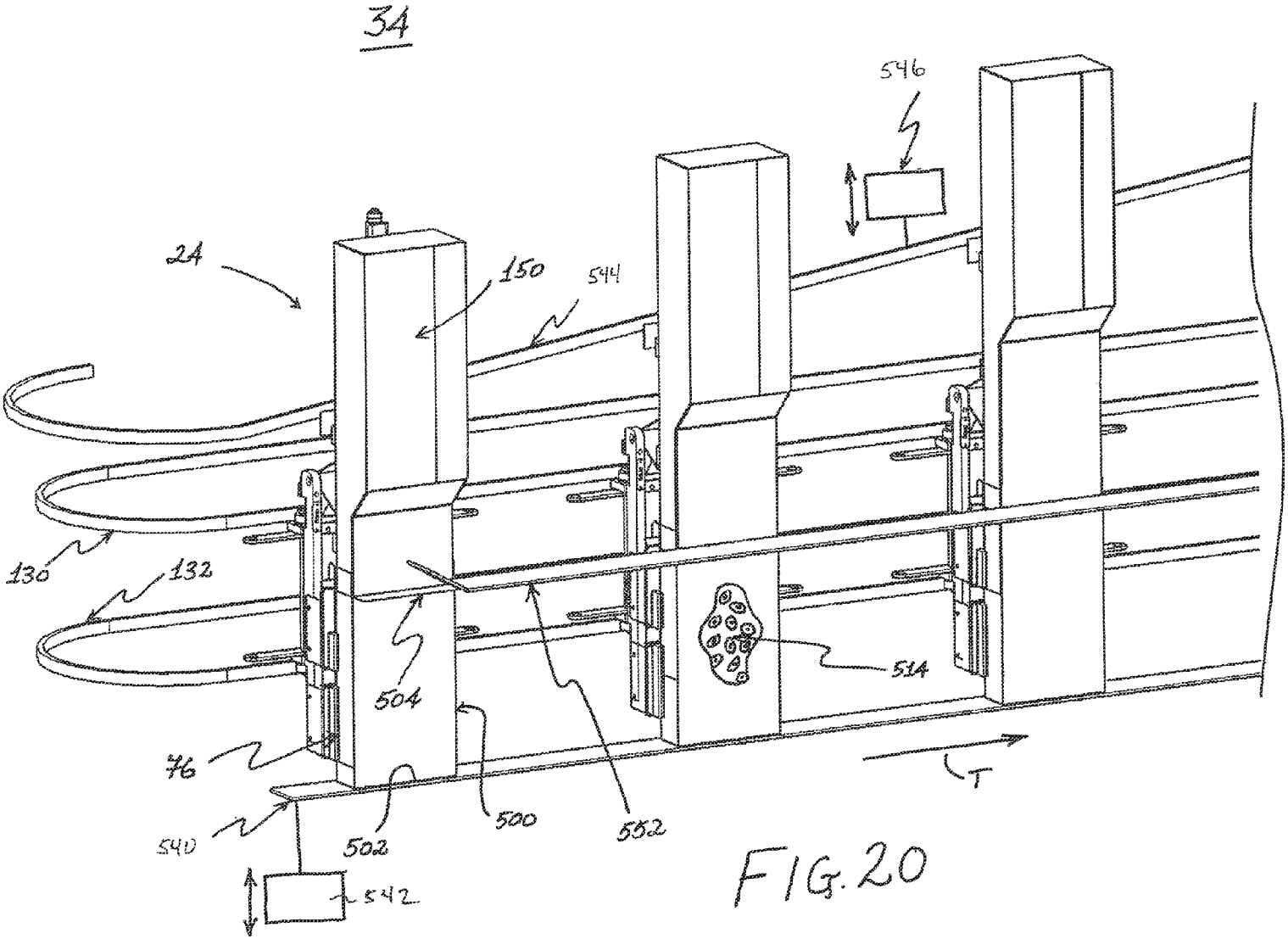
FIG. 20 is a simplified perspective view of a combined compacting station and separation station useful with the system of FIG. 1A.

Returning to FIG. 1A, the optional product compacting station 34 is configured to densify the product 514 (FIG. 19E) within the package portion 160 (FIG. 19E) via vibration. In some embodiments, the compacting station 34 is combined with the package/mandrel separation station 36 that otherwise operates to separate the mandrel 150 from the corresponding partial package 500 (FIG. 19E). For example, FIG. 20 depicts one embodiment of a combination product compacting station 34/separation station 36 as including a lower deck 540 positioned to slidably receive the closed end 502 of the partial package 500 as the corresponding carriage assembly 56 moves along the path of travel T (via the carriage rails 130, 132). For ease of explanation, only a few of the carriage assembly 56/mandrel apparatus 24 pairings are illustrated in FIG. 20, it being recalled that immediately adjacent ones of the carriage assemblies 56 are directly linked to one another to establish the drive chain 50 (FIG. 1B). A motorized vibration mechanism 542 subjects the deck 540 a constant vibrational force (e.g., a vertically oscillating or reciprocating movement). A mandrel track 544 is optionally also provided, and interfaces with the mandrel apparatuses 24 as described below. In this regard, with embodiments in which the compacting station 34 and the separation station 36 are combined, the mandrel track 544 is included to effectuate mandrel/partial package separation as described below. Conversely, with constructions in which the compacting station 34 and the separation station 36 are discrete from one another (e.g., the compacting station 34 is "upstream" of the separation station 36 relative to the path of travel T), the mandrel track 544 may only be present at the separation station 36. In the interest of clarity, then, the combined compacting station 34/separation station 36 are described first with respect to features of the compacting station 34 followed by features of the separation station 36, it being understood that these features can be combined into a single "station" or can be incorporated as separate stations.

With the above understanding in mind, the compacting station 34 is configured such that as the mandrel 150 moves along the path of travel T, the bottom end 502 of the partial package 500 vibrates via contact with the deck 540, as does any of the product 514 residing within the mandrel 150/partial package 500. The vibrational forces generated by the deck 540 (via the motorized vibration mechanism 542) cause the product 514 to densify within the mandrel 150/partial package 500. To possibly optimize densification or settling of the product 514, the frequency (e.g., strokes per minute) and/or amplitude (e.g., vertical travel of each stroke) of the applied vibrational force can be varied as a function of the physical characteristics of the product 514, the partial package 500, or both. In other embodiments, the compacting station 34 can further include the mandrel track 544 as a rail caused to vibrate by a motorized vibration mechanism 546) in contact with the mandrel apparatus 24 along the path of travel T through the compacting station 34 (or throughout the combined stations 34/36), with the vibrating rail 544 thus applying an additional vibrational force on to the mandrel 150/partial package 500.

In some embodiments, the product compacting station 34 further includes a guide flight 552 that interfaces with the open end 504 of the partial package 500 (e.g., the guide flight 552 contacts an upper flap of the open end 504) so as to prevent the partial package 500 from lifting relative to the mandrel 150 with induced vibration.

Figure 21A:
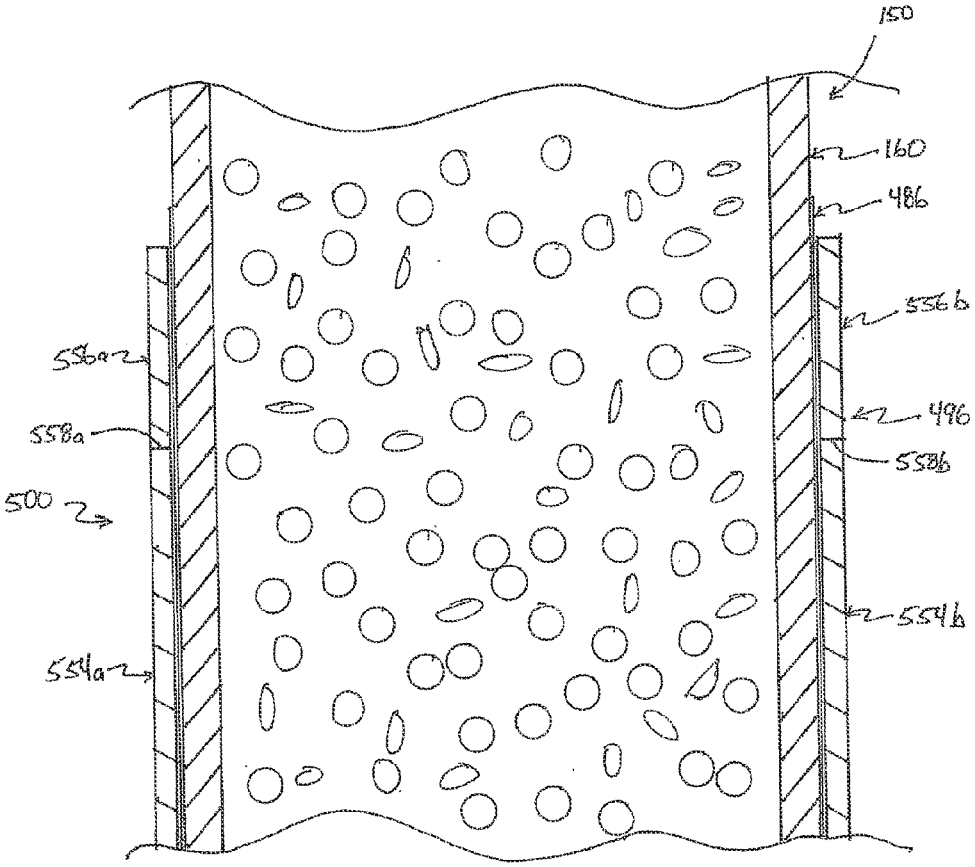
FIGS. 21A-21E are simplified cross-sectional views illustrating optional features of the combined compacting station and/or separation station of FIG. 20 in interfacing with a partial package/mandrel.

For example, FIG. 21A illustrates a segment of an optional construction of the partial package 500 formed about the package portion 160 of the mandrel 150. The partial package 500 includes the partial film package 486 formed over the mandrel 150, and the partial carton package 496 formed over the partial film package 486. The partial carton package 496 includes opposing major panels 554*a*, 554*b*. A flap 556*a*, 556*b* is connected to, and extends from, a corresponding one of the panels 554*a*, 554*b*, with the combination panel/flap 554*a*/556*a*, 554*b*/556*b* being joined at a score line 558*a*, 558*b*, respectively. Immediately prior to processing at the product compacting station 34 (FIG. 20), the flaps 556*a*, 556*b* can extend in a substantially parallel fashion relative to the corresponding panel 554*a*, 554*b*.

With the above conventions in mind, the product compacting station 34 (FIG. 20) can incorporate various structures that interact with the partial package 500 in a sequential fashion as the mandrel 150 progresses along the path of travel T (out of the page of FIG. 21A). For example, FIG. 21B illustrates the partial package 500 initially interfaces with a spring loaded rail 560 provided with the product compacting station 34. The spring loaded rail 560 is arranged to contact the first major panel 554*a* and squeeze the partial package 500 against the mandrel 150 with enough force so that any bow in the panel 554*a* is removed and the panel 554*a* is positioned flatly against the mandrel 150, but not with so much force as to damage or mar the partial carton 500. An upper edge 561 of the spring loaded rail 560 is positioned immediately vertically below the score line 558*a* to facilitate folding of the flap 556*a* relative to the panel 554*a* along the score line 558*a*.

Figure 21C:
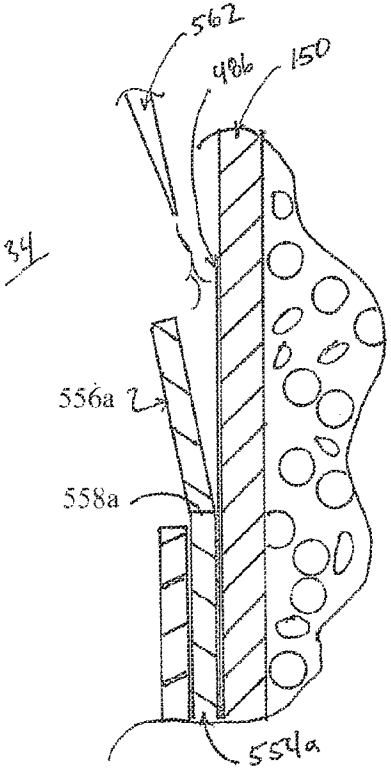
Figure 21B:
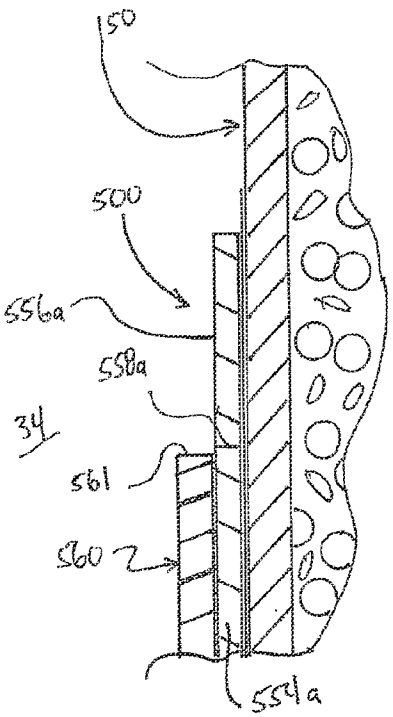

A stream of air is next directed at an interface between the flap 556*a* and the mandrel 150 by an air nozzle 562 component of the product compacting station 34 as shown in FIG. 21C. The stream of air flows down a face of the mandrel 150 until it contacts the flap 556*a*, causing the flap 556*a* to pivot or fold (relative to the panel 554*a*) away from the mandrel 150. The partial film bag 486 may also move slightly away from the mandrel 150 in response to the stream of air.

Figure 21E:
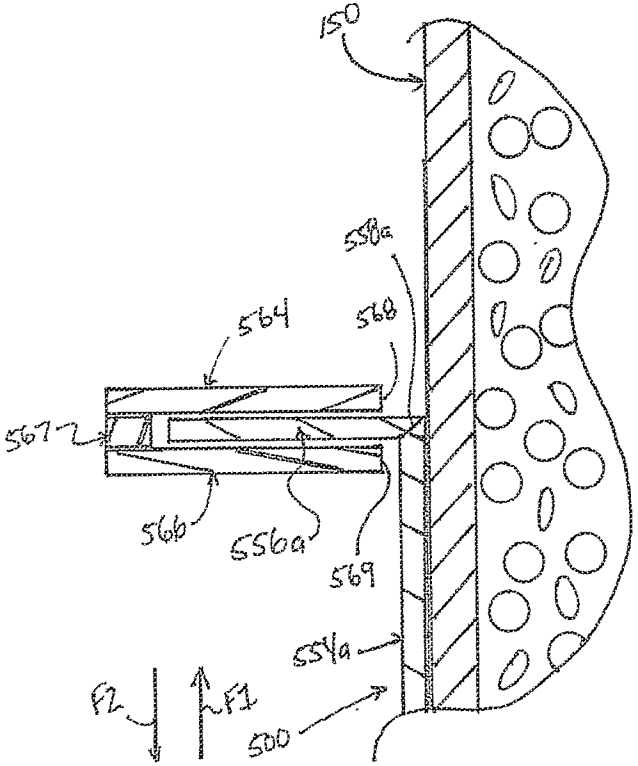
Figure 21D:
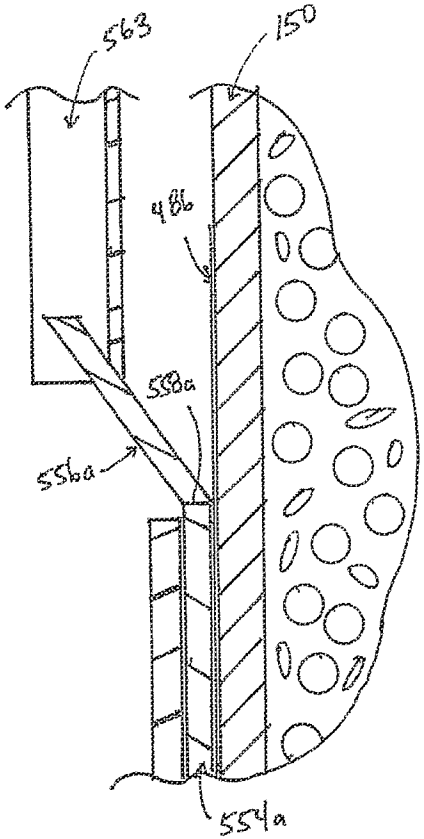

A spacing between the flap 556*a* and the mandrel 150 (caused by the stream of air) is sufficiently size for insertion of a twist plow 563 component of the product compacting station 34 as depicted in FIG. 21D. As shown, even if the partial film bag 486 has also displaced slightly from the mandrel 150, a height of the twist plow 563 is "below" a point of contact of the twist plow 563 relative to the flap 556*a*. Though not evident in the view of FIG. 21D, the twist plow 563 presents a spatially curved surface along the path of travel T (out of the page of FIG. 21D), and serves to sequentially fold the flap 556*a* relative to the panel 554*a* along the fold line 558*a*, guiding the flap 556*a* toward a more perpendicular orientation or extension relative to the panel 554*a* as the mandrel 150 continues moving along the path of travel T.

With the flap 556*a* now folded away from the panel 554*a* (e.g., perpendicular or nearly perpendicular), the product compacting station 34 guides the flap 556*a* between upper and lower trap plates 564, 566 as shown in FIG. 21E with continued movement of the mandrel 150 along the path of travel (out of the page of FIG. 21E). The upper and lower trap plates 564, 566 can be mounted to a spacer plate 567. The spacer plate 567 has a thickness slightly greater than a thickness of the flap 556*a* to ensure that flap 556*a* readily slides between the trap plates 564, 566, but is located so as to not contact the flap 556*a*. An inward most edge 568, 569 of the trap plates 564, 566, respectively, is maintained at a small distance from the mandrel 150 (e.g., on the order of 0.125 inch). This small distance allows the flap 556*a* to flex upward without damage as the partial package 500 is driven upward by a vibration mechanism (e.g., the vibrating deck 540 (FIG. 20)) and yet provide enough downward force on the partial package 500 to push the partial package 500 down when the vibration force direction moves downwardly. Thus, when the partial package 500 moves upwardly in response to an upward component of the vibrational force (F1 in FIG. 21E), the flap 556*a* remains captured between the trap plates 564, 566, flexing at the score line 558*a*; effectively, a significant surface area of the flap 556*a* comes into contact with the upper trap plate 564. When the vibrational force subsequently transitions to a downward component (F2 in FIG. 21E), the flap 556*a* self-flexes back toward the "normal" condition, driving the partial package 500 downwardly. As a result of this downward movement caused by flexing of the flap 556*a*, the partial package 500 is returned to the proper position for receiving the sequentially next upward vibration force. Stated otherwise, and with additional reference to FIG. 20, the vertical oscillating vibration of the deck 540 and/or the track 544 can include upward and downward movements (F1 and F2). The upward movement F1 acts on the closed end 502 of the partial carton 500, driving the partial carton 500 upwardly. During the downward movement F2, the captured, flexing flap 556*a* effectively keeps the closed end 502 in contact with the deck 540 so that when the deck 540 makes its next upward movement F1, this upward movement F1 is again directly applied to the closed end 502.

While the compacting station 34 has been described above as optionally interfacing with one of the flaps 556*a*, in other embodiment, additional ones of the flaps (e.g., the flap 556*b*) can be similarly acted upon. Further the flap(s) 556*a*, 556*b* can be held at angles other than perpendicular (relative to the corresponding panel 554*a*, 554*b*). Even further, the flaps(s) 556*a*, 556*b* can be maintained vertical (or nearly vertical), with the capture force being applied to an edge of the flap 556*a*, 556*b*. In more general terms, then, some embodiments of the present disclosure optionally configure the product compacting station 34 to interface with the partial package 500 while applying a vibrational force such that the controlled portion of the partial package 500 acts like a spring, absorbing the vibrators upward movement energy and using the absorbed energy to drive the partial package 500 into place when the vibrator retracts. In other embodiments, however, the above-described control features can be omitted. Returning to FIG. 20, the separation station 36 is configured to separate the mandrel 150 from the partial package 500, and can have various forms. For example, the partial package 500 can be pulled or otherwise permitted to fall from the mandrel 150. Alternatively, and as shown in FIG. 20, the separation station 36 (or combined compacting station 34/separation station 36) can include the transport deck 540 and the mandrel track 544. The mandrel track 544 is configured to interface with the lift roller 256 (generally hidden in FIG. 20, but shown, for example, in FIGS. 8A and 8B) of the mandrel apparatus 24. Relative to the path of travel T, the mandrel track 544 extends at a vertically upward angle relative to horizontal. In particular, the mandrel track 544 has a vertically upward component or vector relative to the carriage rails 130, 132 that otherwise spatially retain the carriage assemblies 56 at a constant elevation. Further, in some embodiments, the vibration mechanism 546 is connected to the mandrel track 544. Finally, the transport deck 540 extends along the path of travel T and is positioned to slidably support the bottom end 502 of the partial package 500.

Figure 22A:
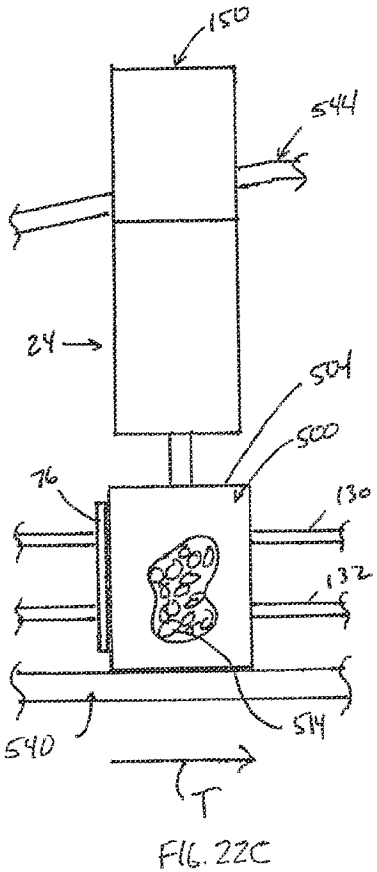
FIGS. 22A-22C are simplified schematic diagrams showing operation of the separation station of FIG. 20 in separating a mandrel from a partial package.
Figure 22B:
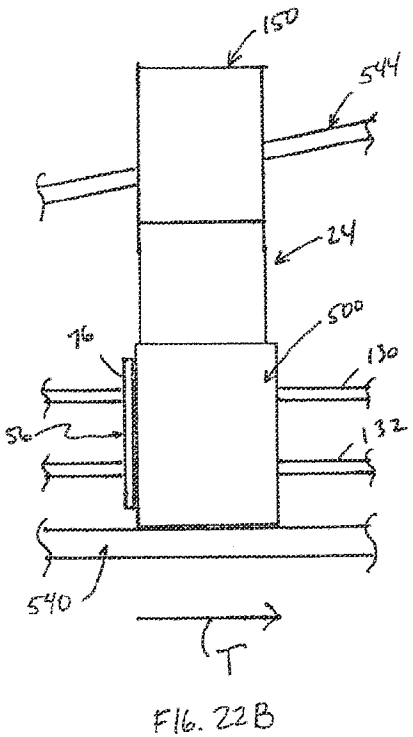
Figure 22C:
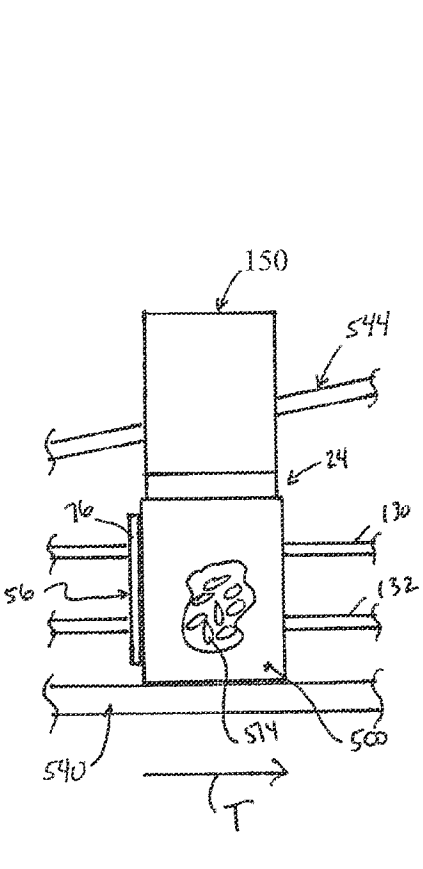

With additional reference to FIGS. 22A-22C, as the mandrel apparatus 24 continuously moves along the path of travel T (via movement of the carriage assembly 56), engagement between the mandrel track 544 and the lift roller 256 (FIG. 8A) causes the mandrel 150 to lift vertically as described above, away from the transport deck 540 and optionally by the trap plates 564, 566 (FIG. 21E) as described above. The partial package 500 remains supported by the deck 540. In some embodiments, the deck 540 continuously vibrates the partial package 500 as described above. Further, vibration of the mandrel track 544 by the vibration mechanism 546 is transferred onto the mandrel 150 so as to prevent frictional "sticking" between the mandrel 150 and the partial package 500 as the mandrel 150 is vertically raised. The so-applied vibration also assists in further densifying the product 514 within the mandrel 150/partial package 500. Thus, while forward movement of the mandrel apparatus 24 along the path of travel T is continuously imparted onto the corresponding partial package 500 via the mandrel 150, the mandrel 150 incrementally lifts out of the partial package 500, resulting in complete separation of the mandrel 150 from the partial package 500 as shown in FIG. 22C. In this regard, the guide bar 76 provided with the carriage assembly 56 maintains a pushing force onto the partial package 500 as the mandrel 150 is withdrawn, ensuring that the partial package 500 continues to move along the path of travel T. As a point of reference, the product 514 remains within the partial package 500 with separation of the mandrel 150, and is densified.

Optional densification of the product 514 via the product compacting station 34 and/or the separation station 36 serves to reduce a volume of the product 514 from the point in time immediately following loading into the mandrel 150 to the point in time of mandrel 150/partial package 500 separation. As a point of reference, FIG. 23A depicts a portion of the mandrel 150/partial package 500 immediately following transferring of the product 514 into the package portion 160 at the product loading station 32 (FIG. 19A). As shown, the loaded product 514 has flowed into contact with the closed end 502 of the partial package 500, and in the vertical orientation of the mandrel 150 occupies a volume of the package portion 160 that can be greater than an internal volume of the partial package 500. In other words, in the stage of manufacture of FIG. 23A, the transferred product 514 establishes a fill line 574 relative to the vertical mandrel 150/package portion 160, with this fill line 574 being in close proximity (and perhaps even "above") the open end 504 of the partial package 500. In the state of FIG. 23A, then, were the mandrel 150 to be removed from the partial package 500 and an attempt made to close the open end 504, the transferred product 514 would undesirably impede or prevent sufficient closure. For example, where the partial package 500 is or includes the partial film package 486, the open end of the partial film package 486 is closed by sealing opposing sides of film to each other; to the extent the transferred product 514 extended to or was otherwise present within this intended zone of sealing, a sufficient seal likely could not be achieved. Similarly, where the partial package 500 is or includes the partial carton package 496 (e.g., in which the open end thereof is effectively defined at the score line 558 between the panels 554 and corresponding flaps 556), the undensified product 514 would prevent or impede acceptable folding and closing of the flaps 556. In fact, in the state of FIG. 23A, the fill line 574 of the transferred product 514 could be at such a level that were the mandrel 150 removed from the partial package 500, the transferred product 514 might even overflow from the internal volume of the partial package 500.

Figure 23B:
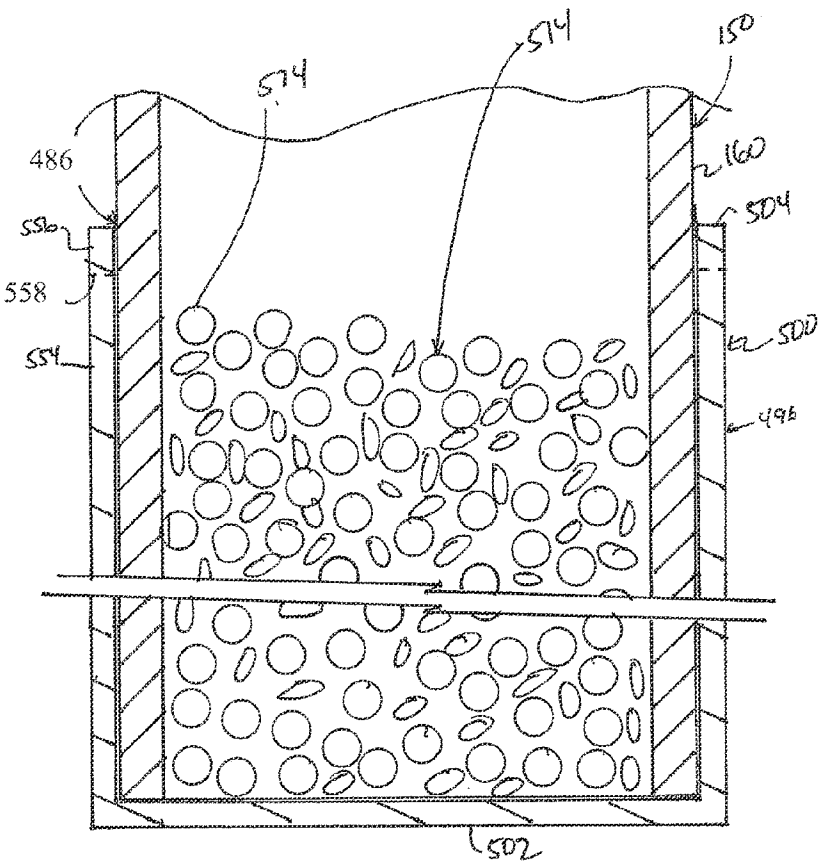
FIG. 23B is a simplified cross-sectional view of the partial package/mandrel of FIG. 23A following an intermediate stage of processing by the separation station of FIG. 20.
Figure 23A:
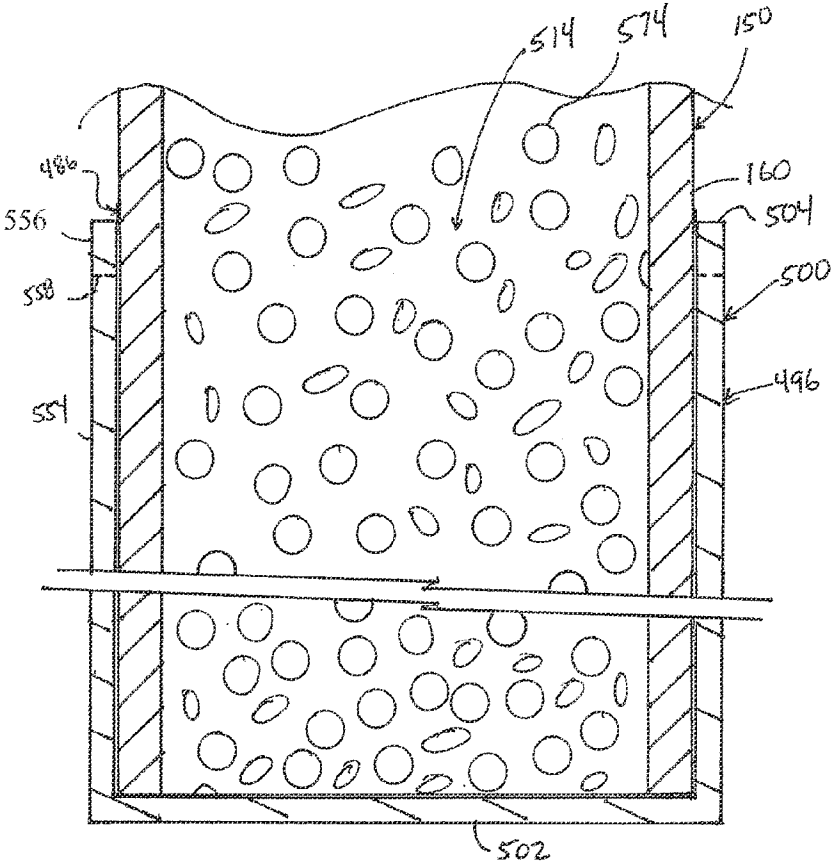
FIG. 23A is a simplified cross-sectional view of a portion of a partial package/mandrel immediately following processing by the loading station of FIG. 19A.

FIG. 23B depicts the same portion of the mandrel 150/partial package 500 after processing by the compacting station 34 and/or the separation station 36 at a point in time immediately prior to complete separation of the mandrel 150 from the partial package 500. As shown, the product 514 has densified, such that the volume of the product 514 is less than the internal volume of the partial package 500. The fill line 574 of the densified product 514 is "below" the open end 504 of the partial package 500 a sufficient amount so as to permit desired, subsequent closure of the open end 504. As a result, with subsequent complete removal of the mandrel 150 from the partial package 500, an entirety of the product 514 remains within the partial package 500, and the product 514 will not impede necessary closure of the open end 504 (e.g., sealing of the partial film package 486 and/or folding and closure of the flaps 556 of the partial carton package 496). By densifying the product 514 within the partial package 500 and prior to complete closure of the partial package 500, systems and methods of the present disclosure thus facilitate use of a smaller package (as compared to conventional techniques in which product densification is not performed between the stages of loading and closing the partial package 500), thereby reducing overall packaging material requirements and attendant costs.

Package Completion Station 38

With additional reference to FIG. 1A, the package completion station 38 is located off-line of the path of travel T, and is configured to close the open end 504 of the partial package 500. For example, the package completion station 38 of FIG. 1A can include a grabbing-type conveyor 580 (referenced generally) that removes the loaded partial package 500 from the path of travel T, and subjects the partial package 500 to various processes that effectuate sealed closure of the partial film package or bag 486 (FIG. 16), partial carton package 496 (FIG. 17), or both via conventional techniques. As a point of reference, with embodiments in which the system 20 includes the separation station 36 as described above, the mandrels 150 are vertically lowered following completion of the separation operation and prior to delivery (along the path of travel T) to the partial package forming station 30.

Methods of Automated Package Formation and Loading

Figure 24:
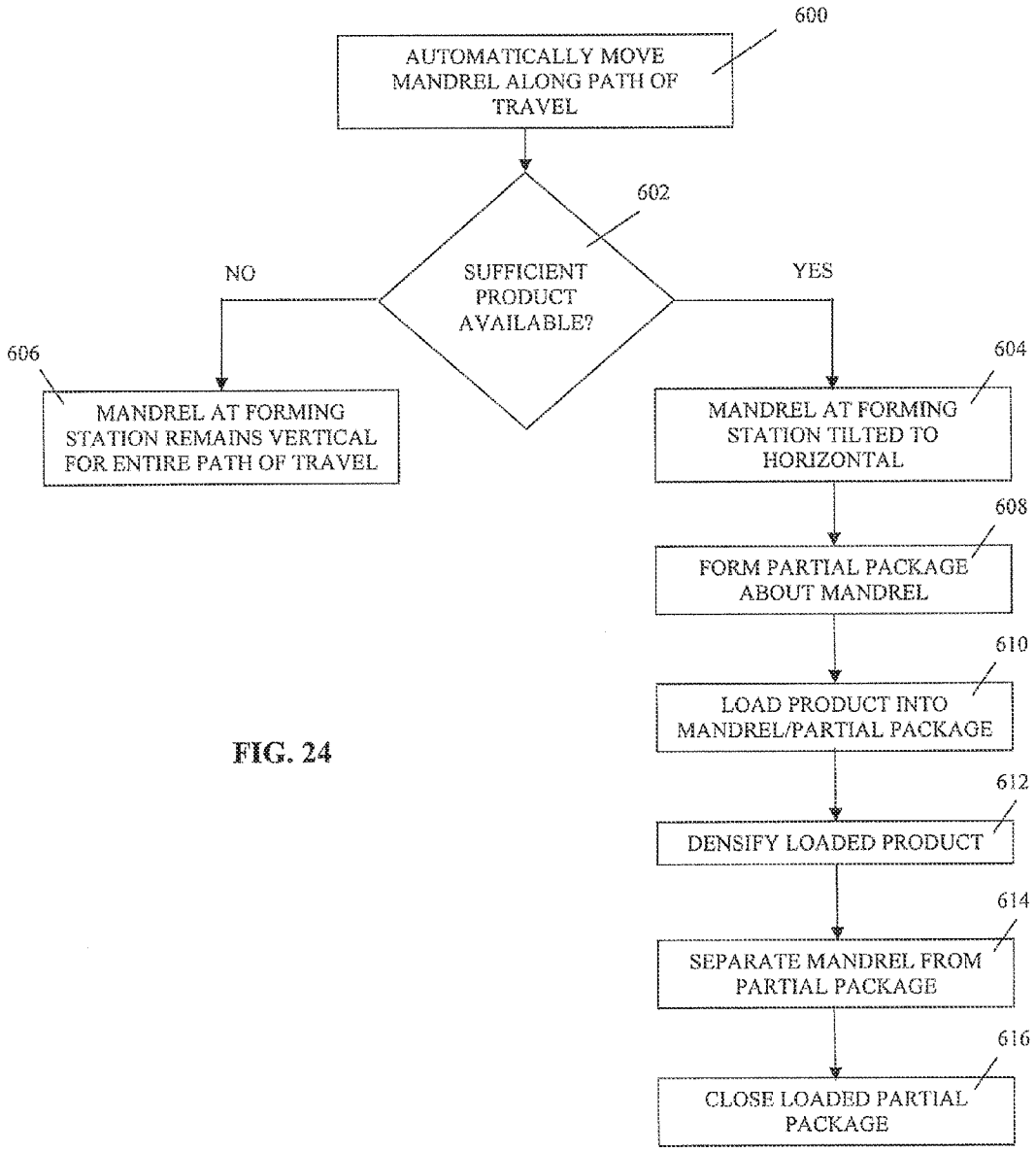
FIG. 24 is a flow diagram of a method for forming and loading a packaged good article in accordance with principles of the present disclosure.

With additional reference to the flow diagram of FIG. 24, one method of automatically forming and loading a package with the system 20 begins at 600 at which the conveyor assembly 22 is operated to continuously move the mandrel apparatuses 24 about the path of travel T. At 602, a determination is made as to whether a sufficient amount of the product 514 is available in the product loading station 32. In this regard, "sufficient quantity" is in reference to whether or not enough product is currently stored in the hopper 510 to fill a single package with a desired quantity (or weight). For example, the product loading station 32 can include one or more sensors (e.g., a scale, a level sensor, etc.) calibrated to generate information indicative of the available quantity of product.

If a sufficient quantity of product is available ("yes" at step 602), a computerized controller (not shown) of the system 20 operates to cause the mandrel 150 of the sequentially next mandrel apparatus 24 (relative to the partial package forming station 30) to transition from a vertical orientation to a horizontal orientation at 604.

As a point of reference, following processing at the separation station 36 and immediately prior to presentation to the partial package forming station 30, the mandrel 150 will be in a vertical orientation. Transitioning of the sequentially next mandrel 150 to the horizontal orientation at the partial package forming station 30 can be effectuated in various manners as described above. For example, and with additional reference to FIGS. 25A and 25B, the system 20 can include a transitional flight assembly 700 adjacent (immediately upstream of) the partial package forming station 30 (identified generally in FIG. 25A). The flight assembly 700 includes or forms a tilt guide track 702 and a bypass rail 704 each configured to interface with the tilt control bearing 262 of the mandrel apparatus 24 as described above with respect to FIGS. 8C and 8D. An articulating gate 706 selectively opens and closes the tilt guide track 702 and the bypass rail 704 relative to a lead-in rail 708. The gate 706 can be controlled in a variety of fashions (e.g., a servo actuator), and serves to direct an incoming mandrel 150 from the lead-in rail 708 to either the tilt guide track 702 or the bypass rail 704.

Figure 25A:
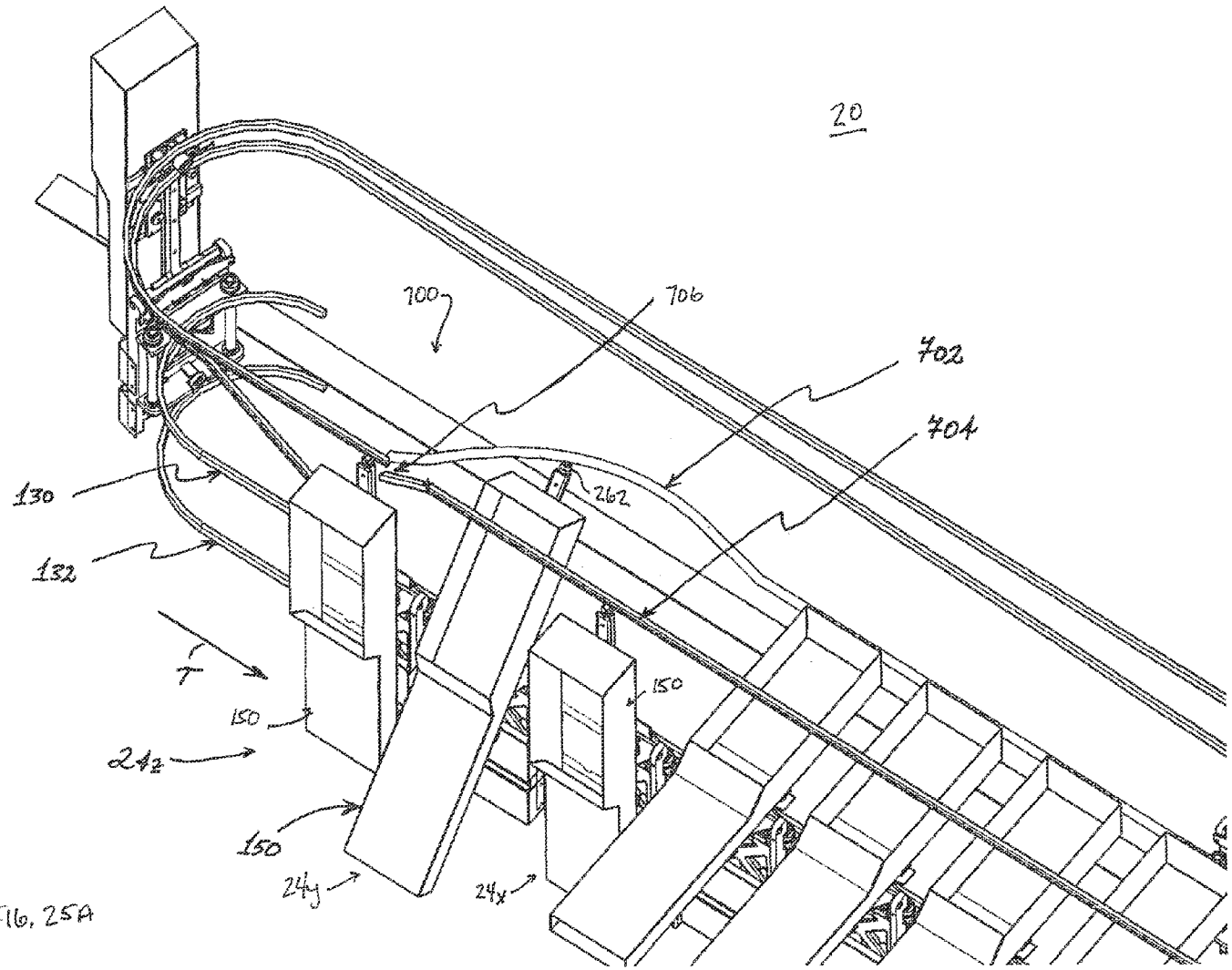
FIG. 25A is a simplified perspective view of a transitional flight assembly useful with the system of FIGS. 1A and 1B in controlling delivery of mandrels to the partial package forming station.
Figure 25B:
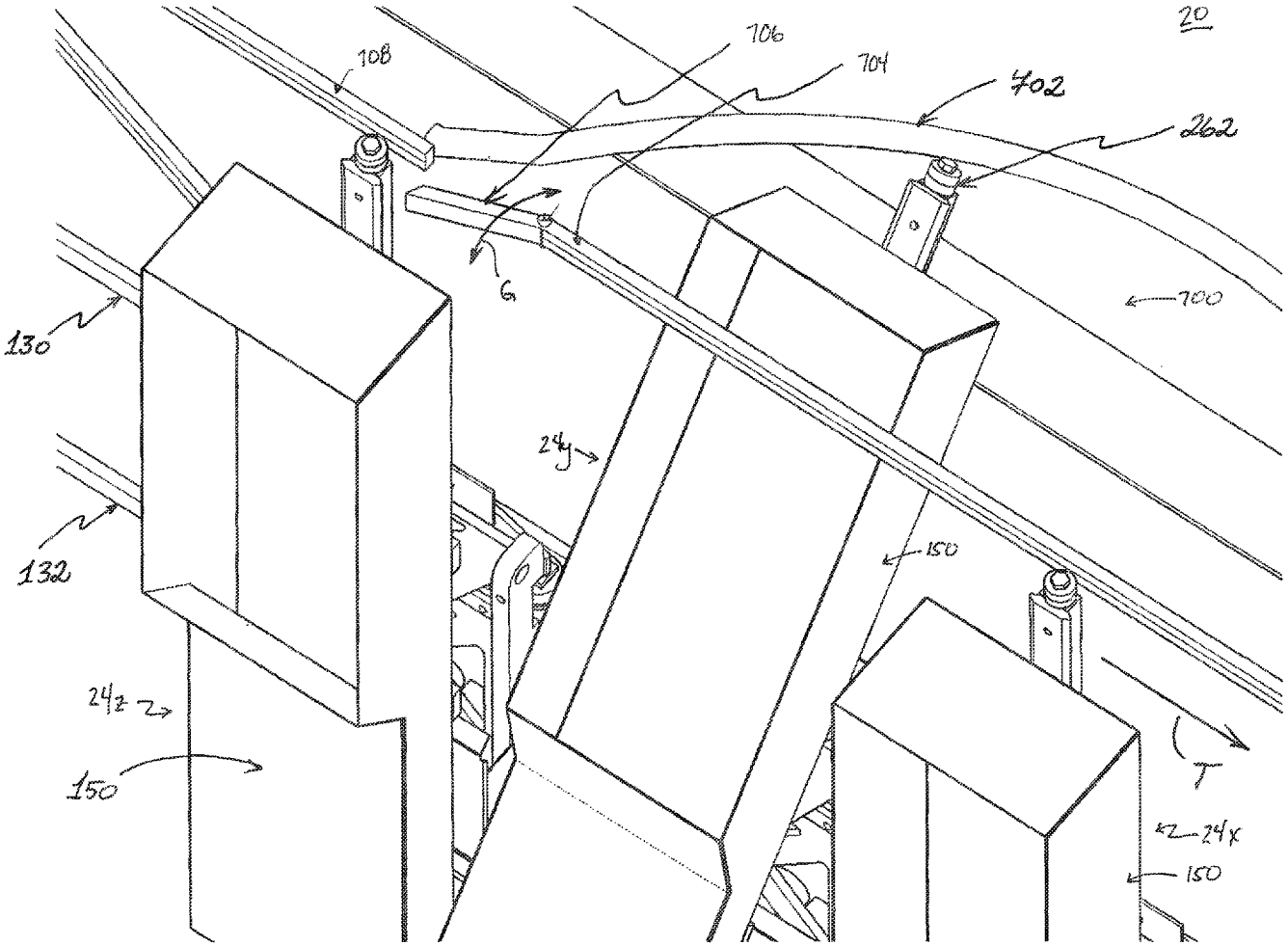
FIG. 25B is an enlarged perspective view of the transitional flight assembly of FIG. 25A.

For example, in FIGS. 25A and 25B, the mandrel 150 of a sequentially next mandrel apparatus 24*z* is traversing the path of travel T and is poised to exit the lead-in rail 708 and interface with either the tilt guide track 702 or the bypass rail 704. Under circumstances where it is determined that the mandrel 150 of the sequentially next mandrel assembly 24*z* is to be employed to form and load a package, the gate 706 pivots away from the lead-in rail 708 (along the pivot path G in FIG. 25B), thereby permitting (or guiding) the tilt control bearing 262 to engage or "enter" the tilt guide track 702. As described above, with continued movement of the mandrel 150 along the path of travel T, cammed interface between the tilt control bearing 262 and the tilt guide track 702 causes the mandrel 150 to pivot or transition from the vertical orientation to the horizontal orientation. FIGS. 25A and 25B illustrate the mandrel 150 of a to-be-acted-upon mandrel apparatus 24*y* (otherwise downstream of the sequentially next mandrel apparatus 24*z*) as having been directed to the tilt guide track 702 and undergoing pivoting rotation.

Conversely, where the mandrel 150 of the sequentially next mandrel apparatus 24*z* will not be employed to form and load a package ("no" at step 602), the gate 706 is pivoted toward the bypass rail 704, with the tilt control bearing 262 thus being directed to follow the bypass rail 704. FIGS. 25A and 25B illustrate the mandrel 150 of a to-be-left-open mandrel apparatus 24*x* (otherwise downstream of the pivoting mandrel apparatus 24*y*) as having been directed to the bypass rail 704 and remaining vertical. Thus, where a determination is made that a sufficient quantity of product does not exist at the loading station 32 (i.e., "no" at 602), the sequentially next mandrel 150 remains in the vertical orientation at 606.

With respect to the mandrel(s) 150 that remain in the vertical orientation when passing through the partial package forming station 30 (i.e., "no" at step 602), the mandrel 150 is not acted upon by components or modules of the partial package forming station 30. That is to say, a partial film bag and/or partial carton is not wrapped or formed about the mandrel 150. The mandrel 150 simply progresses along the path of travel T with no package formation or product loading being performed thereon at 606 until the mandrel 150 has passed along the entire path of travel T and is again presented at the partial package forming station 30. Conversely, with respect to a now horizontally oriented mandrel (at step 604), at step 608, the partial package 500 is formed about the mandrel 150 as the mandrel 150 progresses through the partial package forming station 30. In some embodiments, the partial package provided at the station 30 can include the film-based bag 486 (FIG. 16) formed within a paperboard-based partial carton 496 (FIG. 17) as described above. Alternatively, the system 20 can be configured and/or operated such that only one of the partial bag 486 or the partial carton 496 is formed over the mandrel 150.

For example, certain packaging formats may require only that the product 514 be contained within a flexible bag. Under these circumstances, the conveyor assembly 22 continuously moves the mandrel 150 along the path of travel T, with the horizontally-oriented mandrel 150 (at the partial package forming station 30) being acted upon by the film handling module 300 and the sleeve module 302 as described above. The carton picker module 304 and/or the carton forming module 306 can be deactivated or can operate normally, but flat carton blanks are simply not loaded or provided to the carton picker module 304. In yet other embodiments in which the desired packaging format consists only of a flexible bag, the carton picker module 304 and the carton forming module 306 (as well as other modules such as the carton flap tucking module 310 and/or the carton completion module 314) can be omitted from the package forming and loading system 20.

The package forming and loading system 20 can similarly accommodate a packaging format requiring only a paperboard-type carton. For example, the film handling module 300 can operate as described above, but simply not be provided with the film source rolls 320, 322 (FIG. 9). The horizontally oriented mandrel 150 simply passes through the film handling module 300 and the sleeve module 302 as described above, but no film is applied. Alternatively, the system 20 can be configured such that one or more of the film handling module 300, the sleeve module 302 and/or the film sealing module 308 are omitted.

Following formation of the partial package 500, the method continues to step 610 at which a desired quantity of the product 514 is dispensed into the mandrel 150 as described above. For example, the mandrel 150 is rotated or pivoted from the horizontal orientation to or toward the vertical orientation. Once again, this change in spatial orientation can be accomplished in various manners relative to continuous movement of the mandrel 150 along the path of travel T.

At 612, the partial package 500/loaded product 514 is optionally subjected to vibrational forces at the compacting station 34, followed by separation of the mandrel 150 from the partial package 500/loaded product 514 via the separation station 36 at step 614. Finally, the partial package 500 is closed at step 616 (via the package completion station 38) resulting in a completed, packaged good article.

Figure 26:
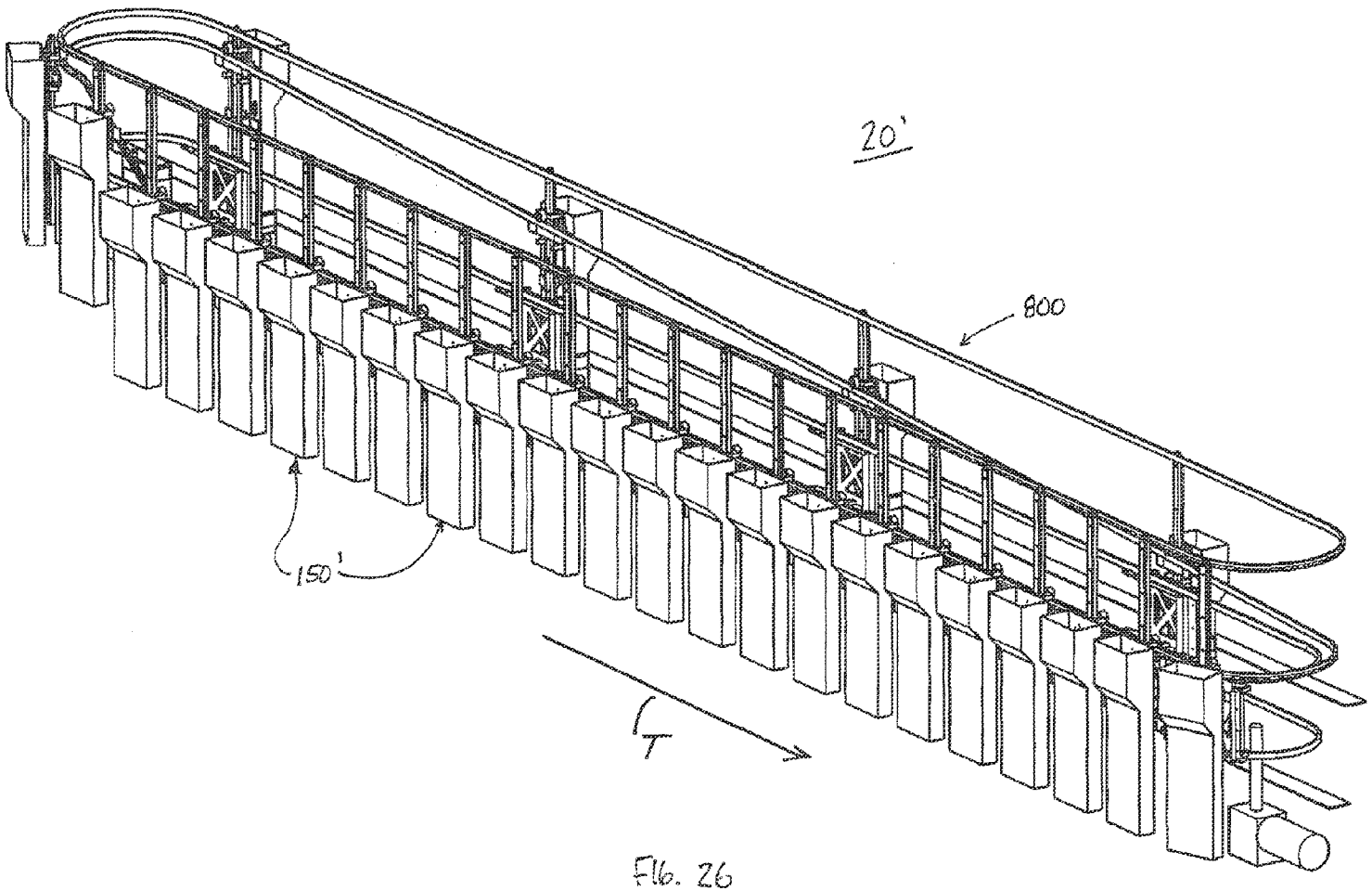
FIG. 26 is a simplified perspective view of an alternative package forming and loading system in accordance with principles of the present disclosure.

The systems and methods of the present disclosure provided a marked improvement over previous designs. The automated systems elegantly combine package formation and product loading into a single system that reduces warehousing and shipping costs, footprint, power, and operators. The pivoting mandrel apparatuses disclosed herein uniquely facilitate this combined operational approach. In other embodiments, densifying product loaded into a partial package prior to closing the partial package beneficially reduces an overall size of the package, and thus costs; further, by effectuating product densification by vibrating the partial package and/or the mandrel while the partial package remains on the mandrel allows the systems and methods of the present disclosure to operate at significant line speeds. In fact, although the present disclosure has described the product densification features in the context of a pivoting mandrel manufacturing process, in other embodiments, the product densification features and related methods are equally useful with package forming and loading systems and methods in which the partial package forming mandrel remains in the same spatial orientation (e.g., vertical or horizontal) throughout an entirety of the manufacturing process. In this regard, FIG. 26 illustrates a portion of an alternative package forming and loading system 20' in accordance with the present disclosure in which mandrels 150' remain vertical throughout the path of travel T, and are subjected to product compacting or densification (identified generally at 800) by vibrating one or both of the mandrels 150' and/or partial packages (not shown) formed about and carried thereby, following partial package formation but prior to package completion as described above.

Although the present disclosure has been described with reference to preferred embodiments, workers skilled in the art will recognize that changes can be made in form and detail without departing from the spirit and scope of the present disclosure.

What is claimed is:

1. A packaging forming and loading apparatus for use with a packaging machine, the apparatus comprising:

a package portion including a tubular body forming an interior passage extending between, and open at, opposing leading and trailing ends, the tubular body having a rectangular shape defining a front face, a rear face, and opposing first and second side faces; and a loading portion including:

a front wall defining opposing, front wall first and second ends, a rear wall opposite the front wall and defining opposing, rear wall first and second ends, the rear wall first end being longitudinally proximate the front wall first end, opposing first and second side walls connected to and extending between the front and rear walls, wherein the walls combine to form a funnel segment defining a closed perimeter funneling pathway terminating at the front wall second end, a transverse cross-sectional area of the funneling pathway at the front wall second end being greater than the transverse cross-sectional area of the funneling pathway at the front wall first end, an end wall interconnecting the rear wall and the opposing side wall opposite the front wall, wherein a plane of the end wall is perpendicular to a central axis of the loading portion, and further wherein the rear wall second end is longitudinally beyond the front wall second end in a direction opposite the rear wall first end to define a portion of a loading region fluidly open to the funneling pathway;

wherein upon final assembly of the loading portion to the package portion, the funneling pathway is fluidly connected to the interior passage to facilitate delivery of product from the loading region to the interior passage via the funneling pathway.

2. The apparatus of claim 1, wherein each of the side walls project in a plane perpendicular to a plane of the rear wall and terminate in a side wall terminal end opposite the rear wall, and further wherein the perimeter is further partially defined by the side wall terminal ends.

3. The apparatus of claim 2, wherein the first side wall is co-planar with the first side face, and the second side wall is co-planar with the second side face, and further wherein along the open perimeter, a lateral distance between the rear wall and the first side wall terminal end is less than a lateral distance between the rear wall and the second side wall terminal end.

4. The apparatus of claim 3, wherein the second side wall terminal end is co-planar with the front wall terminal end, and the first side wall terminal end is laterally between a plane of the front wall terminal end and a plane of the rear wall.

5. The apparatus of claim 1, further comprising:

a bracket mounted to the rear wall and configured to receive a slide assembly.

6. The apparatus of claim 5, wherein the bracket is further mounted to the rear face.

7. The apparatus of claim 5, wherein the slide assembly comprises:

a mounting plate adapted for attachment to the bracket; and an arm slidably assembled to the mounting plate.

8. The apparatus of claim 7, wherein the slide assembly further includes a lift roller mounted to the mounting plate such that a lifting force applied to the lift roller causes the package portion to slide relative to the arm.

9. The apparatus of claim 7, wherein the arm defines opposing first and second ends, and further wherein a pivot control bearing is connected to the first end of the arm and a pivot rod is connected to the second end of the arm, the pivot rod being pivotably connectable to a carriage assembly otherwise forming part of a conveyor chain for moving the apparatus along a path of travel.

* * * * *